US005388725A

United States Patent [19]

Lichfield

[11] Patent Number: 5,388,725

[45] Date of Patent: Feb. 14, 1995

[54] FLUID-DRIVEN APPARATUS FOR DISPENSING PLURAL FLUIDS IN A PRECISE PROPORTION

[75] Inventor: William H. Lichfield, Corinne, Utah

[73] Assignee: Fountain Fresh International, Salt Lake City, Utah

[21] Appl. No.: 158,199

[22] Filed: Nov. 24, 1993

[51] Int. Cl.[6] ..... B67D 5/56; F04B 11/00

[52] U.S. Cl. ..... 222/1; 91/346; 222/129.2; 222/132; 222/136; 222/249; 417/397

[58] Field of Search ..... 222/1, 129, 129.1–129.4, 222/132, 135–137, 145, 249, 250, 334; 417/393, 395, 397, 403, 404; 91/346

[56] References Cited

U.S. PATENT DOCUMENTS

| | | | |
|---|---|---|---|
| 1,169,666 | 1/1916 | Mayer | 222/129.2 X |
| 1,366,529 | 1/1921 | Frick | 222/129 X |
| 1,429,574 | 9/1922 | England et al. | 222/129 X |
| 1,553,994 | 9/1925 | Estes | 222/129.2 |
| 1,654,004 | 12/1927 | Lind | 222/129.2 X |
| 1,906,839 | 5/1933 | Christianson | 222/129.2 |
| 1,912,171 | 5/1933 | Austin | 222/129.2 X |
| 2,201,545 | 5/1940 | Mazzanobile | 222/129.4 X |
| 2,371,432 | 3/1945 | DiPietro | 222/145 X |
| 2,372,360 | 3/1945 | Cornelius | 222/129.2 |
| 2,379,532 | 7/1945 | Lloyd | 222/129 |
| 2,401,914 | 6/1946 | DiPietro | 222/145 X |
| 2,427,429 | 9/1947 | Waite et al. | 222/249 X |
| 2,434,374 | 1/1948 | Tull | 222/129 X |
| 2,455,681 | 12/1948 | Kantor et al. | 222/129 X |
| 2,462,019 | 2/1949 | Bowman | 222/1 |
| 2,502,610 | 4/1950 | Wegman | 222/129.2 X |
| 2,517,301 | 8/1950 | Gottlieb | 222/129.1 |
| 2,527,927 | 10/1950 | Grow, Jr. | 222/129 |
| 2,533,281 | 12/1950 | Oliveau | 222/136 |
| 2,535,835 | 12/1950 | Burgess | 222/129.1 |
| 2,536,400 | 1/1951 | Thompson | 222/129.2 X |
| 2,537,119 | 1/1951 | Bauerlein | 222/129.2 X |
| 2,565,084 | 8/1951 | Parks | 222/2 X |
| 2,566,436 | 9/1951 | Waite | 222/129.2 X |
| 2,573,888 | 11/1951 | Benjamin | 222/145 |
| 2,585,172 | 2/1952 | Reynolds | 222/129.2 X |
| 2,588,217 | 3/1952 | DeMille | 222/249 X |
| 2,698,703 | 1/1955 | Harvey | 222/129 X |
| 2,731,906 | 1/1956 | King | 222/256 |
| 2,736,466 | 2/1956 | Rodth | 222/136 |

(List continued on next page.)

FOREIGN PATENT DOCUMENTS

| | | |
|---|---|---|
| 0113486 | 7/1984 | European Pat. Off. . |
| 0223568 | 5/1987 | European Pat. Off. . |
| 0253406 | 1/1988 | European Pat. Off. . |
| 2124464 | 9/1972 | France . |
| 1160690 | 8/1969 | United Kingdom . |

*Primary Examiner*—Kevin P. Shaver
*Attorney, Agent, or Firm*—Workman, Nydegger and Seeley

[57] ABSTRACT

A fluid-driven proportioning pump for dispensing precise volumes of at least three different fluids includes a drive cylinder housing a correspondingly formed drive piston which divides the drive cylinder into first and second drive fluid chambers and is propelled in a reciprocating motion by a pressurized drive fluid. The housing for the drive cylinder is comprised of two identical hollow housings mutually matingly engaged at the open ends thereof. The face of the drive piston is provided with projecting proportioning pistons which extend into proportioning cylinders that open into each drive fluid chamber. An over-center mechanism triggered by movement of the drive piston at the extremes of the strokes of the reciprocating motion thereof operates valving that admits the pressurized drive fluid into turn it of the drive fluid chambers. The over-center mechanism is activated by hoop springs and is housed entirely within the drive cylinder. A drive cylinder liner sleeve is disposed on the interior of the drive cylinder extending at least to the extremes of movement of the drive piston and bridging the engaged mating surfaces of the two identical cup-shaped halves of the proportioning pump housing.

135 Claims, 22 Drawing Sheets

U.S. PATENT DOCUMENTS

| | | | |
|---|---|---|---|
| 2,770,394 | 11/1956 | Mueller | 222/1 |
| 2,808,815 | 10/1957 | Cromwell | 91/322 |
| 2,894,377 | 7/1959 | Shikles, Jr. et al. | 222/129.1 X |
| 3,011,681 | 12/1961 | Kromer | 222/1 |
| 3,047,021 | 7/1962 | Turak | 222/129 X |
| 3,058,620 | 10/1962 | Kromer | 222/1 |
| 3,259,273 | 7/1966 | Kromer | 222/1 |
| 3,263,864 | 8/1966 | Welty et al. | 222/129 |
| 3,310,203 | 3/1967 | McCann | 222/54 |
| 3,317,084 | 5/1967 | Welty | 222/57 |
| 3,322,305 | 5/1967 | Tremolada | 222/61 |
| 3,348,737 | 10/1967 | Yingst et al. | 222/58 |
| 3,357,598 | 12/1967 | Kraft | 222/134 |
| 3,366,276 | 1/1968 | Fridley | 222/51 |
| 3,503,540 | 3/1970 | Fuerst | 222/129.1 |
| 3,589,569 | 6/1971 | Bonetti | 222/250 |
| 3,591,051 | 7/1971 | Mitchell et al. | 222/56 |
| 3,640,433 | 2/1972 | Rodth | 222/129.2 |
| 3,643,688 | 2/1972 | Meinert | 137/556 |
| 3,650,434 | 3/1972 | Johnson et al. | 222/31 |
| 3,664,550 | 5/1972 | Carothers | 222/129.2 |
| 3,717,284 | 2/1973 | Gerrard | 222/108 |
| 3,727,844 | 4/1973 | Bencic | 222/129.1 X |
| 3,756,456 | 9/1973 | Georgi | 222/1 |
| 3,756,473 | 9/1973 | Donahue, Jr. | 222/129.2 |
| 3,776,665 | 12/1973 | Dalton | 417/252 |
| 3,799,402 | 3/1974 | Meister | 222/129.2 |
| 3,935,971 | 2/1976 | Papoff et al. | 222/134 |
| 3,940,019 | 2/1976 | Kross et al. | 222/30 |
| 3,945,536 | 3/1976 | Doak | 222/148 |
| 3,948,419 | 4/1976 | Polster | 222/61 |
| 3,981,414 | 9/1976 | Gust et al. | 222/38 |
| 3,991,219 | 11/1976 | Kuckens | 222/129.4 X |
| 4,032,040 | 6/1977 | Kecskemethy et al. | 222/1 |
| 4,104,008 | 8/1978 | Hoffmann et al. | 417/397 |
| 4,121,507 | 10/1978 | Kuckens | 222/129.1 X |
| 4,180,090 | 12/1979 | Bemba | 222/249 X |
| 4,194,650 | 4/1980 | Nottke et al. | 222/133 X |
| 4,349,130 | 9/1982 | Bair | 222/129.2 |
| 4,350,503 | 9/1982 | Skoli et al. | |
| 4,390,035 | 6/1983 | Hill | 137/99 |
| 4,392,508 | 7/1983 | Switall | 137/99 |
| 4,411,601 | 10/1983 | Hersom et al. | 417/388 |
| 4,467,941 | 8/1984 | Du | 222/1 |
| 4,479,758 | 10/1974 | Hersom et al. | 222/129.2 X |
| 4,582,226 | 4/1986 | Doak | 222/148 |
| 4,599,239 | 7/1986 | Wieland et al. | 426/590 |
| 4,659,294 | 4/1987 | Barthomeuf | 417/397 |
| 4,708,266 | 11/1987 | Rudick | 222/105 |
| 4,726,493 | 2/1988 | Wallace et al. | 222/129.1 |
| 4,753,370 | 6/1988 | Rudick | 222/105 |
| 4,779,761 | 10/1988 | Rudick et al. | 222/1 |
| 4,780,064 | 10/1988 | Olsen | 417/397 |
| 4,827,832 | 5/1989 | Hartley et al. | 91/269 |
| 5,058,768 | 10/1991 | Lichfield | 222/1 |
| 5,060,824 | 10/1991 | Credle, Jr. | 222/129.2 X |

FLUID-DRIVEN APPARATUS FOR DISPENSING PLURAL FLUIDS IN A PRECISE PROPORTION

BACKGROUND

1. The Field of the Invention

This invention relates to devices for dispensing a plurality of fluids in a precise ratio to each other. More particularly, the invention disclosed herein relates to an improved fluid-driven liquid proportioning pump that effects the positive displacement in a precise ratio of an externally pressurized drive fluid and one or more constituent fluids. While adaptable to a number of diverse uses, the methods and apparatus of the present invention have ready applicability in the field of mixing and dispensing beverages.

2. Background Art

Many aspects of industrial processing and consumer merchandising require the continuous, precise dispensing and simultaneous mixing of a plurality of constituent fluids into a desired product. This is the case in the manufacture of paints, pesticides, fertilizers, and industrial sealants, as well as in the preparation of cosmetics, pharmaceuticals, toothpaste, and even foods, such as margarine, syrups, and beverages.

While the methods and apparatus of the present invention finds utility in each of the above-named and other fields, an immediate application of the present invention resides in meeting the demand in the beverage industry for an improved manner by which the constituent fluids of beverages may be dispensed and mixed into a consumer product within the narrow specifications that are dictated by consumer tastes. Such beverages may be of both the carbonated and the non-carbonated variety.

In the retail area the dispensing of individual constituent fluids for mixture into a final consumable product is prominent in relation to the retailing of carbonated and other syrup-based beverages and juices. This occurs in restaurants and fast food establishments, at entertainment and sport events, and at grocery stores, where purchases of customer-dispensed beverages is on the rise.

In the production of cola-type beverages, orange and other fruit drinks, lemonade, and the like, aromatic flavoring agents in liquid form, such as syrups and concentrates, are metered and combined with predetermined quantities of carbonated or plain water. Typically, the water is pressurized and mixed with the syrups to form a finished beverage that may be dispensed either into reusable or disposable containers.

This process of dispensing and blending into a final mixture the proper quantities of each fluid in a manner capable of satisfying the sensitized tastes of the consuming public has been rendered more complicated in recent years by two developments. First, the public preference for artificially sweetened carbonated beverages has increased dramatically. Second, the perceived necessity to replace the artificial sweetener saccharin with another has resulted in a widespread shift by the food industry to the use of the artificial sweetener, aspertaime, which is commonly marketed under the trademark NUTRASWEET®. Unfortunately, aspertaime has a relatively short shelf life, after which the flavor of the sweetener undergoes markedly noticeable alteration.

This fact about aspertaime has lead to the practice in the soft drink industry of separating the sweetening element from the aromatic syrups, so that the turnover of sweetener supplies can be accelerated. Accordingly, in dispensing and blending the components of a carbonated beverage that is to contain aspertaime, it is now necessary to blend, not merely two different constituent fluids, but three: water, an aromatic syrup, and an artificial sweetener.

The effort to develop fluid proportioning devices suitable for metering more than two constituent fluids has cast in a harsher light the drawbacks of the devices previously developed toward the dispensing of only two constituent fluids.

Prior devices were complicated, requiring plural conduits, complex valving, and forms of involved linkages for effecting coordination between the operation of otherwise independent dispensing mechanisms. Devices which failed to physically integrate the dispensing mechanisms necessitated the use of additional mechanical system for coordinating the necessarily separate dispensing functions. This added to the complexity of dispensing devices, resulting in a need for increased maintenance. The resort to electrical drive motors as a source of motive power for the prior devices only complicated the proportioning pumps by adding thereto another system needing its own separate maintenance and isolation for safety and operational purposes.

Many proportioning pumps were reciprocating in nature, but were successful in dispensing all of the constituent fluids in only one direction of their reciprocating motion. This produced uneven flow and irregular ratios of the constituent fluids involved in each cycle of operation.

The actual proportioning aspect of such devices presented several problems. Many simply were not accurate, so that a user was faced with unreliability in preparing a final product. The proportioning function was frequently effected by valving external to the mechanism with which the constituent fluids were actually advanced through the system. Such external valving itself comprised a separate system of mechanical operation requiring its own maintenance and coordination.

A significant problem in prior proportioning pumps was the number of dynamic seals required to segregate the plurality of fluids involved, to preserve pressure in the device, and to prevent fluid leakage. In many cases, of necessity, one or more of these seals was exposed on one side to the atmosphere, tending to age such seals rapidly due to drying. The concomitant need for replacement and repair of such components is readily predictable.

The reliability of numerous prior proportioning pumps has been impaired by the entrapment of air bubbles within the chambers and fluid passageways thereof. Air bubbles would not of themselves impair reliability, if the air bubbles could be successfully induced to move through and out of the proportioning pump with the flowing constituent fluids. Air bubbles tend to rise to the highest point within a proportioning pump and accumulate there. Thus, both the internal design of proportioning pumps and the orientation of the mounting thereof to fixed surfaces at the location of use have tended to defeat the desirable objective of purging the proportioning pumps of air bubbles during normal use.

Some proportioning pumps have accordingly been supplied with air bubble venting stop cocks that communicate with the highest points in various chambers and fluid passageways in the proportioning pump.

Through periodic operation of these venting stop cocks, entrapped air is in theory removed. Disadvantageously, however, venting stop cocks increased the complexity of proportioning pumps, the tendency to leak, and the need for additional maintenance activity, if only that of manually operating the stop cocks on a periodic basis.

Ultimately, prior fluid proportioning pumps were complicated assemblages of separate mechanical systems. Each separate component system required its own maintenance. Intervening systems were necessary for effecting coordinated operations. In the effort to streamline such devices, designers were faced with two conflicting tendencies. The subsystems additional to that used to advance constituent fluids could be located external to the advancement system, where they would be relatively easily accessible for maintenance and adjustment purposes but relatively difficult to coordinate in any simple manner. Alteratively, such additional subsystems could be integrated into the mechanical structure of the fluid advancement subsystem rendering them difficult to access, while possibly more easy to coordinate.

All such drawbacks existed in proportioning pumps used with just two constituent fluids. The need for proportioning pumps which could effectively dispense more than two fluids exacerbated known problems. Additional constituent fluids require additional subsystems for coordination and proportioning. Devices grew more complex, rather than simpler, as would have been desired.

One method and apparatus which coped effectively with additional constituent fluids and simplified the number of subsystems and components involved is disclosed in U.S. Pat. No. 5,058,768, which will be referred to hereinafter as the '768 Patent.

In the '768 Patent a fluid-driven proportioning pump is illustrated that dispenses precise volumes of at least three different constituent fluids, including among them a pressurized drive fluid. The proportioning pump comprises a drive cylinder made up of a tube closed at each end by a plate assembly. A correspondingly formed drive piston is disposed in the drive cylinder, dividing the drive cylinder into first and second drive fluid chambers. The drive piston is propelled in a reciprocating motion alternately toward each of the drive fluid chambers by the pressurized drive fluid itself. Passageways for admitting the drive fluid into and removing drive fluid from each of the drive fluid chambers are formed in the end plate assemblies that effect closure of the tube of the drive cylinder.

Each face of the drive piston is provided with a projecting proportioning piston corresponding to each of the non-pressurized constituent fluids. These proportioning pistons extend into corresponding proportioning cylinders that open into each fluid drive chamber toward the drive piston. Passageways into and out of each of the proportioning cylinders are formed in the end plate assemblies that effect closure of the tube of the drive cylinder.

A valving mechanism housed entirely within the drive cylinder regulates the flow of the drive fluid into and out of the drive fluid chambers on opposite sides of the drive cylinder. The valving mechanism passes rigidly through the reciprocating drive piston into value bores in each of the two opposed end plate assemblies. While the economy of mechanisms resulting from this valving mechanism is advantageous, the valving mechanism requires extremely precise alignment among the valving mechanism, the drive piston, and the two end plate assemblies of the device. Otherwise, the valving mechanism and the drive piston in undertaking to move in the respective roles of each, experience unacceptable levels of binding stress that reduces efficiency and can even prevent the desired operation of the device. This places severe constraints on the assembly precision required in manufacturing the proportioning pump disclosed in the '768 Patent.

An over-center mechanism activated by movement of the drive piston at the extremes of the strokes of the reciprocating motion thereof operates the valving mechanism and admits the pressurized drive fluid into alternate of the drive fluid chambers. The over-center mechanism is activated by system of loop springs disposed in each of the first and second drive fluid chambers and retained in different degrees of compression between the drive piston and the valving mechanism. The degree of compression in the system of loop springs varies continuously according to the position of the drive piston during the reciprocating movement thereof. This arrangement in the proportioning pump of the '768 Patent, while found to be an improvement over earlier prior proportioning devices, is still somewhat sluggish in responsiveness, particularly in any initial operation of the proportioning pump after a prolonged period of dormancy.

In the proportioning pump disclosed in the '768 Patent selective adjustment of the proportion among the drive fluid and the other constituent fluids is enabled from the exterior of the proportioning pump through the use of a complicated mechanical system. This proportioning adjustment system requires, however, that the proportioning pistons to be configured as disk-like piston heads that are slidably mounted on a turnable shaft that projects from the end face of the drive piston. The shaft has an enlarged head on the side of the disk remote from the drive piston. The head of the shaft is provided with a fitting that is manipulatable from the outside of the proportioning pump by built-in retractable tools that are provided for each distinct proportioning piston head. All elements of the proportioning adjustment system are advantageously contained within the proportioning pump.

While this arrangement affords the convenience of post-assembly adjustments to the portion among the drive fluid and other constituent fluids, the result is extremely complex mechanically, increasing dramatically the number of differing parts required in the assembly of the proportioning pump. Access to the interior of the proportioning pump for this purpose, much like the introduction of air bubble venting stop cocks, not only increases the complexity of the proportioning pump itself, but the tendency thereof to leakage.

One unexpected disadvantage of an externally adjustable proportioning adjustment system is a tendency for a proportioning pump set at a predetermined desired portion among the drive fluid and constituent fluids dispensed therefrom to deviate from that predetermined proportion during use. As a result, periodic testing of the proportions among those fluids in the output is required, and concomitantly periodic recalibration of the proportioning pump. Thus, a proportioning pump such as that disclosed in the '768 Patent which must be fine-tuned after manufacture, is one which demands ongoing related maintenance activity.

The drive fluid passageways and constituent fluid passageways formed in each end plate of the proportioning pump disclosed in the '768 Patent necessitate the attachment to that proportioning pump of at least four hoses for the drive fluid, as well as four hoses for each of the other individual constituent fluids. For each single fluid an input and an output hose must be connected to the end plate assembly on each end of the drive piston. For a single drive fluid and a pair of constituent fluids, twelve hose couplings are thus required.

Difficulties have been encountered due to competing requirements relative to the structure and material composition of which the tube of a proportioning pump is comprised. The first and second drive fluid chambers housed within that tube are separated from each other by the reciprocating drive piston. The circumference of the drive piston is fitted with an encircling sealing ring that effects the actual sealing and sliding contact with the inner walls of that tube.

When introduced into the drive cylinder one effect of the pressurized drive fluid is to distort the shape of the tube of the drive piston. This produces two adverse effects. First, the desired ratio between the drive fluid and one or both of the other constituent fluids is altered. Secondly, changes in the shape of the drive cylinder can impair the seal effected by the sealing ring on the drive piston with the inner walls of the tube of the pump.

Efforts to rigidify the tube of the drive cylinder against the effects of the pressure of the drive fluid have been numerous. Each has proved unsuccessful for distinct reasons.

The walls of the tube of the drive cylinder have, for example, been thickened dramatically resulting in a more rigid structure, but also in a more bulky device that, by consuming substantial quantities of constituent material, is expensive to manufacture. Alternatively, the thickness of the walls of the tube of the drive cylinder has been maintained at an acceptable size by forming the tube of the drive cylinder from a very strong material. If in the process a castable material is used such as steel, then the cost of manufacturing the device is still quite high.

On the other hand, efforts toward the same end have been made using inexpensive moldable materials such as resins, but to achieve adequate strength in the device these materials quire reinforcement, usually by adding thereto a matrix of reinforcing fibers. This has resulted in a marked roughening of the inner surface of the tube of the drive cylinder. Correspondingly, abrasion of the sealing ring on the reciprocating drive piston has increased, along with the need for remedial maintenance.

OBJECTS AND SUMMARY OF THE INVENTION

One object of the present invention is to provide methods and apparatus for simultaneously dispensing precisely measured quantities of at least three different constituent fluids.

Another object of the present invention is to provide a fluid proportioning apparatus which effects the positive displacement of the constituent fluids involved, but which does so with a consistent precision of operation acceptable in the industry in which the teachings of the present invention are applied.

Yet another object of the present invention is a fluid proportioning apparatus as described above which is driven exclusively by the pressure exerted by one of the constituent fluids being dispensed.

An additional object of the invention is an apparatus for proportioning fluids as described above which utilizes reciprocating motion and which is capable of continuously dispensing the constituent fluids involved.

Another object of the present invention is an apparatus for proportioning fluids in which the dynamic seals thereof avoid exposure to the atmosphere, and therefore benefit from effective lifetimes of enhanced duration.

Yet another object of the present invention is a fluid proportioning pump for at least three fluids which is mechanically streamlined in relation to prior proportioning pumps so as to be compact, easily assemble from a minimum of differing components, and minimally demanding of maintenance.

Still another object of the present invention is a fluid proportioning pump as described above in which the drive cylinder resists distortion caused by the pressure of the drive fluid.

Nevertheless, it is also an object of the present invention in improving the structural rigidity of the drive cylinder in a fluid proportioning pump as described above to avoid increasing the size of the overall device, as well as to maintain or extend the useful lifetime of the sealing ring disposed between the inner surface of the drive cylinder and the periphery of the drive piston reciprocating therein.

Additionally, an object of the present invention is to ease the mechanical alignment constraints imposed on the assembly of a fluid proportioning pump of the type described above.

More particularly it is an object of the present invention to provide a valving mechanism for the drive fluid of such a proportioning pump, such as that described above, which is operably tolerant of misalignments of the components thereof.

Yet another object of the present invention is to provide in a proportioning pump as described above enhanced responsiveness in the shifting mechanism by which the drive fluid therefor is valved alternately on to opposite sides of the drive piston thereof, particularly following periods of proportioning pump dormancy.

It is yet another object of the present invention to reduce the number of hoses required to supply and withdraw fluids from a proportioning pump as described above.

An object of the present invention is to enable the manufacture of liquid a proportioning pump as described above during which manufacturing process the proportion among the constituent fluids to be dispensed by the proportioning pump is easily established, but permanently and reliably maintained thereafter.

An additional object of the present invention is a liquid proportioning pump as described above in which the purging of air bubbles in fluids passing therethrough occurs during normal usage.

A related object of the present invention is to provide a method and apparatus for mounting to a fixed surface a proportioning pump as described above, whereby the purging of air bubbles from the fluids passing therethrough is facilitated.

Finally, one object of the present invention is a proportioning pump capable of operation under the influence of two different pressurized drive fluids, such as pressurized water having a high carbonation content and pressurized water having low or no carbonation content.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a system is provided for dispensing in a precise, predetermined ratio quantities of an externally pressurized drive fluid and one or more of a first constituent fluid and a second constituent fluid. The system comprises a proportioning pump activated by the drive fluid and mounting means for securing the proportioning pump to a fixed surface at any predetermined rotational orientation about the longitudinal axis of the proportioning pump. The proportioning pump and the mounting means incorporate teachings of the present invention that together suppress the accumulation of bubbles in the drive fluid and in the first and the second constituent fluids during the flow thereof through the proportioning pump.

The proportioning pump, however, incorporates additional teachings of the present invention that simplify the manufacture thereof and that insure reliability in the operation thereof for dispensing the drive fluid and at least one of the first and the second constituent fluids in a precise, predetermined ratio.

The proportioning pump portion of the present invention comprises a pump housing that defines therewithin a drive cylinder having closed ends and sidewalls extending therebetween. A drive piston is disposed in the drive cylinder, thereby to be propelled by the drive fluid in a reciprocating motion made up of successive strokes of the drive piston in opposite directions. The drive piston thus separates the drive cylinder into a first and a second drive fluid chamber. The longitudinal axis of the drive cylinder defines the longitudinal axis of the proportioning pump about which the mounting means is capable of securing the proportioning pump at any predetermined rotational orientation to a fixed surface.

Interior of the proportioning pump are a pair of first constituent fluid proportioning cylinders. One of these first constituent fluid proportioning cylinders opens opposite the drive piston into each of tile first and the second drive fluid chambers. Where a second constituent fluid is also dispensed by the proportioning pump, a pair of second constituent fluid proportioning cylinders are also provided interior thereof. These second constituent fluid proportioning cylinders similarly open opposite the drive piston into each of the first and second drive fluid chambers.

Proportioning pistons project from each side of the drive piston and extend into corresponding individual ones of each of the first constituent fluid proportioning cylinders and the second constituent fluid proportioning cylinders, if any. Thus, where both a first and a second constituent fluid are dispensed by the proportioning pump, two pair of such proportioning pistons are provided interior of the proportioning pump. The reciprocating motion of the drive piston alternately advances and retracts the constituent fluid proportioning pistons within each corresponding one of the first and second constituent fluid proportioning cylinders.

A constituent fluid outlet passageway is formed in the housing of the proportioning pump. Each constituent fluid outlet passageway communicates with one of the first and second constituent fluid proportioning cylinders at a constituent fluid discharge site that is located radially remote from the center of each of the corresponding first and second constituent fluid proportioning cylinders. In this manner when the rotational orientation of the proportioning pump about the longitudinal axis of the drive cylinder is such that the constituent fluid discharge sites are at the top of the corresponding one of the first and second constituent fluid proportioning cylinders, air bubble accumulation in those constituent fluid proportioning cylinders is suppressed.

Similarly, a constituent fluid inlet passageway is formed in the housing of the proportioning pump corresponding to each of the first and second constituent fluid proportioning cylinders. Each of the constituent fluid inlet passageways communicates with one of the first and second constituent fluid proportioning cylinders at a constituent fluid influx site that is located radially remote from the center of each of the corresponding first and second constituent fluid proportioning cylinders. Optimally each constituent fluid influx site is also located opposite from the constituent fluid discharge site for the same constituent fluid proportioning cylinder. This relationship between the constituent fluid inlet passageway and the constituent fluid outlet passageway for each constituent fluid proportioning cylinder further contributes to the suppression of air bubble accumulation in the proportioning pump.

By way of example and not limitation, the mounting means of the inventive system comprises in one embodiment thereof a clamp means for engaging the proportioning pump and a mount capable of securing the clamp means to a fixed surface. The clamp means nondestructively encircles the proportioning pump at a longitudinally medial position thereon. In one embodiment of the clamp means a pair of semi-circular bands are provided that are nondestructively mutually attachable at the ends thereof so as to tightly encircle the pump housing. The rotational orientation of the pump housing about the longitudinal axis thereof can be adjusted within the semi-circular bands to achieve an optimum angular orientation for bubble suppression, before the ends of the semi-circular bands are securely attached to each other and the pump housing is thereby clamped into a fixed orientation. Nevertheless, the attachment at the ends of the semi-circular bands can be released to permit repair, replacement, or reorientation of the pump housing as needed.

The pump housing of the inventive proportioning pump advantageously comprises identical first and a second hollow housings. Each has an open end. The first and second hollow housings are mutually matingly engaged at the open ends thereof to define therewithin the drive cylinder and the first and second drive fluid chambers thereof. The pump housing of the proportioning pump can thus be assembled from a pair of identical structures exclusively.

Each of the first and second hollow housings comprises two elements. The first of these is a shell means for defining a single closed end of the drive cylinder and for enclosing in the interior thereof an individual one of the first and second drive fluid chambers. The second element of each of the hollow housings comprises fluid communication means for coupling sources of the drive fluid and the first and second constituent fluids to the interior of the shell means. The structure of each of the shell means and of the fluid communication means will be described below in that order.

The shell means comprises a cup-shaped canister. That canister includes an end wall, sidewalls projecting from and encircling the periphery of the end wall, and a mating surface on the ends of the sidewalls remote from the end wall. The mating surface of the canister of the first hollow housing and the mating surface of the canister of the second hollow housing are engaged in the assembled relationship of the two canisters to form a sealing joint of the drive cylinder.

A drive cylinder liner sleeve is disposed against the interior of the sidewalls of the two canisters in the assembled relationship thereof. The drive cylinder liner sleeve is positioned along the sidewalls of the two canisters bridging the sealing joint of the drive cylinder therebetween. The drive cylinder liner sleeve extends at least to the respective extremes of the range of travel of the drive piston in the reciprocating motion thereof. Optionally the drive cylinder liner sleeve is comprised of a material having a high lubricity, such as material with a high teflon content. This reduces friction and wear on internal components of the proportioning pump, and in particular on the drive piston sealing ring dispensed in one embodiment of the proportioning pump between the inner surface of the drive cylinder and the periphery of the drive piston.

The fluid communication means of each of the first and second hollow housings comprises a fluid tubing manifold that is nestable about the exterior of a corresponding one of the canisters of the hollow housings. Each fluid tubing manifold comprises an end plate which is positionable against the exterior of the end wall of the corresponding canister. Various fluid passageways are formed in the end plate of the fluid tubing manifold.

Each of the fluid passageways communicates from the exterior of the fluid manifold to the drive fluid chamber in the corresponding canister. These fluid passageways may include a pressurized drive fluid inlet passageway, a drive fluid outlet passageway, a first constituent fluid inlet passageway, a first constituent fluid outlet passageway, a second constituent fluid inlet passageway, and a second constituent fluid outlet passageway.

A pair of fluid tubing manifolds nestable about the exterior of the drive cylinder at each of the first and the second drive fluid chambers enables convenient coupling of tubing from the proportioning pump to sources of the drive fluid and of the first and second constituent fluids.

The fluid tubing manifold also comprises an assembly cage extending from the end plate along the exterior of the sidewalls of the corresponding canister. A fluid tubing manifold assembly flange is provided on the end of the assembly cage remote from the end plate of each fluid tubing manifold. In one embodiment of the fluid tubing manifold the assembly cage comprises a pair of assembly arms diametrically opposed on opposite sides of the end plate, each with a respective assembly flange on the free end thereof.

The fluid tubing manifold assembly flanges for the fluid tubing manifold of one of the hollow housings is clamped by the clamp means of the mounting means of the inventive systems to the fluid tubing manifold assembly flange of the fluid tubing manifold of the other of the hollow housings. In this manner, the first and second hollow housings are secured to each other with the two canisters therewithin engaged at the mating surfaces thereof.

The proportioning pump further comprises a drive reversal means for admitting the pressurized drive fluid alternately into the first and into the second drive fluid chambers. Advantageously the drive reversal means according to the teachings of the present invention is disposed entirely within the drive cylinder of the proportioning pump. The drive fluid reversal means comprises a pressurized drive fluid inlet passageway formed in each of the pump housings at each end of the drive cylinder, and a drive fluid outlet passageway formed in the pump housing at each end of the drive cylinder.

First valve means are provided for placing the first drive fluid chamber in communication alternately with the pressurized drive fluid inlet passageway and with the drive fluid outlet passageway formed in the pump housing at the end of the drive cylinder adjacent to the first drive fluid chamber. Similarly, second valve means are provided for placing the second drive fluid chamber in communication alternately with the pressurized drive fluid inlet passageway and with the drive fluid outlet passageway formed in the pump housing at the end of said drive cylinder adjacent to the second drive fluid chamber.

The drive reversal means includes linkage means for operably interconnecting the first valve means and the second valve means through the drive piston with plural dimensions of alignment freedom. These plural dimensions of alignment freedom ease the mechanical alignment constraints imposed during the assembly of the proportioning pump with the elements of the drive reversal means. This in turn affords for reliable, non-binding operation of these elements.

The linkage means functions to simultaneously operate both the first and the second valve means in either a first or a second operative mode. In the first operative mode the first drive fluid chamber is in communication with the pressurized drive fluid inlet passageway formed in the pump housing at the end of the drive cylinder adjacent thereto, while the second drive fluid chamber is in communication with the drive fluid outlet passageway formed in the pump housing at the end of the drive cylinder adjacent thereto. Conversely, in the second operative mode the first drive fluid chamber is in communication with the drive fluid outlet passageway formed in the pump housing at the end of the drive cylinder adjacent thereto, while the second drive fluid chamber is in communication with the pressurized drive fluid inlet passageway formed in the pump housing at the end of the drive cylinder adjacent thereto.

An over-center means drives the linkage means to operate the first and second valve means between the first and second operative modes responsive to the completion of each of the successive strokes of the reciprocating motion of the drive piston.

The first valve means comprises a first valve bore extending from the first drive fluid chamber into the pump housing at the end of the drive cylinder adjacent to the first drive fluid chamber. The first valve bore communicates with the pressurized drive fluid inlet passageway and with the drive fluid outlet passageway formed in the pump housing at the end of the drive cylinder adjacent to the first drive fluid chamber.

A first valve stem is slidably mounted in the first valve bore. The first valve stem has a first end that is received in the first valve bore and a free end opposite thereto that extends from the first valve bore into the first drive fluid chamber. A first valving passageway formed longitudinally through the first valve stem. The end of the first valving passageway at the first end of the first valve stem opens in both the first and second operative modes into the first drive fluid chamber through the free end of the first valve stem. The other end of the first valving passageway opens through a valving aperture in the first end of the first valve stem into the first valve bore. The valving aperture communicates with the pressurized drive fluid inlet passageway in the first operative mode and communicates with the drive fluid outlet passageway in the second operative mode.

The first valve means further comprises a booster spring retained in the first valve bore in compression between the pump housing and the first end of the first valve stem. The booster spring urges the first valve stem out of the first valve bore toward the first drive fluid cylinder, and thus assists in shifting the first valve means from the second operative mode to the first operative mode.

The second valve means is structured as a mirror image of the first valve means, but is located in the pump housing at the end of the drive cylinder adjacent to the second drive fluid chamber. The booster spring of the second valve means assists in shifting the second valve means from the first operative mode to the second operative mode.

In one embodiment of the linkage means, a valve linkage aperture is formed through the drive piston between the first and second drive fluid chambers. A valve linkage shaft is slidably and sealingly disposed through the valve linkage aperture with the opposed first and second ends of the valve linkage shaft disposed in the first and second drive fluid chambers, respectively. A system of connective links are provided between each of the first and second ends of the valving shaft and the first and second valve means, respectively.

In one embodiment the system of connective links comprises a valve block pivotally and laterally slidably attached on a first side thereof to the first end of the valve linkage shaft and pivotally and laterally slidably attached on the second side thereof to the free end of the first valve stem. These pivotable and slidable connections at each side of the valve block provide plural dimensions of alignment freedom that enable the easy assembly of the elements of the linkage means, while still avoiding the development of binding stresses during the operation thereof. The valve block engages in reciprocating sliding motion against the inside of the drive cylinder when the over-center means drives the linkage means to operate the first and second valve means between the first and second operative modes.

In the system of connective links an open-topped valve stem receiving recess is formed through a wall of the slide block at the first side thereof. An open-topped valve stem retention pin receiving slot is formed in the first side of the slide block normal to the valve stem receiving recess. A valve stem retention pin aperture is formed laterally through the free end of the first valve stem. A valve stem retention pin is slidably disposed through the valve stem retention pin aperture projecting outwardly from either side of the first valve stem. In this condition the valve stem retention pin is received in the valve stem retention pin receiving slot when the free end of the first valve stem is received in the valve stem receiving recess.

A valve stem retention bar having opposed first and second edges is received by the first edge thereof into the valve stem retention pin receiving slot after the first valve stem and the valve stem retention pin have been received. The valve stem retention bar thereby bridges the valve stem receiving recess and traps the free end of the first valve stem with the valve stem retention pin passing therethrough in the valve stem receiving recess. The valve stem retention pin is correspondingly trapped in the valve stem retention pin receiving slot. This operably couples the free end of the first valve stem to the slide block, while simultaneously affording the first valve stem two types of freedom of movement relative to the slide block. The first valve stem tilts relative to the slide block about the valve stem retention pin and slides relative to the slide block along the valve stem retention pin.

The second edge of the valve stem retention bar projects from the slide block and is provided with a convex curvature complimentary to the curvature of the inside of the drive cylinder for sliding movement thereagainst.

Similar structures in the system of connective links afford for the tiltable and slidably coupling of the valve linkage shaft to the slide block of the system of links.

An open-topped valve linkage shaft retention recess is formed through a wall of the slide block at a second side thereof, and an open-topped valve linkage shaft retention pin retention slot is formed in the second side of the slide block normal to the valve linkage shaft receiving recess. A valve linkage shaft retention pin aperture is formed laterally through the first end of the valve linkage shaft. A valve linkage shaft retention pin is slidably disposed through the valve linkage shaft retention pin aperture projecting outwardly from each side of the valve linkage shaft. In this condition the valve linkage shaft retention pin is received in the valve linkage shaft retention pin receiving slot when the first end of the valve linkage shaft is received in the first valve linkage shaft recess.

A valve linkage shaft retention bar having opposed first edges is received in the valve linkage shaft retention pin receiving slot by the first edge thereof after the valve linkage shaft and the valve linkage shaft retention pin have been thusly received. The valve linkage shaft retention bar thus bridges the valve linkage shaft receiving recess and traps the first end of the valve linkage shaft with the valve linkage shaft retention pin passing therethrough in the valve linkage shaft receiving recess. The valve linkage shaft retention pin is correspondingly trapped in the valve linkage shaft retention pin receiving slot. This results in operably coupling the first end of the valve linkage shaft to the slide block, while simultaneously affording the valve linkage shaft two types of freedom of movement relative to the slide block. The valve linkage shaft tilts relative to the slide block about the valve linkage shaft retention pin and slides relative to the slide block along the valve linkage shaft retention pin.

An identical, but mirror image configuration of the above-described system of connective links is used to couple the second end of the valve linkage shaft to the free end of the second valve stem.

The over-center means of the inventive proportioning pump comprises a first linkage bearing surface attached to the linkage means on a first side of the drive piston, and a first drive bearing surface attached to the drive piston on the first side thereof. The first drive bearing surface is movably in each successive stroke of the reciprocating motion of the drive piston into a center position relative to the first linkage bearing surface in which the first drive bearing surface is maximally proximate thereto.

A first biasing means urges the first linkage bearing surface and the linkage means attached thereto into the first operative mode on the side of the center position of the first drive bearing surface adjacent to the drive piston. On the side of the center position of the first drive bearing surface remote from the drive piston the first biasing means urges the first linkage bearing surface and the linkage means attached thereto into the second operative mode. The over-center means comprises a first spring shoe attached to the drive piston on a first side thereof. The first drive bearing surface in this embodiment of the over-center means comprises a spring-receiving slot formed in the first spring shoe.

In one embodiment of the first biasing means, two pair of springs are mounted in compression between the first linkage bearing surface and the first drive bearing surface. Each spring comprises a resilient C-shaped loop, optionally having an ambit greater than 180°. Each end of each loop is provided with a mounting ball receivable in spherical sockets formed in the drive shoe and the spring shoe, respectively.

Optionally leverage means is provided for interacting with and enhancing the effect of the first biasing means after the drive bearing surface that leads the drive piston passes the center position thereof.

In one embodiment of the leveraging means, a kicker ridge projects from the closed end of the drive cylinder opposite the first side of the drive piston. The kicker ridge functions as a fulcrum against which movement past the center position by the drive bearing surface that leads the drive piston drives the first biasing means at a point intermediate the drive bearing surface and the linkage bearing surface. This tends to enhance the effectiveness of the first biasing means and the booster spring retained in the first valve bore in shifting the first valve means from the second operative mode to the first operative mode.

An identical, but mirror image configuration of the above-described first biasing means is provided as the second biasing means of the inventive proportioning pump. A leverage means having an identical, but mirror-image configuration of that in the linkage means described earlier may optionally be provided for the second biasing means.

The proportioning pump of the present invention further comprises a constituent fluid inlet passageway communicating between the exterior of the drive cylinder and an associated one of each of the proportioning cylinders. A first check valve is located within the constituent fluid inlet passageway oriented to permit one-way flow of the constituent fluid into the associated one of the proportioning cylinders.

Such a first check valve may comprise a first check valve recess having opposed parallel end walls. The first check valve recess is formed across the constituent fluid inlet passageway with the end walls of the first check valve recess being normal to the constituent fluid inlet passageway. A check valve seat is disposed in the first check valve recess with a butterfly valve so disposed as to permit one-way flow of the constituent fluid into the associated one of the proportioning cylinders.

The portion of the constituent fluid inlet passageway between the first check valve recess and the associated one of the proportioning cylinders is eccentric, both to the first check valve recess and to the associated one of the proportioning cylinders.

Similarly, the proportioning pump of the present invention further comprises a constituent fluid outlet passageway communicating between the exterior of the drive cylinder and an associated one of each of the proportioning cylinders. A second check valve is located within the constituent fluid outlet passageway oriented to permit one-way flow of the constituent fluid out of the associated one of the proportioning cylinders.

Such a second check valve may comprise a second check valve recess having opposed parallel end walls. The second check valve recess is formed across the constituent fluid outlet passageway with the end walls of the second check valve recess normal to the constituent fluid outlet passageway. A check valve seat is disposed in the second check valve recess with a butterfly valve which is so disposed as to permit one-way flow of the constituent fluid out of the associated one of the proportioning cylinders.

The portion of the constituent fluid outlet passageway between the second check valve recess and the associated one of the proportioning cylinders is eccentric, both to the second check valve recess and to the associated one of the proportioning cylinders.

Identical, but mirror-image configurations of the above-described first and second check valves are provided as first and second check valves for each constituent fluid proportioning cylinder on either side of the drive piston.

Optionally, each proportioning cylinder of the fluid proportioning pump comprises a proportioning cylinder shell projecting from a respective one of the ends of the drive cylinder. A proportioning cylinder sleeve having an internal bore of predetermined cross-section is retained in the proportioning cylinder shell. Advantageously, each proportioning cylinder sleeve is comprised of a material of high lubricity, which may contrast with the material of which the proportioning cylinder shell and the drive cylinder are comprised.

Correspondingly, each proportioning piston comprises a proportioning piston footing projecting from one side of the drive piston toward the corresponding one of the proportioning cylinders. A proportioning piston head is secured to the end of the proportioning piston footing opposite from the drive piston. The proportioning piston head has a cross-section complementary to the predetermined cross-section of the proportioning piston cylinder sleeve and is slidably but sealingly disposed therein.

In this manner, by adjusting the predetermined cross-section of the proportioning cylinder shell, the proportioning pump is provided with ratio adjustment means for fixing the predetermined quantity of either or both of the constituent fluids drawn into and displaced from each proportioning cylinder in each stroke of the reciprocating motion of the drive piston. In each such stroke, the corresponding proportioning piston head disposed in the proportioning cylinder alternately advances and retracts within the proportioning cylinder sleeve to correspondingly draw into and positively displace from the proportioning piston the predetermined quantity of the constituent fluid.

Additionally, the proportioning pump of the present invention comprises a first fluid tubing manifold nestable about the exterior of the drive cylinder at the first drive fluid chamber. The first fluid manifold comprises an end plate positioned against the exterior of the end wall of the drive cylinder adjacent the first drive fluid chamber. The end plate has formed therein a number of fluid passageways.

The present invention also contemplates a method for dispensing in a precise predetermined ratio quantities of a drive fluid and a constituent fluid. In the method pressurized drive fluid is valved alternately into opposite sides of a drive piston slidably disposed for reciprocating motion in a drive cylinder. This is accomplished using valving disposed entirely within the drive cylinder. The drive cylinder is comprised of first and second identical hollow housings, each of which has an open end and is mutually matingly engaged at that open end to form a sealing joint of the drive cylinder.

The method of the present invention further comprises the step of venting the side of the drive piston not provided with the pressurized drive fluid to enable the reciprocating motion of the drive piston, as well as the positive displacement of the drive fluid from the side of the drive piston not provided with the pressurized drive fluid.

A pair of proportioning pistons are secured in the method of the present invention within the drive cylinder on each side of the drive piston. Each proportioning piston projects into an individual corresponding proportioning cylinder opening into the drive cylinder facing the drive piston. The proportioning pistons advance into and recede within the corresponding proportioning pistons in the reciprocating motion of the drive piston.

The method of the present invention includes the further steps of supplying the constituent fluid to the proportioning cylinders as the proportioning pistons recede therein and venting the proportioning cylinders as the proportioning piston advances thereinto. This enables the positive displacement of the constituent fluid therefrom in a precise proportion determined by the volume of each of corresponding proportioning cylinders traversed by the proportioning piston head disposed therein and the volume of the drive piston traversed by the drive piston in each cycle of the alternating movement thereof.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DESCRIPTION OF THE PREFERRED EMBODIMENT

The liquid proportioning pump disclosed herein should be understood to be possessed of utility in any number of diverse fields which require the continuous, precise dispensing and simultaneous mixing of a plurality of constituent fluids into a desired product. Such is the case in the manufacture of numerous industrial and consumer materials, such as paints, pesticides, fertilizers, and industrial sealants, as well as in the preparation of cosmetics, pharmaceuticals, toothpaste, and even foods, such as margarine, syrups, and beverages.

While the methods and apparatus of the present invention find utility in each of the above-named and other fields, for the purpose of fully disclosing the inventive methods and apparatus, the figures herein illustrate an application of the present invention to dispense the constituent fluids of beverages into a mixed consumer product meeting the narrow specifications that are dictated by consumer tastes.

Figure 1:
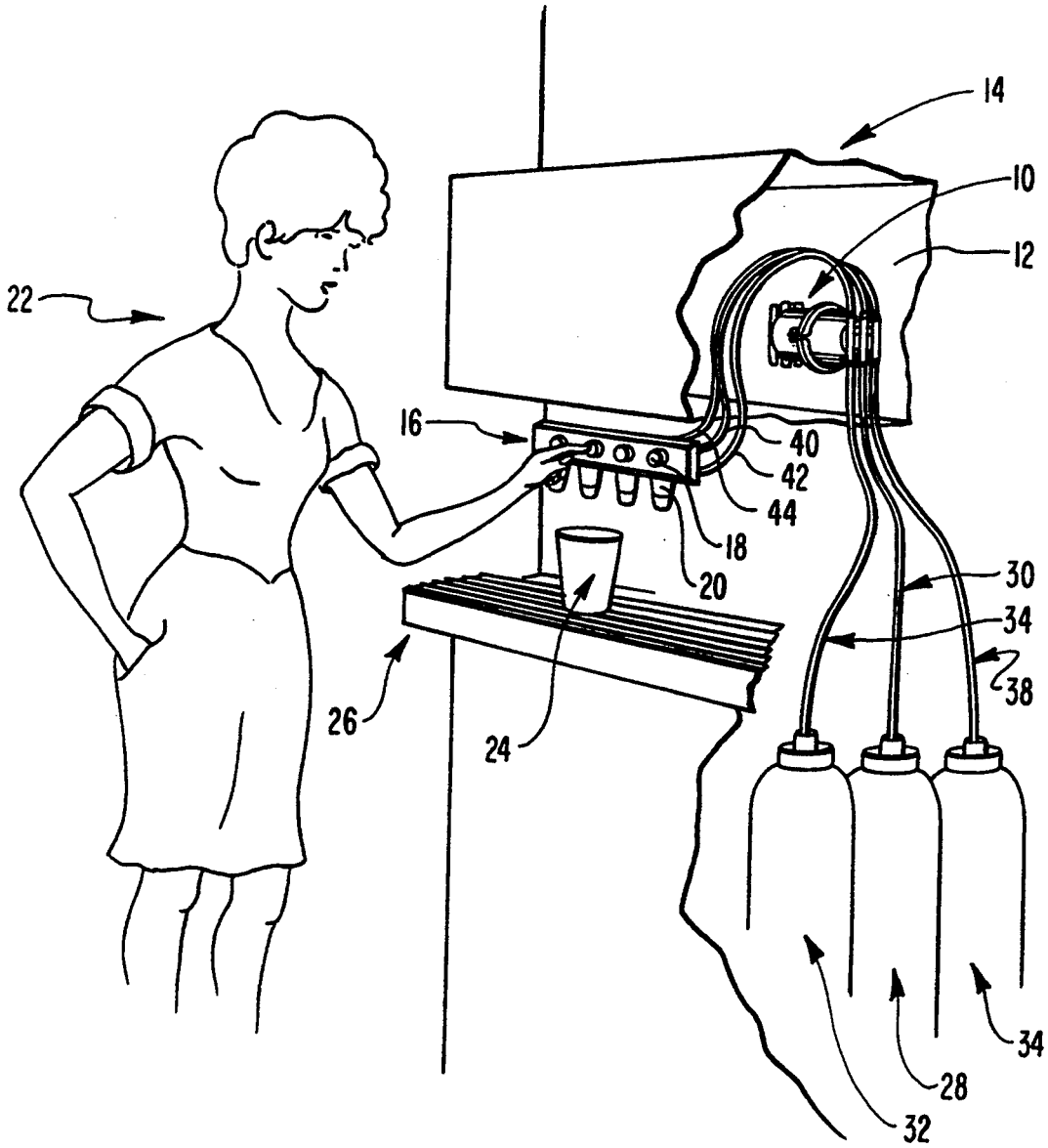
FIG. 1 is a perspective view of a proportioning pump incorporating teachings of the present invention installed in a soft drink dispensing station, being representative of an intended environment in which the proportioning pump has utility.

Thus, FIG. 1 illustrates a proportioning pump 10 incorporating teachings of the present invention mounted to a fixed surface 12 within an enclosing cabinet 14. Cabinet 14 is located in FIG. 1 proximate to and above a control panel 16 provided with a plurality of proportioning pump activating controls 18, each with a corresponding dispenser nozzle 20. A customer 22 is shown about to depress one of activating controls 18, thereby to activate proportioning pump 10 to dispense a beverage through a corresponding one of dispenser nozzles 20 into a cup 24 resting on a ledge 26 therebelow.

The beverage to be dispensed may be of either the carbonated or the non-carbonated variety. The scene depicted could be one in a restaurant or fast food establishment, at an entertainment center or sporting event, or even at a grocery store, where purchases of customer-dispensed beverages is on the rise. Accordingly, while customer 22 might be the ultimate consumer of the beverage dispensed into cup 24, customer 22 could alternatively be a service personnel dispensing beverages for sale to and consumption by an ultimate consumer not depicted.

Proportioning pump 10 is driven by a pressurized drive fluid supplied thereto typically from a source of pressurized drive fluid, such as drive fluid canister 28, by way of a single pressurized drive fluid supply tube 30. Operation of proportioning pump 10 under the influence of the pressurized drive fluid canister 28 concomitantly results in the dispensing from proportioning pump 10 of a first constituent fluid, and possibly a second constituent fluid, neither of which are pressurized. Such a first constituent fluid is typically supplied to proportioning pump 10 from a first constituent fluid canister 32 by way of a single first constituent fluid supply tube 34. Similarly, the second constituent fluid is typically supplied to proportioning pump 10 from a second constituent fluid canister 36 by way of a single second constituent fluid supply tube 38.

The operation of proportioning pump 10 draws therethrough such quantities of the first constituent fluid and the second constituent fluid as causes these to be dispensed with the drive fluid in a precise predetermined ratio. These quantities of the drive fluid, the first constituent fluid, and the second constituent fluid are communicated from proportioning pump 10 for mixing at control panel 16 through a single drive fluid discharge tube 40, a single first constituent discharge tube 42, and a single second constituent fluid discharge tube 44, respectively. Naturally, the drive fluid and any first or second constituent fluids dispensed in this manner need not be mixed remote from proportioning pump 10, as shown in FIG. 1, but according to the demands of the environment in which proportioning pump 10 is utilized, could be mixed immediately adjacent thereto and thereafter transferred in that mixed condition to the actual site at which the mixed product is provided to a consumer.

Fluid supply tubes 30, 34, 38, and fluid discharge tubes 40, 42, 44 are coupled to proportioning pump 10 by fittings, one preferred form of which will be disclosed in detail subsequently. For the benefit of simplicity, however, such fittings, and even such supply tubing and discharge tubing, will be omitted in all possible subsequent figures of this disclosure. Aside from such supply tubes, discharge tubes, and canisters 28, 32, 36, all other operating components of proportioning pump 10 are located interior thereof.

Nevertheless, before proceeding to investigate those internal structures, it should be pointed out that the apparatus and method of the present invention contemplate a system for dispensing in a precise, predetermined ratio quantities of an externally pressurized drive fluid and of a first and a second constituent fluid. Such system comprises not only a proportioning pump, such as proportioning pump 10, activated by the drive fluid, but in combination therewith mounting means for securing that proportioning pump to a fixed surface, such as fixed surface 12, at any predetermined rotational orientation of the proportioning pump about a longitudinal axis defined relative thereto. One embodiment of suitable structures for performing the function of such a mounting means is illustrated, by way of example and not limitation, in FIG. 2.

There, proportioning pump 10 has been enlarged relative to FIG. 1 and can be observed in an overall sense to comprise a generally cylindrically structure having a correspondingly defined central longitudinal axis L and an encircling flange 46 at a medial position on the exterior of proportioning pump 10, which is concentric with longitudinal axis L thereof. Other external features of proportioning pump 10, and the functional significance thereof will be explored subsequently.

Figure 2:
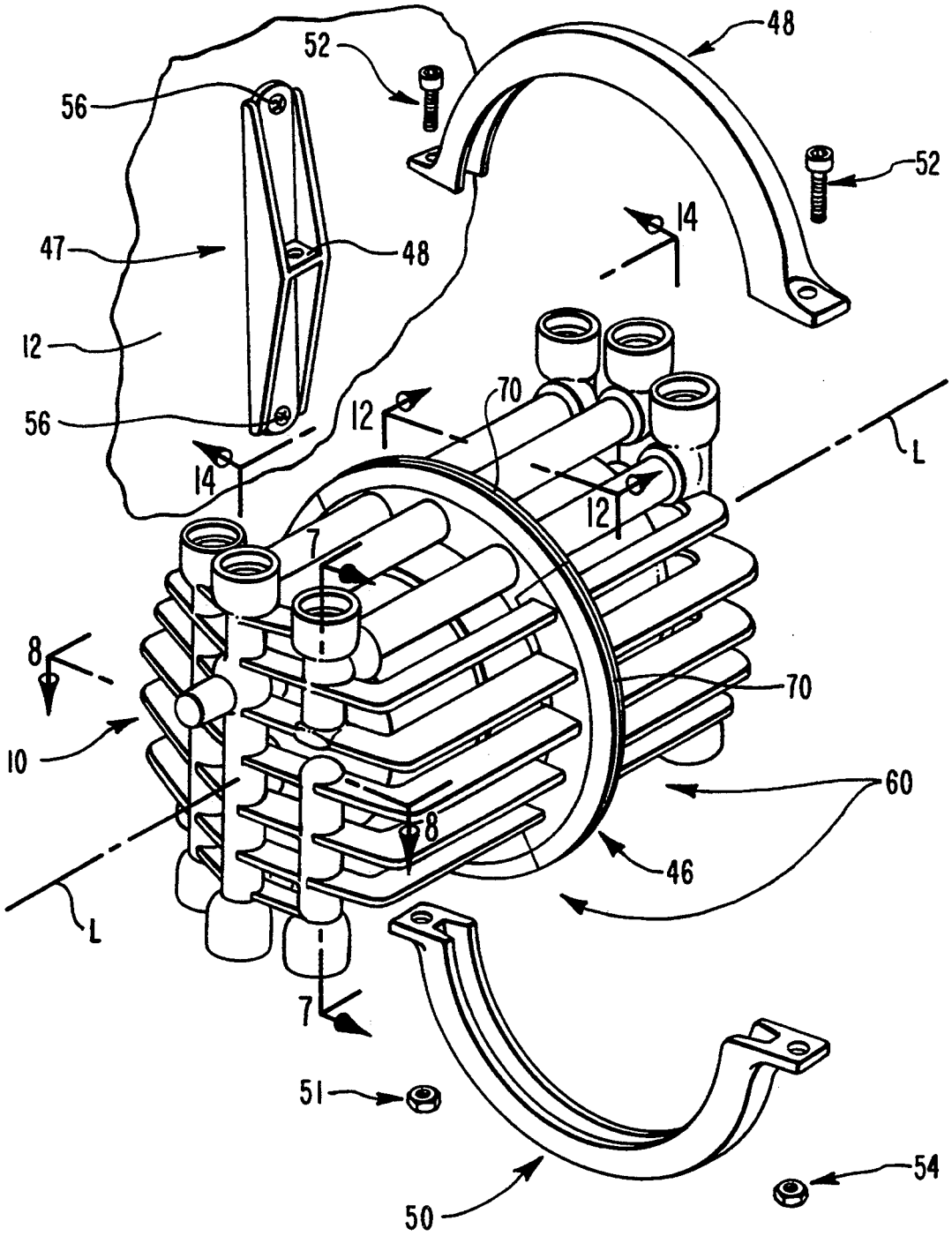
FIG. 2 is an exploded perspective view of the mounting bracket for the proportioning pump illustrated in FIG. 1.

In FIG. 2, however, one form of the mounting means of the system of the present invention can be seen to comprise a clamp means for engaging proportioning pump 10 and a mount 47 capable of securing that clamp means to fixed surface 12. The clamp means nondestructively encircles proportioning pump 10 at a longitudinally medial position thereon corresponding to encircling flange 46. As shown by way of example and not limitation, such a clamp means can take the form of a pair of semi-circular bands 48, 50, which are configured to tightly encircle proportioning pump 10 and receive encircling flange 46. The ends of semi-circular bands 48, 50 are nondestructively mutually attachable by any number of known connector structures, such as cooperating threaded connectors 52, 54.

Mount 47 is correspondingly secured to fixed surface 12 by some similar form of threaded connector 56. One set of threaded connectors 52, 54 serve not only to connect a pair of free ends of semi-circular bands 48, 50, but also to engage therebetween an aperatured mounting web 58 of mount 47. The rotational orientation of proportioning pump 10 about longitudinal axis 11 can be adjusted within semi-circular bands 48, 50 prior to the complete tightening of cooperating threaded connectors 52, 54.

In this manner, an optimum angular orientation of proportioning pump 10 can be achieved for suppressing bubble accumulation in the fluids passing therethrough. Internal structural aspects of proportioning pump 10 also contribute to effective bubble suppression and will be explored subsequently.

Nevertheless, as a general principle, it is desirable that the angular orientation of proportioning pump 10 about longitudinal axis L achieved through the use of semi-circular bands 48, 50 be an angular orientation that permits a flow of the drive fluid, the first constituent fluid, and the second constituent fluid through proportioning pump 10 which is substantially vertical, regardless of the inclination of the fixed surface 12 to which proportioning pump 10 is to be secured. Thus in a general sense, and as illustrated in FIG. 1, supply tubes, such as supply tubes 30, 34, 38, are optimally coupled to proportioning pump 10 at positions that are lower thereon than the positions at which discharge tubes, such as discharge tubes 42, 44, 46 are coupled thereto.

Naturally, the rotatability of proportioning pump 10 within semi-circular bands 48, 50 prior to the complete tightening thereof affords the opportunity during installation of proportioning pump 10 at fixed surface 12 to optimally determine the relative positions of these interconnection sites.

According to one aspect of the present invention, proportioning pump 10 comprises reciprocating means for continuously dispensing the pressurized drive fluid. That reciprocating means comprises a stationary portion and an active portion housed therewithin that is driven in a reciprocating motion of successive strokes in opposite directions by the pressurized drive fluid.

Figure 3:
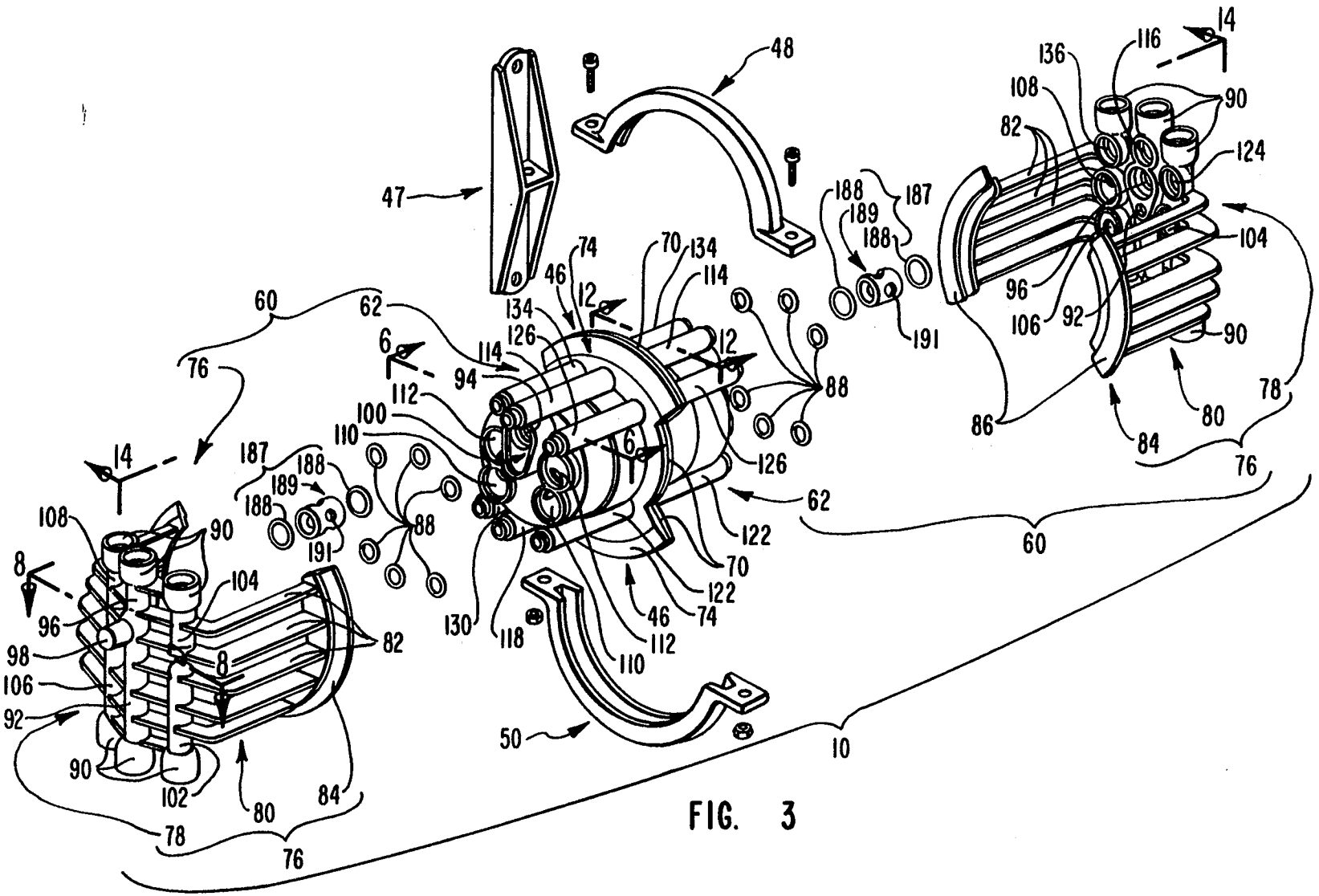
FIG. 3 is a further exploded perspective view of the proportioning pump illustrated in FIG. 2 with the fluid tubing manifolds removed from exterior of the ends of the drive cylinder thereof.

FIG. 3 is a partially disassembled perspective view of proportioning pump 10 which will aid in appreciating initially some of the components of the stationary portion of that reciprocating means. That stationary portion comprises first and second identical hollow housings 60 to either side of encircling flange 46. Each of hollow housings 60 have an open end at encircling flange 46 which is not apparent in FIGS. 2 and 3. The open ends of hollow housings 60 are mutually matingly engaged to define therewithin a drive cylinder also not apparent in FIGS. 2 and 3, but which terminates at the opposite ends thereof in first and second opposed drive fluid chambers. The active portion of the reciprocating means of proportioning pump 10 is driven in reciprocating motion in opposite directions alternately toward each of the first and the second drive fluid chambers.

As illustrated by way of example in FIG. 3, each of hollow housing 60 comprises shell means for defining a single closed end of such a drive cylinder and for enclosing in the interior thereof an individual one of the first and second drive fluid chambers. Such a shell means is shown in FIG. 3 in the form of cup-shaped canisters 62.

Figure 4:
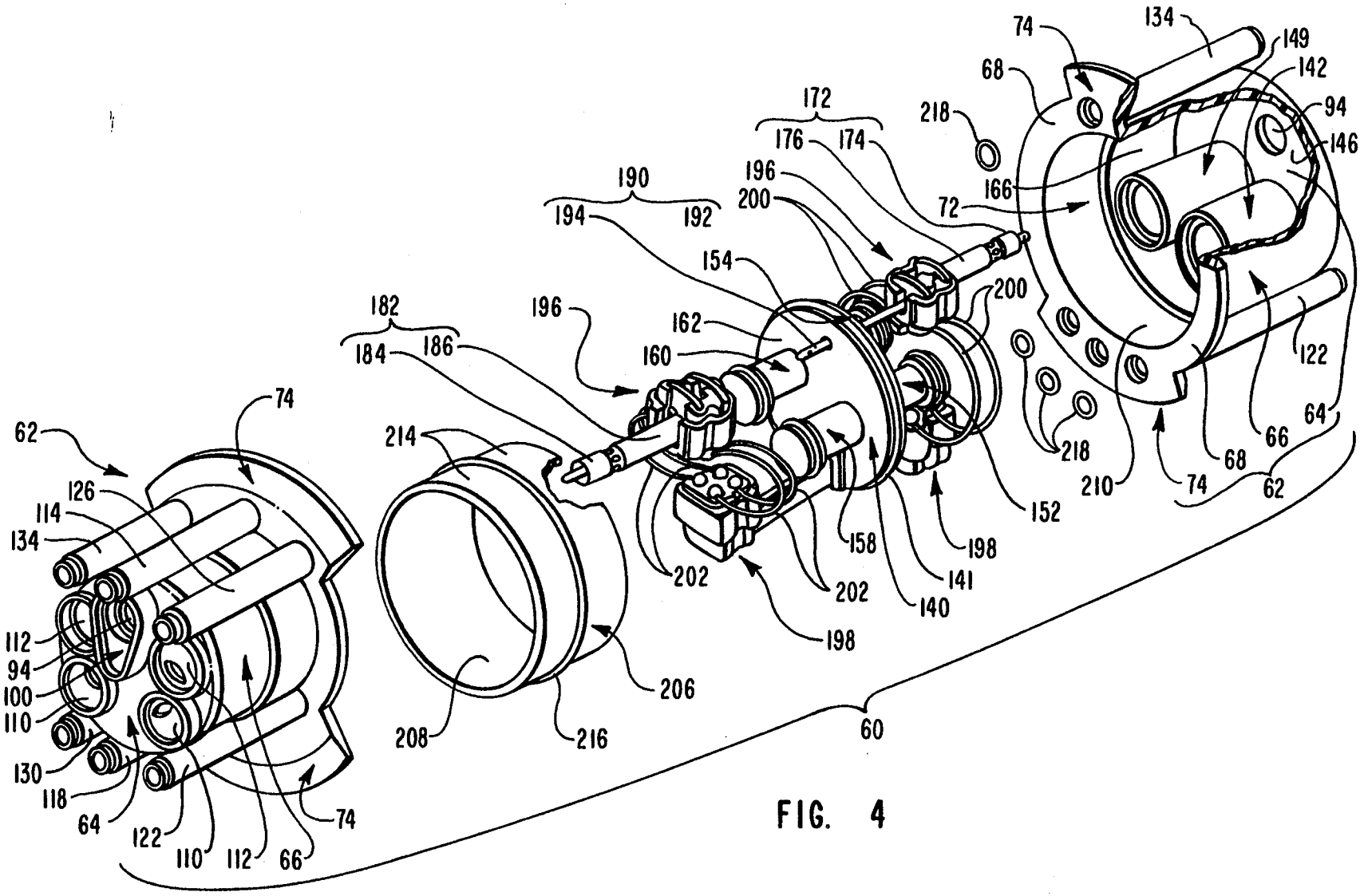
FIG. 4 is a further exploded perspective view of the proportioning pump of FIG. 3 illustrating components thereof disposed interior of the drive cylinder.

As appreciated to further advantage in the additionally disassembled perspective view of proportioning pump 10 shown in FIG. 4, each of canisters 62 comprises an end wall 64 with side wall 66 projecting from the periphery thereof. A mating surface 68 is formed on the ends of sidewalls 66 remote from end wall 64. Mating surfaces 68 of canisters 62 are engaged one with another in an assembled relationship of canisters 62 forming a sealing joint 70 for a drive cylinder 72 defined interiorly of canister 62 in that assembled relationship. Mating surfaces 68 of canisters 62 are located at least in part on canister assembly flanges 74 that project radially outwardly from the ends of side walls 66 remote from end walls 64. Thus, when canisters 62 are in the assembled relationship thereof illustrated in FIG. 3, canister assembly flanges 74 meet to form opposed portions of encircling flange 46, and sealing joint 70 is created therebetween where mating surfaces 68 of opposed canisters 62 effect actual contact. Sealing joint 70 is thus located at the middle of encircling flange 46.

In cooperation with each of canisters 62, hollow housings 60 further comprise fluid communication means for coupling sources of the drive fluid and the first and second constituent fluids to the interior of each of canisters 62, respectively. As shown by way of example and not limitation in FIG. 3, examples of structures performing the function of the fluid communication means of the present invention are illustrated in the form of a fluid tubing manifold 76 that is nestable about the exterior of a corresponding one of canisters 62. Each of fluid tubing manifolds 76 will there be observed to comprise an end plate 78 positionable against the exterior of an end wall 64 of one of canisters 62. An assembly cage 80 extends from end plate 78 of fluid tubing manifold 76 along the exterior of sidewalls 66 of canisters 62. In the form of assembly cage 80 illustrated in FIG. 3, reinforcing longitudinally extending ribs 82 extend from end plate 78 toward sealing joint 70 formed between mating surfaces 68 of canisters 62. A fluid tubing manifold assembly flange 84 is provided on the end of each assembly cage 80 remote from end plate 78.

Fluid tubing manifold assembly flanges 84 of opposed fluid tubing manifolds 76 meet at a medial position on proportioning pump 10 to thereby with canister assembly flanges 74 form encircling flange 46. Sealing joint 70 is created between the mating faces 86 of fluid tubing manifold assembly flanges 84 at the middle of encircling flange 46. Fluid tubing manifold assembly flanges 86 and canister assembly flanges 74 are held in a sealed coplanar assembly securing both canister 62 and canister assembly flange 74 as the components of hollow housing 60 utilizing semi-circular bands 48, 50.

A plurality of passageways for the drive fluid and for the first and second constituent fluids is formed in each of end plates 78 of fluid tubing manifolds 76. Where ends walls 64 of canister 62 are engaged by end plates 78 of fluid tubing manifolds 76, 0-rings 88 are interposed to effect fluid tight couplings of the various fluid passageways formed in fluid tubing manifolds 76 with corresponding fluid passageways formed in each of canisters 62.

The fluid passageways formed in fluid tubing manifolds 76 communicate with the exterior thereof at enlarged openings 90 which may either be blocked with plugs or provided with fittings for receiving fluid tubes, such as fluid supply tubes 30, 34, 38, or fluid discharge tubes, such as fluid discharge tubes 40, 42, 44. This aspect of fluid proportioning pump 10 will be explored with the benefit of additional cross-sections and fluid flow charts to be introduced subsequently. For the present, however, it is useful to observe that the fluid passageways formed in end plates 78 of fluid tubing manifolds 76 each communicate at the end thereof opposite from openings 90 with one or the other ends of drive cylinder 72 through end walls 64 of canisters 62.

The arrangement of these fluid passageways and substantially all other structural elements of proportioning pump 10 internal thereof comprise identical mirror-image structural arrangements associated with each opposite end of proportioning pump 10 and drive cylinder 72 therein. Thus, in the interest of brevity, these identical but mirror image structural relationships will only be disclosed relative to one half of these two-sided mirror-image structures.

For example, formed in end plate 78 of fluid tubing manifold 76 shown to the left in FIG. 3 is a pressurized drive fluid inlet passageway 92, which communicates through a valve bore 94 formed through end wall 64 of canister 62 with drive cylinder 72. Thus, the drive fluid enters drive cylinder 72 at the end thereof at the left side of FIG. 3 through the enlarged opening 90 associated with pressurized drive fluid inlet 92 and then through the inner end thereof illustrated in end plate 78 of fluid tubing manifold 76 on the right side of FIG. 3 and valve bore 94 coupled thereto. These structures are arranged in an identical mirror-image configuration on either side of sealing joints 70.

The drive fluid exits drive cylinder 72 also through valve bore 94, but therefrom through a drive fluid outlet passageway 96 and the enlarged opening 90 associated therewith at the outer end thereof. The inner end of drive fluid outlet passageway 96 at the coupling thereof to valve bore 94 is shown on the inner surface of end plate 78 of fluid tubing manifold 76 to the right side of FIG. 3. While the exterior configuration of end plate 78 of canister assembly flange 74 shown on the left side of FIG. 3 reveals the corresponding outlines of pressurized drive fluid inlet passageway 92 and drive fluid outlet passageway 96, it should be understood that such an external structure corresponding to those passageways and others to be disclosed subsequently result in the embodiment of proportioning pump 10 disclosed herein only due to the plastic molding techniques utilized to manufacture certain components, such as fluid tubing manifold 76 of proportioning pump 10. Alternatively, the fluid passageways formed in fluid tubing manifolds 76 could be produced in a solid end plate 78 for fluid tubing manifold 76 by drilling and machining processes.

Also, it should further be understood that, despite the external appearance of end plate 78 of fluid tubing manifold 76 shown on the left-hand side of FIG. 3, pressurized drive fluid inlet passageway 92 and drive fluid outlet passageway 96 do not communicate directly one with the other. Protuberance 98 on the exterior of end plate 78 encloses a spring receiving recess chamber not visible in FIG. 3 communicates only with drive fluid outlet passageway 96.

At protuberance 98 each of pressurized drive fluid inlet passageway 92 and drive fluid outlet passageway 96 is separated one from the other, thereby to communicate individually with valve bore 94 by way of an elliptical drive fluid plenum 100 visible on the outer surface of end wall 64 of canister 62 on the left side of FIG. 3. Drive fluid plenum 100 couples the inner end of each of pressurized drive fluid inlet passageway 92 and drive fluid outlet passageway 96 as seen on the right side of FIG. 3 commonly to valve bore 94.

In addition, the external structure of end plate 78 of fluid tubing manifold 76 on the left side of FIG. 3 discloses various passageways formed therein for the separate communication to drive cylinder 72 and from drive cylinder 72 of the first and the second constituent fluids, each in a flow channel segregated from the other. Thus, the outer surface of end plate 78 of fluid tubing manifold 76 appearing on the left side of FIG. 3 includes a first constituent fluid inlet passageway 102, a first constituent fluid outlet passageway 104, a second constituent fluid inlet passageway 106, and a second constituent fluid outlet passageway 108. Each communicates to the exterior of end plate 78 of fluid tubing manifold 76 at a corresponding enlarged opening 90. At the inner end each is illustrated in the inner side of end plate 78 of fluid tubing manifold 76 on the right side of FIG. 3 as communicating with individual ones of one-way check valve recesses 110, 112 shown on the outer surface of end wall 64 of canister 62 to the left of sealing joint 70 in FIG. 3. The inner ends of the constituent fluid passageways are only partially illustrated in FIG. 3.

Nevertheless, these disclosed structures of proportioning pump 10 are identical mirror image arrangements on either side of sealing joint 70. As shown in FIG. 3 by way of example and not limitation, a transverse drive fluid passageway is formed into identical mirror-image components thereof on the exterior surface of sidewalls 66 of each of canisters 62. These include identical transverse mirror image first check valve recesses 110 interposed in first constituent fluid inlet passageway 102 and second constituent fluid inlet passageway 106 individually. In first check valve recesses is disposed a first check valve intended to permit one-way flow of the first and the second constituent fluids, respectively, into the interior of proportioning pump 10. Correspondingly, a pair of second check valve recesses 112 are formed on the outer surface of end wall 64 of canister 62 shown to the left side of sealing joint 70 in FIG. 3. Second check valve recesses 112 are designed to each house a check valve for permitting one-way flow of the first and the second constituent fluids, respectively, out of the interior of proportioning pump 10 through first constituent fluid passageway 104 and second constituent fluid outlet passageway 108, respectively.

The portions of transverse drive fluid outlet passageway 114 on the exterior of each of canisters 62 communicate one with the other through encircling flange 46 and thus internally thereof across sealing joint 70. In this manner, transverse drive fluid outlet passageway 114, which is open at the remote ends thereof, is capable of communicating between drive fluid outlet passageway 96 formed in end plate 78 of one of the fluid tubing manifolds 76 and drive fluid outlet passageway 96 formed in end plate 78 of the other of the fluid tubing manifolds 76. This occurs through a transverse drive fluid aperture 116 that opens into drive fluid outlet passageway 96 on the inner surface of end plate 78 of fluid tubing manifold 76 as shown on the right side of FIG. 3.

Correspondingly, to enable the drive fluid outlet passageway 96 formed in end plate 78 of each of the fluid tubing manifolds 76 of proportioning pump 10 to communicate one with another, a transverse pressurized drive fluid inlet passageway 118 is formed into identical mirror-image portions on the exterior of sidewalls 66 of each of canisters 62. The open ends of transverse pressurized drive fluid inlet passageway 118 communicate with the respective of pressurized drive fluid inlet passageways 92 by way of transverse pressurized drive fluid apertures 120 formed on the inner surface of end plate 78 of each of fluid tubing manifold 76, but not visible in FIG. 3.

In addition, the universal fluid communication means of the present invention comprises a similarly constructed transverse constituent fluid inlet passageway 122 that communicates with first constituent fluid inlet passageways 102 in each of end plates 78 of fluid tubing manifold 76 at a transverse first constituent fluid aperture 124 not visible in FIG. 3. A transverse first constituent fluid outlet passageway 126 communicates with the first constituent fluid outlet passageways 104 in end plates 78 of each of fluid tubing manifolds 76 through transverse first constituent fluid outlet apertures 128, one of which is shown on the right side of FIG. 3.

Identically configured mirror image structures are provided in the universal fluid communication means of the present invention for the second constituent fluid. These include a transverse second constituent fluid inlet passageway 130 and cooperating transverse second constituent fluid inlet apertures 132 not shown in FIG. 3 that communicates with second constituent fluid inlet passageways 106 at each end of proportioning pump 10.

Finally, as shown by way of example in FIG. 3 and not limitation, a transverse drive fluid passageway is formed into identical mirror-image components thereof on the exterior surface of sidewalls 66 of each of canisters 62. As shown in FIG. 3 by way of example and not limitation, a transverse drive fluid passageway is formed into identical mirror-image components thereof on the exterior surface of sidewalls 66 of each of canisters 62. not shown in FIG. 3 by way of example and not limitation, a transverse drive fluid passageway is formed into identical mirror-image components thereof on the exterior surface of sidewalls 66 of each of canisters 62. not shown in FIG. 3.

Finally, as shown by way of example in FIG. 3, the universal communication means of the present invention comprises a transverse second constituent fluid outlet passageway 134 and transverse second constituent fluid outlet apertures 136 at each end thereof that communicate with second constituent fluid outlet passageways 108 at either end of proportioning pump 10.

According to one aspect of the proportioning pump of the present invention, universal fluid communication means are provided for coupling selected of the fluid passageways disclosed above as being formed in an end plate 78 of one of the fluid tubing manifolds 76 of proportioning pump 10 into drive cylinder 72 through a corresponding individual one of a plurality of one-way check valve recesses 110, 112 illustrated on the exterior surface of end wall 64 of canister 62 shown in FIG. 3 to the left of sealing joint 70.

As transverse drive fluid outlet passageway 114, transverse pressurized drive fluid inlet passageway 118, transverse first constituent fluid inlet passageway 122, transverse first constituent fluid outlet passageway 126, transverse second constituent fluid inlet passageway 130, and transverse second constituent fluid outlet passageway 134 are disclosed on the exterior of side wall 66 of canister 62, these transverse fluid passageways are thus also correctly characterized as being disposed on the exterior of drive cylinder 72 defined within canister 62. As the transverse fluid passageways recited above are integrally formed with drive cylinder 78, the embodiment of the universal fluid communication means of the present invention illustrated in FIG. 4 can be said to be integrally formed with that drive cylinder. Nevertheless, a universal fluid communication means that is distinct from the drive cylinder of proportioning pump 10 is within the scope of the present invention and will be disclosed in additional detail subsequently relative to FIG. 17.

It is the function of the universal fluid communication means of the present invention, however configured, to reduce the number of fluid supply and fluid discharge tubes that must be coupled to proportioning pump 10 to provide thereto the pressurized drive fluid and the first and second constituent fluids, as well as to permit the dispensing therefrom of each in a predetermined ratio thereamong. The system of transverse fluid passageways described above has the effect of permitting the coupling of a single fluid supply tube or a fluid discharge tube to one side of proportioning pump 10 to also serve also as the fluid supply tube or the fluid discharge tube for the other side of proportioning pump 10. This greatly simplifies the installation of any proportioning pump 10, as well as reducing the amount of auxiliary tubing required therewith.

The flow of drive fluid and first and second constituent fluids through proportioning pump 10 occasioned by the universal fluid communication means of the present invention will ultimately be most clearly comprehended relative to the fluid flow diagram found in FIGS. 18A, 18B, 19A and 19B. Relative to the latter pair of those figures, it will also be explained how the selective blockage of the transverse pressurized drive fluid inlet passageway 118 permits the use of proportioning pump 10 driven by two distinct sources of pressurized drive fluid, preferably having varying degrees of carbonation. Nevertheless, a full description of these figures will not be undertaken at this point.

Instead, the reader is referred to the further disassembled respective view of canisters 62 of proportioning pump 10 shown in FIG. 4. There, by virtue of the separation of canisters 62 and mating surfaces 68 thereof, the interior of proportioning pump 10, and the nature of drive cylinder 72 can begin to be appreciated in the first instance. Other operating components of proportioning pump 10 located interior of drive cylinder 72 are thereby also revealed. Such additional components will be identified briefly by reference to FIG. 4, but will be elaborated subsequently in more detail and interrelated with other components of proportioning pump 10.

A drive piston 140 is disposed in drive cylinder 72 and propelled in a reciprocating motion of successive strokes in opposite directions by the pressurized drive fluid. A drive piston sealing ring 141 encircles the periphery of drive piston 140 so as to travel and bear against the inner surface of drive cylinder 72 to maintain a fluid seal between the drive fluid on either side thereof. Further details of the structure of a preferred embodiment of a drive piston, such as drive piston 140, for use in proportioning pump 10 will be discussed subsequently in relation to FIG. 5. Nevertheless, alternative forms of such a drive piston could easily be accommodated within the limitations and teachings of the present invention.

It is important to note that while the cross-section of drive cylinder 72 as shown in FIG. 4 is circular, and while the cross-section of drive piston 140 corresponds thereto, it would be equally workable, although not presently preferable, to employ a drive cylinder in proportioning pump 10 that has virtually any workable prismatic cross-section. Thus, a drive cylinder, such as drive cylinder 12, could be elliptical, rectangular, or of any other workable cross-section, provided that the size and shape of the drive piston required to function therewith is modified accordingly from that shown for drive piston 140 in FIG. 4.

Other structural elements of proportioning pump 10 which in the assembled state thereof are contained within drive cylinder 72 include a pair of proportioning cylinders 142, 144 projecting into drive cylinder 72 from inner face 146 of end wall 64 of the canisters 62 shown on the right side of FIG. 4. Similarly, but not visible in FIG. 4, identical proportioning cylinders 148, 150 in a mirror image relationship to those visible in FIG. 4 project from the inner face of end wall 64 of canister 62, also into drive cylinder 72, but at the opposite end thereof from proportioning cylinders 142, 144. The ends of proportioning cylinders 142, 144, 148, 150 oriented toward drive piston 140 are open.

Generally, the longitudinal axes of the proportioning cylinders are parallel to the longitudinal axis L of proportioning pump 10 shown in FIG. 2, and consequently to the longitudinal axis of drive cylinder 72. Nevertheless, this need not absolutely be the case within the scope of the present invention, but such an arrangement greatly simplifies the corresponding cooperating structures in proportioning pump 10.

One of the two proportioning cylinders on each of inner faces 146 of end walls 64 of canister 62 corresponds to the first of the constituent fluids that is to be dispensed by proportioning pump 10 in a predetermined ratio with drive fluid 10. The other proportioning cylinder on inner face 146 of each of end walls 64 of canisters 62 corresponds to the second of the constituent fluids. For future reference, proportioning cylinders 142 and 146 will be associated with the first constituent fluid while proportioning cylinders 144 and 150 will be associated with the second constituent fluid.

The constituent fluid for each proportioning cylinder enters and exits through the first and second constituent fluid inlet and outlet passageways described above. Thus, the first constituent fluid enters proportioning cylinders 142, 148 through first constituent fluid inlet passageways 102 and is discharged therefrom through first constituent fluid outlet passageways 104. The second constituent fluid enters proportioning cylinders 144, 150 through second constituent fluid inlet passageways 106 and is discharged therefrom through second constituent fluid outlet passageways 108.

Constituent fluid is drawn into each proportioning cylinder and positively displaced therefrom by a proportioning piston which projects from the face of drive piston 140 opposite thereto. The proportioning pistons move backwards and forwards in each respective proportioning cylinder with drive piston 140 in the reciprocating motion in which drive piston 140 is propelled by the drive fluid. Specifically, when proportioning pump 10 is assembled, a proportioning piston 152 extends from the face of drive piston 140 not visible in FIG. 4 and is received in proportioning cylinder 142. The reciprocating motion of drive piston 140 thus alternatively advances and retracts proportioning piston 152 within proportioning cylinder 142 to correspondingly draw thereto and to positively displace therefrom precise measured quantities of the first constituent fluid corresponding thereto. A proportioning piston 152 extends from the side of drive piston 140 not visible in FIG. 4 into proportioning cylinder 144 for engaging in reciprocating motion therein.

In a similar manner, proportioning pistons 158, 160 project from a side 162 of drive piston 140 visible in FIG. 4 and extend into proportioning cylinders 148, 150, respectively, which are not apparent in that figure. The operation of proportioning pistons 158, 160 within the proportioning cylinders corresponding to each is reversed with respect to that of proportioning pistons 152, 154 described above. Thus, when a stroke of drive piston 140 is advancing proportion pistons 152, 154 into proportioning cylinders 142, 144, respectively, and thereby positively displacing the respective constituent fluids from each, proportioning pistons 158, 160 are simultaneously being retracted within respective proportioning cylinders on the opposite side of drive piston 140. This draws into those respective proportioning cylinders the constituent fluid corresponding to each.

Before leaving FIG. 4, it will be useful to point out further structural components of proportioning pump 10 that are housed within drive cylinder 72 when proportioning pump 10 is assembled. Some of the remaining functional components of proportioning pump 10 have functions which can only be explained at the level of an overview relative to FIG. 4. Nevertheless, the corresponding structure performing each of the functions that will be discussed relative to FIG. 4 will be set forth in substantial detail relative to appropriate specific figures which follow hereafter. For convenience in that discussion and hereafter, however, the portion of drive cylinder 72 housed within canister 62 on the right side of FIG. 4 will be referred to as a second drive fluid chamber 166, while the portion of drive cylinder 72 on the opposite side of drive piston 40 and not visible as being enclosed by canister 62 on the left side of FIG. 4 will be referred to as a second drive fluid chamber 168.

According to one aspect of the present invention, a fluid-driven pump, such as proportioning pump 10, which is powered by and displacing of an externally pressurized drive fluid includes first valve means for placing first drive fluid chamber 166 in communication alternately with the pressurized drive fluid inlet passageway 92 formed in end plate 78 of the fluid tubing manifold 76 adjacent to first drive fluid chamber 166. By way of example and not limitation and as shown to the limited degree possible in FIG. 4, valve bore 94 formed in end wall 64 of canister 62 adjacent to first drive fluid chamber 166 communicates both with the pressurized drive fluid inlet passageway 92 and the drive fluid outlet passageway 96 formed in end plate 78 of the fluid tubing manifold 76 that is disposed adjacent first drive fluid chamber 166. A first valve stem 172 is slidably mounted in valve bore 94 when proportioning pump 10 is assembled. First valve stem 172 has a first end 174 thereof that is actually received in valve bore 94 and a free end 176 opposite thereto that extends from the valve bore 94 into first drive fluid chamber 166.

Correspondingly, a second valve stem 172 is slidably mounted in the assembled condition of proportioning pump 10 in valve bore 94 formed in the canister 62 on the left side of FIG. 4. The canister 62 on the left side of FIG. 4 encloses and defines second drive fluid chamber 168 not visible in FIG. 4, but located on the side of drive piston 140 opposite from first drive fluid chamber 166. Second valve stem 182 similarly has a first end 184 that is actually received in valve bore 94 and a free end 186 that extends from valve bore 94 into second drive fluid chamber 168.

The sliding movement of first valve stem 162 and second valve stem 182 in the valve bore 94 corresponding to each, respectively, results in valving of the pressurized drive fluid into drive cylinder 72 alternately on opposite sides of drive piston 140. The same sliding movement of first valve stem 172 and second valve stem 182 is coordinated by a linkage system to be described in overview immediately hereafter also results in the venting of the side of drive piston 144 not provided with pressurized drive fluid. These two functions together enable the reciprocating motion required of drive piston 140, as well as the positive displacement of the drive fluid from the side of drive piston 140 not provided with the pressurized drive fluid.

In the process, first ends 174, 184 of valve stems 172, 184, respectively, do not in fact interact directly with the inner surface of valve bore 84. Instead, a seal assembly 187 shown in FIG. 3 is disposed in each of drive fluid plenums 100 between and aligned with a valve bore 184 and the opening into drive fluid outlet passageway 96 on the inner surface of end plate 78 of fluid tubing manifold 76. A corresponding first end 174, 184 of valve stems 172, 182 is then slidably disposed through seal assembly 187. Seal assemblies 187 include a pair of chevron seals 188 that encircle and engage first ends 174, 184 of valve stems 172, 182, respectively. Disposed between each pair of chevron seals 188 is a rigid cylindrical sleeve 189 that has formed therethrough a plurality of perforations 191 which permit drive fluid in pressurized drive fluid inlet passageway 92 to flow through drive fluid plenum 100 into proximity with the sides of first ends 174, 184, of valve stems 172, 182. A clearer depiction of this process will be provided relative to FIGS. 15A and 15B.

According to another aspect of the present invention, a fluid driven pump, such as proportioning pump 10, that is powered by and dispensing of an externally pressurized drive fluid is provided with linkage means for operably interconnecting the first valve means thereof and the second valve means thereof through drive piston 140 in such a manner as to afford plural dimensions of alignment freedom between the first valve means and the second valve means. The linkage means provided according to this teaching simultaneously operates both the first valve means and the second valve means in either a first or a second operative mode thereof.

In the first operative mode, first drive fluid chamber 166, is placed in communication with the pressurized drive fluid inlet passageway 92 adjacent to first drive fluid chamber 166, and second drive fluid chamber 168 is placed in communication with the drive fluid outlet passageway 96 adjacent to second drive fluid chamber 168. Correspondingly, in the second operative mode, first drive fluid chamber 166 is placed in communication with the drive fluid outlet passageway 96 adjacent thereto, and second drive fluid chamber 168 not shown in FIG. 4 is placed in communication with the pressurized drive fluid inlet passageway formed in the housing for proportioning pump 10 adjacent thereto.

As shown by way of example and not limitation in FIG. 4, a valve linkage shaft 190 is slidably disposed through drive piston 40 with first end 192 thereof disposed in first drive fluid chamber 166 and second end 194 thereof disposed in second drive fluid chamber 168 on the opposite side of drive piston 140 therefrom. A system of connecting links are provided between the ends of valve linkage shaft 190 and free ends 176 of first and second valve stems 172, 182, respectively.

Such a system of connective links includes, but is not limited to, a pair of valve slide blocks 196 that are also shown in FIG. 4. The valve slide block 196 illustrated to the right of FIG. 4 is shown interconnecting first end 192 of valve linkage shaft 190 with free end 176 of first valve stem 172. Correspondingly, on the opposite side of drive piston 140 a valve slide block 196 is illustrated as being connected to free end 186 of second valve stem 182. The valve slide block 196 coupled in this manner to second valve stem 182 is intended to also be coupled to second end 194 of valve linkage shaft 190. Nevertheless, in order to more clearly show proportioning piston 160, this interconnection between valve slide block 196 and second end 194 of valve linkage shaft 190 is illustrated in a disconnected condition in FIG. 4.

Finally, according to the present invention, a fluid driven pump, such as proportioning pump 10, which is powered by and dispensing of an externally pressurized drive fluid comprises in an additional aspect thereof an over-center means for driving the linkage means described above, thereby to operate the first and second valve means between the first and second operative modes responsive to the completion of each of the successive strokes of the reciprocating motion of drive piston 140 within drive cylinder 172. Only an overview of the elements of such an over-center means can be obtained from FIG. 4, but a detailed explanation of those elements will follow in due course, particularly relative to FIGS. 5, 12, and 13.

Generally, in one embodiment of such an over-center means, a linkage bearing surface is attached to the linkage means of the invention on each side of drive piston 140. Correspondingly, a drive bearing surface is attached to drive piston 140, also on each side thereof. The drive bearing surfaces are thus moveable in each successive stroke of the reciprocating motion of drive piston 140 into a center position maximally proximate to the linkage bearing surface located on the same side of drive piston 140 therewith.

In the embodiment of proportioning pump 10 illustrated in FIG. 4, the linkage bearing surfaces of the over-center means are located on a side of valve slide blocks 196 not illustrated therein. The drive bearing surfaces of the over-center means are located on spring shoes 198 attached rigidly to a drive piston 140 on either side thereof. These, and the drive bearing surfaces associated therewith, will be described subsequently in greater detail in, for example, FIGS. 5, 12, and 13.

Finally, the over-center means of the present invention includes a biasing means on each side of drive piston 140 between the linkage bearing surface and the drive bearing surface on the same side thereof. Each of the biasing means urges the corresponding linkage bearing surface and the linkage means attached thereto out of the over-center position of the associated drive bearing surface located on the same side of drive piston 140 therewith. Thus, by way of example, a first biasing means is provided on the right side of drive piston 140 in FIG. 4 for urging the first linkage bearing surface on that side of drive piston 140 and the linkage means attached thereto into the first operative mode when the first drive bearing surface on that same side of drive piston 140 is adjacent to drive piston 140. Correspondingly, the first biasing means urges the linkage bearing surface on the side of drive piston 140 and the linkage means attached thereto into the second operative mode when the drive bearing surface on that same side of drive piston 140 is on the side of the center position thereof remote from drive piston 140. As shown by way of example, in FIG. 4 a pair of springs 200 are mounted in compression between the linkage bearing surface and the drive bearing surface on the left side of drive piston 140 in FIG. 4.

Correspondingly, a second biasing means is provided as part of the over-center means for urging the linkage bearing surface in the linkage means attached thereto on the right side of drive piston 140 as shown in FIG. 4 into the first operative mode when the drive bearing surface on that same side of drive piston 140 is on the side of the center position thereof remote from drive piston 140. The second biasing means correspondingly also urges the second linkage bearing surface and the linkage means attached thereto on the left side of drive piston 140 into the second operative mode when the drive bearing surface on that same side of drive piston 140 is on the side of the center position thereof remote from drive piston 140. As shown by way of example and not limitation in FIG. 4, a pair of springs 202 are mounted in compression between the linkage bearing surface and the drive bearing surface on the left side of drive piston 140 in FIG. 4.

Figure 14A:
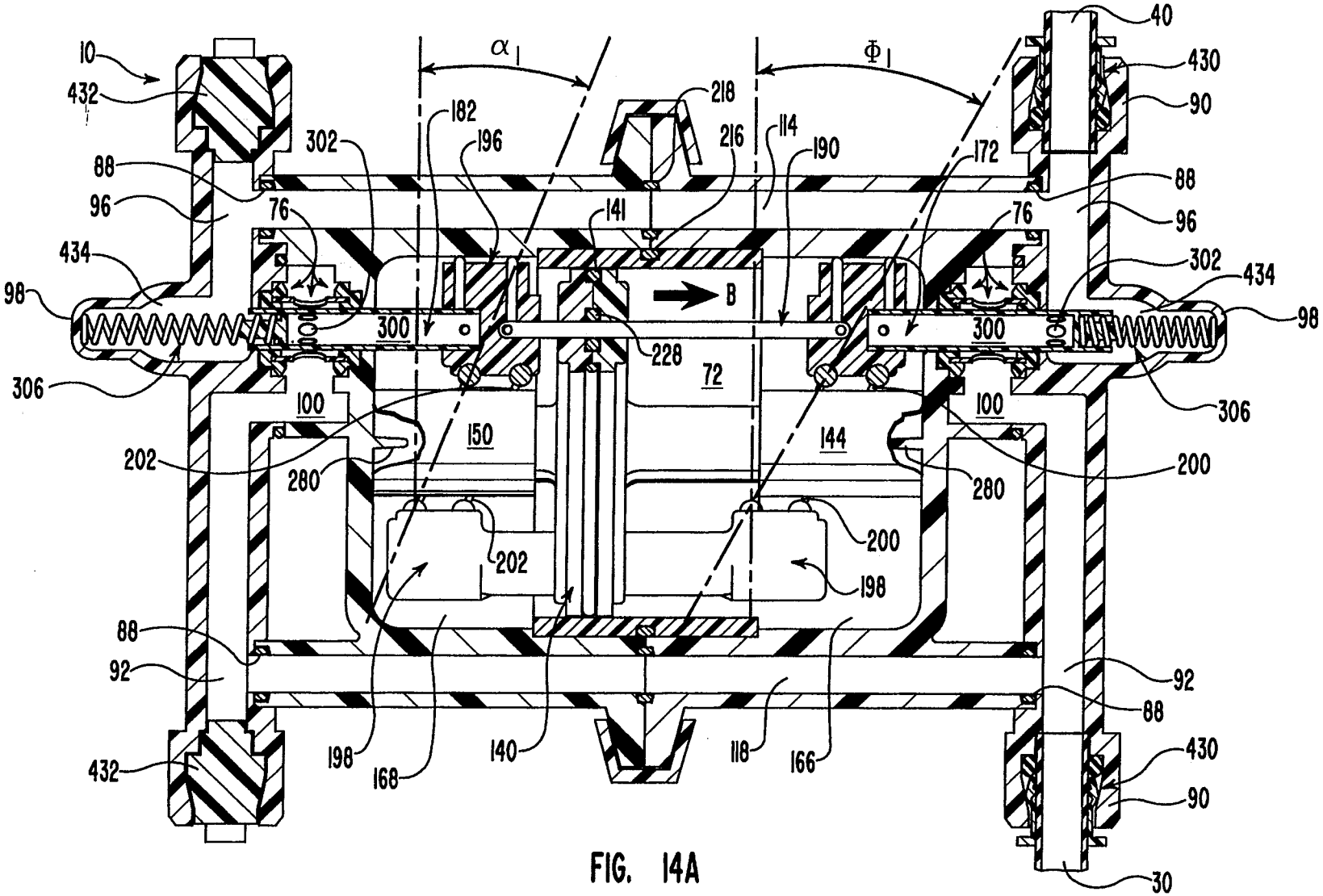
FIG. 14A is a cross-sectional longitudinal elevation view of the proportioning pump of FIGS. 2, 3, and 8 in an assembled condition taken along section line 14—14 shown therein and illustrating the relative positions of the components thereof in a first stage of operation.
Figure 14B:
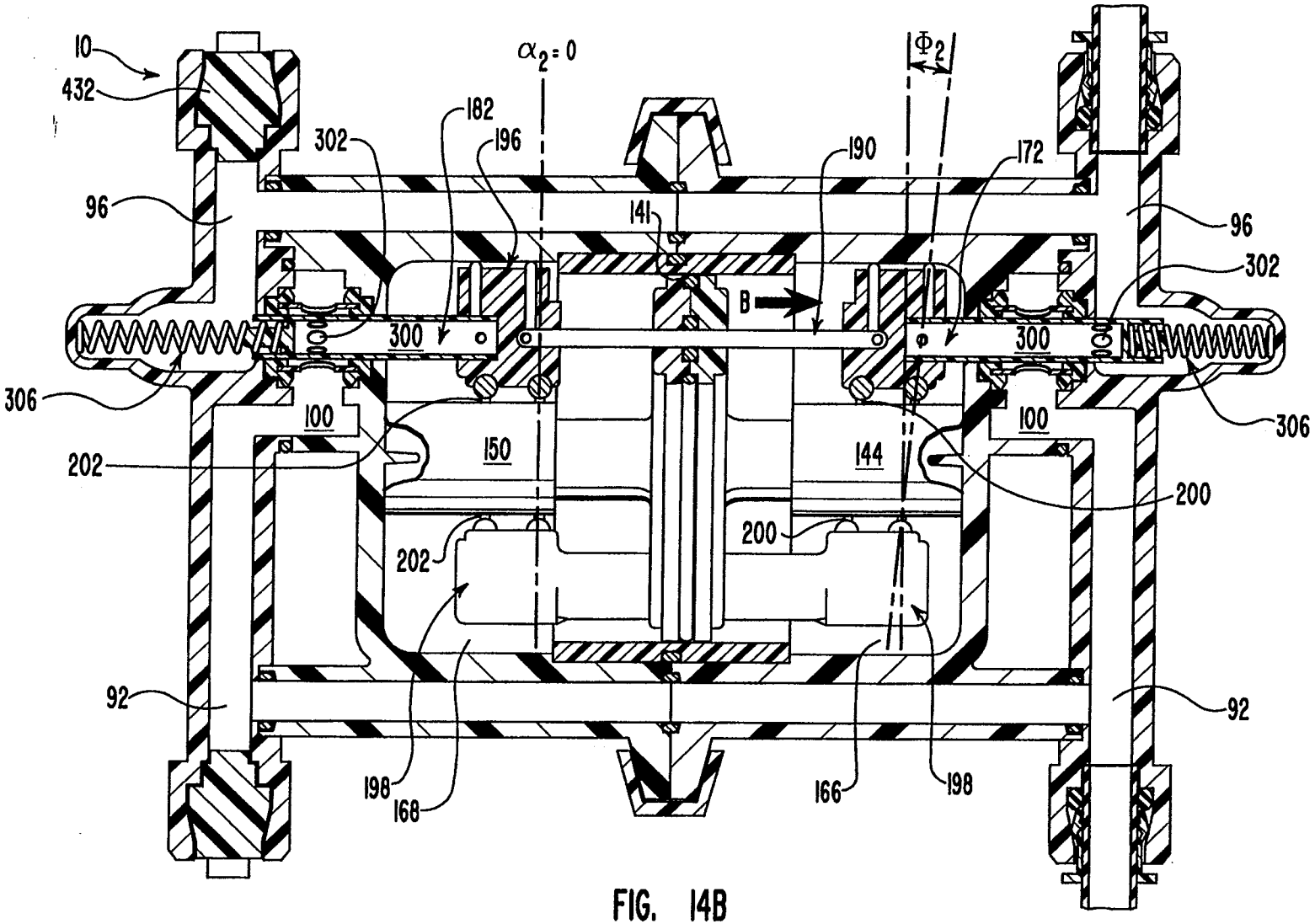
FIG. 14B is a cross-sectional longitudinal elevation view of the device shown in FIG. 14A in a succeeding second stage of operation.

The functional consequences of these described elements of the over-center means of the present invention will be greatly enhanced through the discussion to be provided relative to FIGS. 14A–14B.

Selected aspects of significance relative to the material construction of canisters 62 are appropriate to be mentioned at this point. The presence of a pressurized drive fluid in drive cylinder 72 can cause one or both of canisters 62 to become distorted in shape or in size during each stroke of the alternating motion of drive piston 140 within drive cylinder 72. As a result of such distortions in the size or shape of canisters 62, the desired predetermined ratio between the drive fluid and either or both of the first and second constituent fluids may vary. Furthermore, the distortion of the size or shape of either of canisters 62 can permit leakage of the drive fluid between the first drive fluid chamber 166 and the second drive fluid chamber 168 located opposite sides of drive piston 140. This not only varies the proportion among the various fluids dispensed from the proportioning pump, but vents the pressure of the pressurized drive fluid and results in a loss of motivating power for the overall mechanism.

Accordingly, it is of concern to insure the dimensional stability of canisters 62 under all anticipated operating conditions of proportioning pump 10. The provision of canister assembly flanges 74 about the periphery of end wall 64 of canister 62 assists in stabilizing the dimensions thereof. Semi-circular bands 48, 50 that receive canister assembly flanges 74, also assist in this regard. The dimensional stability of canister 62 is also enhanced by the structure of the canister assembly flanges 74 that are disposed on the outside of side wall 62 of canisters 62. Therefore, assembly cage 80 and ribs 82 thereof, which are components of fluid tubing manifold 76 nested about the exterior of canister 62, also serve to preserve the dimensional stability of canister 62 and of drive cylinder 72 defined therein.

The material of which canisters 62 are fabricated can, however, also influence the dimensional stabilty thereof. For example, the use of a substantial amount of material in forming side walls 66 of canisters 62 will increase the dimensional stability of canisters 62, but will correspondingly increase the weight and bulkiness of the resultant proportioning pump 10. For highly pressurized drive fluids and depending upon the environment in which proportioning pump 10 is intended to be used, canisters 62 can be comprised of a castable material, such as stainless steel. On the other hand, canisters 62 may be comprised of a less rigid and possibly less expensive material which is moldable, such as a resin-type material. In order to enhance the structural rigidity of such resin-type materials, reinforcing materials are added thereto, such as glass fibers carbon fibers. Thus, in one embodiment of the present invention, at least canisters 62, and optionally fluid tubing manifold 76, can be comprised of a glass-filled polysulfon. Nonetheless, it has been found that such resin materials when enhanced in structural rigidity by the addition thereto of fibers of glass or carbon, are relatively abrasive to moveable sealing elements, such as drive piston sealing ring 141, which are slidable on the surface thereof.

Figure 5:
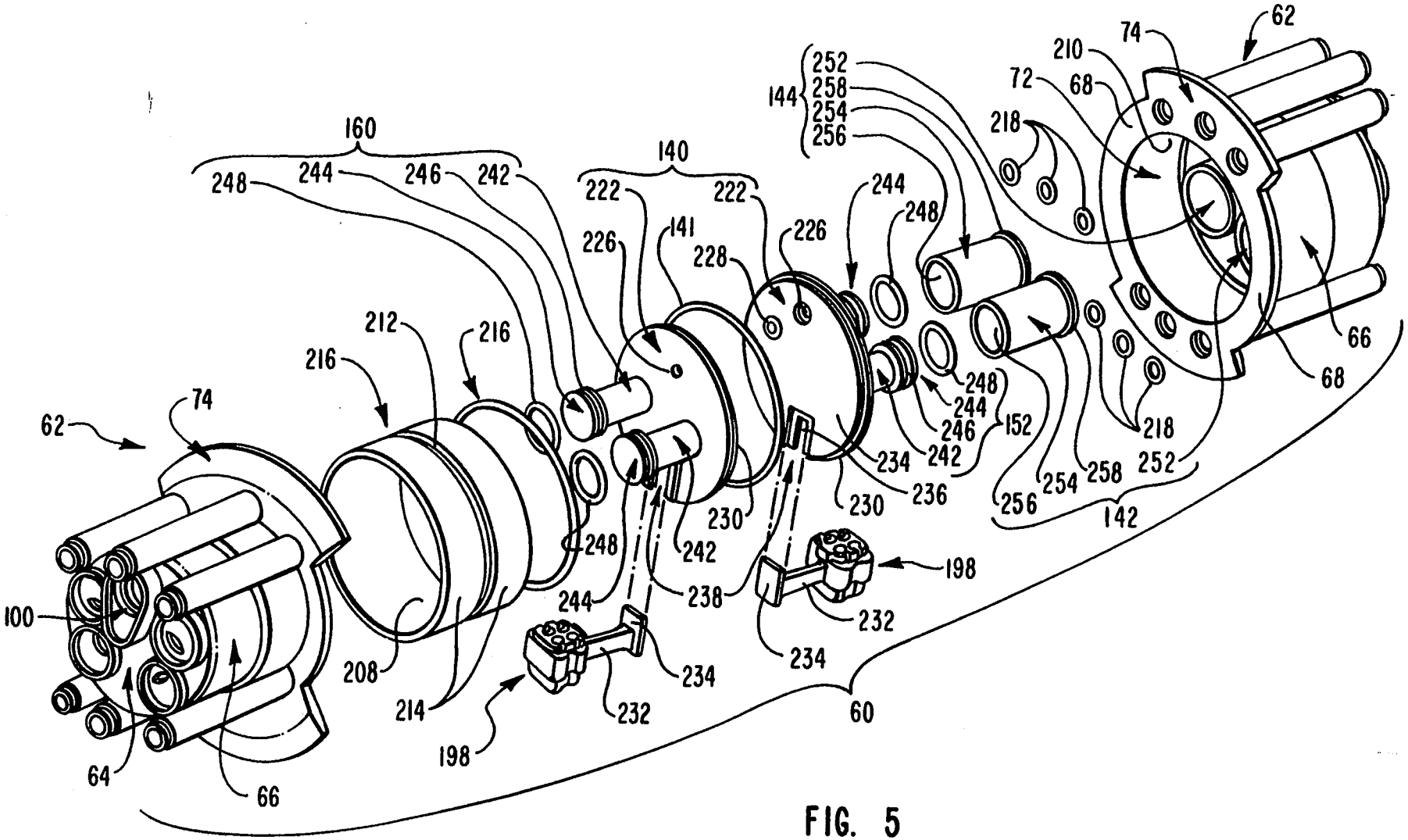
FIG. 5 is an exploded disassembled perspective view of the drive cylinder of FIG. 4 and selected components functionally associated therewith.

Accordingly, in yet another aspect of the present invention, proportioning piston 10, as illustrated in FIGS. 4 and 5 is provided internally thereof with a drive cylinder liner sleeve 206 that is disposed against the interior of side walls 66 of canisters 62 in the assembled relationship thereof. Optimally, drive cylinder liner sleeve 206 is positioned along side walls 66 of the two canisters 62 so as to bridge the sealing joint 70 formed when mating surfaces 68 of each canister 62 are mutually matingly engaged in that assembled position. Optimally, drive cylinder liner sleeve 206 is comprised of a material having a high lubricity, such as a material having a high teflon content. In this manner, the reciprocating motion of drive piston sealing ring 141 against the inner surface 208 of drive cylinder liner sleeve 206 will not produce wear therein. Drive cylinder liner sleeve 206 need not extend the full length of side walls 66 of canisters 62, but should optimally extend at least to the respective extremes of the range of travel of drive piston 140 in the reciprocating motion thereof.

As illustrated in FIG. 4, a drive cylinder liner sleeve recess 210 is formed in the inner surface of side walls 66 of canisters 62 for retaining drive cylinder liner sleeve 206. The provision of drive cylinder liner sleeve recess 210 also stabilizes the longitudinal position of drive cylinder liner sleeve 206 bridging sealing joint 70. Drive cylinder liner sleeve receiving recess 210 is visible in FIG. 4 only in the canister 62 on the left side thereof. Nevertheless, it should be understood that while not shown in FIG. 4 a correspondingly structured drive cylinder liner sleeve retaining recess 210 is formed interior of side walls 66 of the canisters 62 shown on the left side of FIG. 4.

As shown in detail in FIG. 5, in one embodiment of such a drive cylinder liner sleeve 206, a circumferential retaining groove 212 is formed on the outer surface 214 thereof. Received in retaining groove 212 is a drive cylinder liner sleeve sealing ring 216 that is intended to engage sealing joint 70 created at contacting mating surfaces 68 of each of opposed canisters 62. The relationship among these elements is disclosed more thoroughly in FIG. 9 in combination with a second embodiment of a drive cylinder liner sleeve in FIGS. 10 and 11.

In effecting the engagement of mating surfaces 168 on each of canisters 62, O-rings 218 are inserted between the mating surfaces 168 between the two portions of each transverse fluid passageway 114, 118, 122, 126, 130, and 134. O-rings 218 thus insure a fluid type seal at sealing joint 70 for each of those transverse fluid passageways. In FIG. 4, however, O-rings 218 corresponding to transverse drive fluid outlet passageway 114 and transverse first constituent fluid inlet passageway 122 are omitted to improve clarity. Nevertheless, all of O-rings 218 do appear in FIG. 5.

Reference to FIG. 5 will provide insights to the further detailed structure of certain elements of proportioning pump 10 located interior of drive cylinder 72. There, for example, a disassembled perspective view of the components of drive piston 140 are illustrated. These include identical first and second drive piston plates 222, which are bonded together at opposed flat drive piston faces 224. Drive piston plates 222 may be bonded at faces 224 with an adhesive or by welding or ultrasonic welding, depending on the material composition of drive plates 222.

A valve linkage aperture 126 is formed through each of drive piston plates 122 for slidably receiving therethrough valve linkage shaft 190, which has been omitted in FIG. 5 to improve clarity. An O-ring 228 is inserted at faces 224 between the portions of valve linkage apertures 226 formed in each of drive piston plates 222. It is O-ring 228 that ultimately effects the fluid tight, slidable seal on the exterior of valve linkage shaft 190. When assembled with faces 224 thereof in contact, drive piston plates 222 form a peripheral slot 230 in which drive piston sealing ring 141 is retained.

In FIG. 5, it will also be appreciated that each of spring shoes 198 is cantilevered on a spring shoe arm 232 from a respective side of the assembled drive piston 140. The end of spring shoe arm 232 remote from spring shoe 198 is provided with a foot 234 which resides in a foot receiving recess 236 formed in face 224 of a respective drive piston plate 222. In assembling spring shoe arm 232 to a respective drive piston plate 222, spring shoe arm 232 passes through a gap 238 formed in the periphery of drive piston plate 222 at foot receiving recess 236. Foot 234 may be bonded or adhered in that position prior to the assembly of drive piston plates 222 at faces 224. Alternatively, spring shoes 198 and spring shoe arm 232 could be integrally manufactured with drive piston plate 222.

FIG. 5 permits further appreciation of the structure of the proportioning cylinders and proportioning pistons of proportioning pump 10. Each of proportioning pistons 152, 154, 158, and 160 can there be seen to comprise a proportioning piston footing 242 projecting from one side of drive piston 140 toward a corresponding proportioning cylinder. In FIG. 5, only proportioning cylinders 148, 150 are shown. These are disassembled relative to the depiction in FIG. 5. A proportioning piston head 244 is secured to the end of each proportioning piston 242 opposite from drive pistons 140. Only these elements of proportioning pistons 160, 152 are illustrated in the entirety thereof in FIG. 5.

Proportioning cylinders 142, 144 illustrated in FIG. 5, as well as proportioning cylinders 148, 150 not shown therein, have substantially identical constructions. Each comprises a proportioning cylinder shell 252 projecting from inner face 146 of end wall 64 of a canister 62. Proportioning cylinder shells 252 open opposite drive piston 144 into a respective one of first and second drive fluid chambers 166, 168, respectively. Specifically, proportioning cylinder shells 252 for proportioning cylinders 242, 244 open into first drive fluid chamber 166, which is the only drive fluid chamber visible in FIG. 5. Retained in each of proportioning cylinder shells 252 is a proportioning cylinder sleeve having an inner surface 256 with an internal bore of predetermined cross-section.

Advantageously, by varying the internal bore of inner surface 256, the quantity of the corresponding constituent fluid drawn into and expelled from each proportioning cylinder during the strokes of reciprocating movement of drive piston 140 can be varied, without otherwise varying the configuration of canister 62. It is only necessary simultaneously with varying the internal bore of inner surface 256 to correspondingly alter the cross-section of the corresponding proportioning piston head 244 to be slidably disposed therein. Advantageously, proportioning cylinder sleeves 254 are comprised of a material of high lubricity, such as a material with a high teflon content. In this manner, wear on sealing ring 248, which engages inner surface 256 of the proportioning cylinders will be minimized.

Proportioning cylinder sleeves 254 may be assembled in proportioning cylinder shell 252 in various manners, depending primarily upon the material composition of each. Following the manufacture of canister 62, a proportioning piston sleeve 254 having an appropriate predetermined cross-section for the inner surface 256 thereof, can be press fitted into each proportioning cylinder shell 252. This arrangement is particularly appropriate where proportioning cylinder shell 252 and proportioning piston sleeve 254 are comprised of a metal. Nevertheless, it is also within the contemplation of the present invention to use adhesive to bind these two parts or otherwise to use ultrasonic welding or high speed rotation of sleeve 254 within proportioning shell 252 to fuse those two structures.

Figure 7:
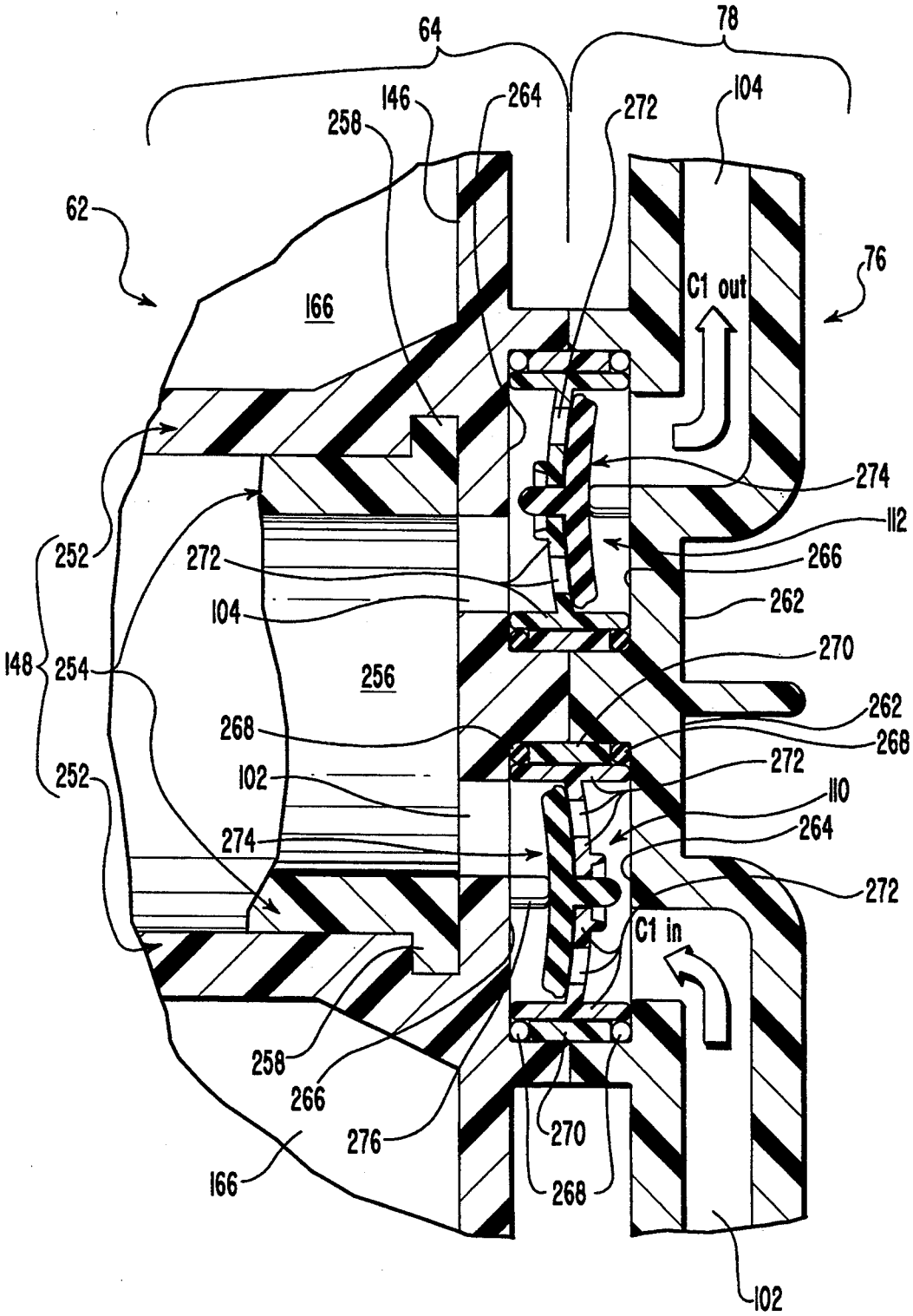
FIG. 7 is a cross-sectional elevation view of a pair of the constituent fluid check valve recesses shown in FIG. 6 and the proportioning cylinder corresponding thereto taken along section line 7—7 shown in FIGS. 2 and 6 and showing in assembled condition the fluid tubing manifold and check valves corresponding thereto.
Figure 8:
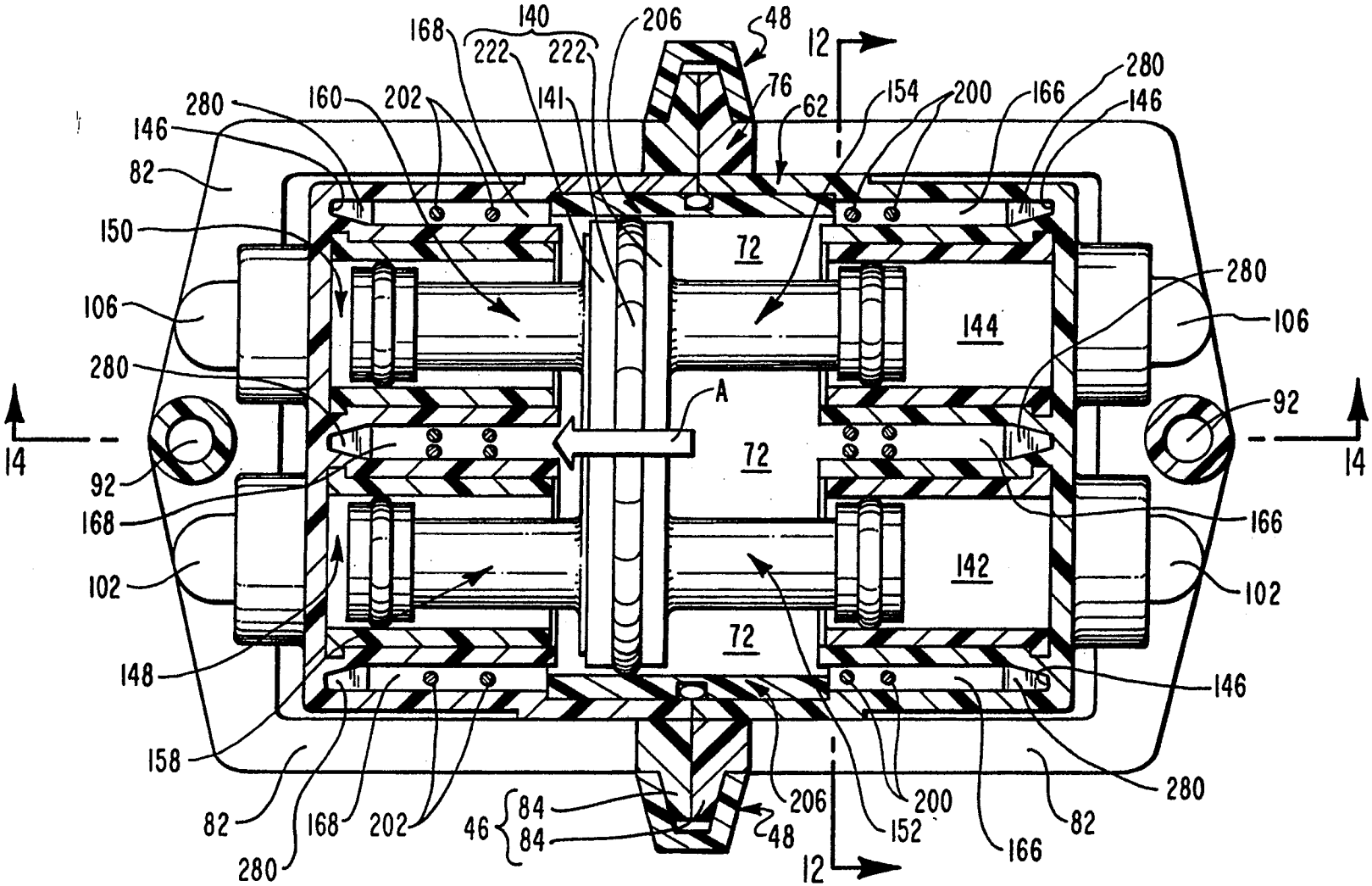
FIG. 8 is a cross-sectional plan view of the proportioning pump of FIGS. 2 and 3 in an assembled condition taken along section line 8—8 shown therein.

In the embodiment of proportioning cylinders 142, 144 shown in FIG. 5, however, each proportioning cylinder sleeve 254 is provided at the end thereof that is inserted into proportioning cylinder shell 252 with a radially outwardly extending lip 258. In that form of proportioning cylinder sleeve 254, canister 62, including proportioning cylinder shell 252, may be injection molded about proportioning cylinder sleeves 254, and lips 258 thereof will serve to enhance the anchoring of proportioning cylinder sleeve 254 in the proportioning cylinder shell corresponding thereto. FIGS. 7 and 8 subsequently illustrate lip 258 disposed thus by injection molding in the body of canister 62.

Figure 6:
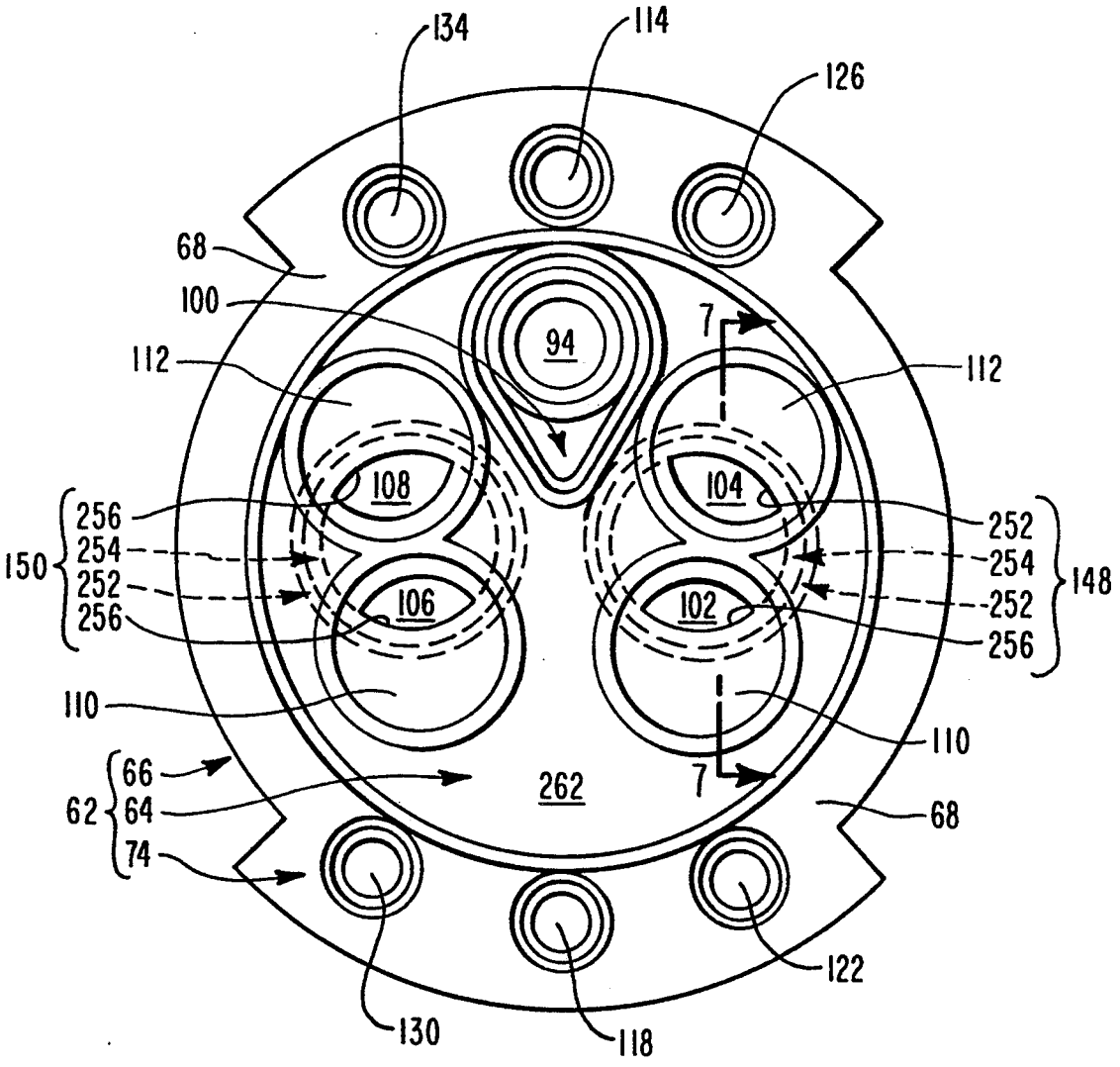
FIG. 6 is an enlarged elevation view of the valve recesses on the exterior of the end of the drive cylinder of FIG. 3 as viewed along line 6—6 therein and illustrating the spatial relationship of the check valve recesses thereon to the proportioning cylinders associated therewith, respectively.

FIG. 6 illustrates an enlarged end view of the outer surface 262 of end wall 64 of the canister 62 shown on the left side of FIGS. 4 and 5. The view illustrated in FIG. 6 is also a left-to-right mirror image view of the outer surface of the end wall 64 of canister 62 on the right side of FIGS. 4 and 5, but not visible therein. Nevertheless, the view provided by FIG. 6 is for the purpose of illustrating in additional detail a teaching of the present invention, which in the interest of brevity, will be disclosed only relative to one of the two canisters 62.

In FIG. 6, structures previously disclosed are referenced consistently by identical reference characters. Accordingly, for example, valve bore 94 in end wall 64 of canister 62 can be seen in full cross-section communicating with the interior of canister 62. It should be remembered that interior of canister 62 is the portion of drive cylinder 72 not shown in FIGS. 4 and 5 but identified above as second drive fluid chamber 168 that would be to the left side of drive piston 140 in FIGS. 3 and 4, if proportioning piston 10 illustrated therein were in the assembled condition thereof. Surrounding valve bore 94 on outer surface of end wall 64 is elliptical drive fluid plenum 100. A pair of first check valve recesses 110 and a pair of second check valve recess 112 on outer surface 262 of end wall 64 can also be seen in FIG. 6.

Shown in dashed lines as being on the opposite side of end wall 64 from outer surface 262 are the outer outlines of the structural components of proportioning pistons 148 and 150, which were not visible in the views presented in FIGS. 4 and 5. In FIG. 6, in confirmation of the disclosure rendered in FIGS. 4 and 5 relative to proportioning pistons 142, 144, however, each of proportioning pistons 148, 150 can be seen to comprise a proportioning cylinder shell 252 concentrically encircling a proportioning cylinder sleeve 254 having an inner surface 256. For convenience of understanding, lip 258 illustrated relative to proportioning pistons 142, 144 in FIG. 5 has been omitted in FIG. 6. Therefore, the spacial relationship between the first check valve recess 110 and the second check valve recess 112 associated on the right side of FIG. 6 with proportioning cylinder 148 can be seen with clarity. Correspondingly, the spacial relationship among the first check valve recess 110 and the second check valve recess 112 associated with proportioning piston 150 shown on the left side of FIG. 6 is also apparent.

It should be recalled from FIG. 3 that end plate 78 of fluid tubing manifold 76 is ultimately disposed in sealing engagement against end wall 64 of canister 62 illustrated in FIG. 6. In end plate 78 are formed a plurality of fluid passageways which communicate through the structures illustrated in FIG. 6 with the interior of proportioning pump 10.

For example, it was pointed out relative to FIG. 3 that protuberance 98 in the exterior of end plate 78 of fluid tubing manifold 76 corresponded in position to drive fluid plenum 100. The drive fluid plenum 100 was disclosed as communicating both with pressurized drive fluid inlet passageway 92 formed in end plate 78 as well as with drive fluid outlet passageway 96 so formed therein.

Relative to first and second check valve recesses 110, 112 illustrated in FIG. 6, a similar clarification of intercommunicating fluid passageway should be tendered. Thus, first constituent fluid inlet passageway 102 formed in end plate 78 of fluid tubing manifold 76 communicates through first check valve recess 110 shown on the right side of FIG. 6 as being associated with proportioning cylinder 148. First check valve recess 110 associated with proportioning cylinder 148 is in actuality located along the course of first constituent fluid inlet passageway 102, so that first constituent inlet passageway 102 continues beyond first check valve recess 110 on the right side of FIG. 6 to communicate with the interior of proportioning piston 148. Therefore, as illustrated in FIG. 6, a portion of first constituent fluid inlet passageway 102 between first check valve recess 110 and the associate proportioning piston 148 is shown on the right side of FIG. 6. This portion of first constituent fluid inlet passageway 102 is eccentric, both relative to that first check valve recess 110, and to the associated proportioning cylinder 148.

Such a relationship also exists relative to the other check valve recess associated with proportioning cylinder 148, namely, second check valve recess 112 shown on the right side of FIG. 6. A portion of first constituent fluid outlet passageway 104 can be seen beyond second check valve recess 112 communicating with the interior of proportioning piston 148. The portion of first constituent fluid outlet passageway 104 between second check valve recess 112 and the associated proportioning cylinder 148 is shown on the right side of FIG. 6 to be eccentric, both as to that second check valve recess 112 and the associated proportioning cylinder 148.

By the described arrangement of the check valve recesses associated with, for example, proportioning cylinder 148, a pair of check valve recesses located on a single planar surface, such as outer surface 262 of end wall 64 of canister 62 illustrated in FIG. 6 can each be made to communicate with a single cylindrical interior of an associated proportioning cylinder.

The spacial relationship detailed above relative to proportioning cylinder 148 and the first and second check valve recesses 110, 112 associated therewith is repeated on the right side of FIG. 6 relative to proportioning cylinder 150 and the first and second check valve recesses 110, 112, respectively, associated therewith. Thus, the portion of second constituent fluid inlet passageway 106 between first check valve recess 110 shown on the left side of FIG. 6 and proportioning cylinder 150 associated therewith is eccentric both to that first check valve recess 110 and to proportioning cylinder 150. Similarly, in FIG. 6 it can be observed that the portion of second constituent fluid outlet passageway 108 between first check valve recess 112 on the left side of FIG. 6 and proportioning cylinder 150 associated therewith is eccentric both to that first check valve recess 112 and to proportioning cylinder 150.

Similar structures are provided on the exterior of end wall 64 of canister 62 shown on the right side of FIGS. 4 and 5.

Additional insight relative to the check valves employed with each proportioning piston can be derived by reference to FIG. 7. In FIG. 7, a cross-sectional elevation view is presented of the pair of constituent fluid check valve recesses 110, 112 shown on the right in FIG. 6 as being associated with proportioning cylinder 148. In contrast with FIG. 6, however, FIG. 7 illustrates the immediately associated structural components of proportioning piston 10 that would be adjacent thereto in the assembled relationship thereof. Also illustrated are the contents of each check valve recess. These function as check valves to permit one-way flow in a corresponding directions of the constituent fluid associated with proportioning cylinder 148.

In the case of proportioning cylinder 148, that constituent fluid would be the first constituent fluid, which is supplied to the interior of proportioning pump 10 through first constituent fluid inlet passageway 102 in a direction indicated by arrow $C1_{IN}$ shown in FIG. 7 and correspondingly discharged from the interior of proportioning pump 10 through first constituent outlet passageway 104 in a direction indicated by arrow $C1_{OUT}$.

From the elevation view presented in FIG. 7, it will also be appreciated that the flow of first constituent fluid through proportioning cylinder 148 is designed to purge air bubbles from proportioning cylinder 48 automatically during use. That first constituent fluid enters proportioning cylinder 148 at an entry site 277 that is disposed remote from the longitudinal axis M at the center of proportioning cylinder 48 shown in FIG. 7. Entry site 277 is located at the lowest extreme of proportioning piston 148. Correspondingly, the first constituent fluid is expelled from proportioning piston 148 through a discharge site 278 that is also located remote from longitudinal axis M of proportioning cylinder 48 on the opposite side therefrom as is entry site 277. Discharge site 278 can be seen in FIG. 7 to be is located at the highest possible position in proportioning cylinder 148. This pattern of fluid flow through the proportioning pistons of the present invention greatly reduces the accumulation of air bubbles in proportioning pump 10, as fluid flow of the type described will tend to purge air bubbles from a proportioning piston during use.

The portion of first constituent fluid inlet passageway 102 between first check valve recess 110 and the interior of proportioning cylinder 148 is also shown in FIG. 7 to be eccentrically disposed relative to both check valve recess 110 and to proportioning cylinder 148. Correspondingly, the portion of first constituent fluid outlet passageway 104 between second check valve recess 112 and the interior of the associated proportioning cylinder 148 is similarly shown eccentrically disposed between both.

In FIG. 7, each of check valve recesses 110, 112 can be appreciated to have opposed parallel end walls that are disposed normal to the associated constituent inlet or outlet fluid passageway. For example, check valve recess 110 has a first end wall 64 through which the first constituent fluid enters first check valve recess 110 by way of first constituent fluid inlet passageway 102, and a second end wall 266 parallel thereto through which the first constituent fluid leaves first check valve recess 110 to enter proportioning cylinder 148.

Accordingly, first end wall 264 of first check valve recess 110 is located remote from proportioning cylinder 148, while second end wall 266 of first check valve recess 110 is located proximate to proportioning cylinder 148. The relative positioning of the first and second end walls of second check valve recess 112 are reversed, due to the reversed direction of flow of the first proportioning fluid through second check valve recess 112. Thus, first end wall 264 of second check valve recess 112 is located proximate to proportioning cylinder 148, while second end wall 266 of second check valve recess 112 is located remote from proportioning cylinder 148.

The contents of both check valve recesses 110, 112, however, are identically disposed relative to the first and second end walls, 264, 266 thereof, respectively. Thus, for example, a pair of encircling O-rings 268 separated by a spacer cylinder 270 are disposed in first check valve recess 110 against the peripheral walls thereof. A check valve seat 272 is disposed in first check valve recess 110 interiorly of cylinder 270 and O-rings 268 in a fixed position relative to first end wall and second end wall 264, 266, respectively, thereof.

An elastomeric butterfly valve 274 is disposed against check valve seat 272 oriented to permit one-way flow of the first constituent fluid into proportioning cylinder 148. A nipple 276 projects from second end wall 266 of first check valve recess 110 to retain the center of butterfly valve 274 against the center of check valve seat 272.

Correspondingly, the check valve seat 272 and butterfly valve 274 disposed in second check valve recess 112 are positioned to permit one-way flow of the first constituent fluid out of proportioning cylinder 148.

FIG. 8 contains a cross-sectional plan view of proportioning pump 10 in the assembled condition thereof. Therefore, in FIG. 8 each of proportioning pistons 152, 154 to the right of drive piston 140 are be disposed in corresponding proportioning cylinders 142, 144, respectively. On the opposite, or left, side of drive piston 144 proportioning pistons 158, 160 are shown disposed for reciprocating sliding movement in proportioning cylinders 148, 150, respectively.

The housing 60 of proportioning pump 10 comprising a pair of fluid tubing manifolds 76 nested about a corresponding pair of canisters 62. These elements of housing 60 are held in a mating relationship at the open ends thereof by semi-circular bands 48, 50. For convenience and simplicity in FIG. 8 and in the other cross-sections of proportioning pump 10 illustrated herein, only semi-circular band 48 of these will be illustrated.

Nevertheless, together the combination of semi-circular bands 48, 50 engage the elements that together make up encircling flange 46. In the plane of the view shown in FIG. 8, these include fluid tubing manifold assembly flanges 48 at the free ends of ribs 82 of assembly cage 80 of fluid tubing manifold 76.

Drive cylinder 72 interior of housing 60 of proportioning pump 10 is shown, including first drive fluid chamber 166 to the right in FIG. 8 and second drive fluid chamber 168 to the left. In first drive fluid chamber 166 springs 200 of the over-center means of the present invention can be seen in cross-section to the outside of each of proportioning cylinders 142, 144. Similarly, in second drive fluid chamber 168, springs 202 of the over-center means of the present invention can be seen in cross-section to the outside of each of proportioning cylinders 158, 160.

Projecting from inner face 146 of each end wall 64 of canister 62 is a kicker ridge 280, which was not included in FIGS. 4, 5, or 7, but which will be illustrated in further detail subsequently.

The kicker ridge 280 in first drive fluid chamber 166 functions as a leverage means for interacting with and enhancing the effect of springs 200 in driving the linkage means of the present invention after the drive bearing surface of the biasing means associated therewith that leads drive piston 140 is passed the center position thereof. Under these conditions the spring 200 closest to kicker ridge 280 comes to bear against kicker ridge 280, so that kicker ridge 280 functions as a fulcrum disposed between the drive bearing surface that leads drive piston 140 and the linkage bearing surface at the opposite end of springs 200. This relationship is shown with additional clarity, for example, in FIG. 14C.

Kicker ridge 280 in second drive fluid chamber 168 interacts with the spring 202 closest thereto in a similar manner when the drive bearing surface of the biasing means associated therewith that leads drive piston 140 is passed the center position thereof.

As seen in FIG. 8, drive piston 140 has reached the full extent of its movement leftwardly in the direction shown by arrow A. That movement was induced by placing first drive fluid chamber 166 in communication with the pressurized drive fluid. In the process of movement in the direction of arrow A, drive fluid was correspondingly positively displaced from second drive fluid chamber 168 due to the advancement of drive piston 140.

As drive piston 140 moves in the direction indicated in FIG. 8 by arrow A, all of the proportioning pistons of proportioning pump 10 are also drawn in the direction of arrow A, as the proportioning pistons are attached to drive piston 140. This causes proportioning pistons 152, 154 to draw corresponding first and second constituent fluids into proportioning cylinders 142, 144, respectively. Proportioning pistons 158, 160 on the other hand force the first and second constituent fluid from proportioning pistons 148, 150, respectively.

When the direction of movement of drive piston 140 is reversed, into a direction opposite that shown by arrow A, pressurized drive fluid is discharged from first drive fluid 166 as drive piston 140 moves theretoward in response to the communication of pressurized drive fluid into second drive fluid chamber 68. The effect on the flow of constituent fluids in the proportioning cylinder is also reversed. The manner in which the direction of movement of drive piston 140 is reversed will ultimately be disclosed in relation to FIGS. 14A, 14B, 14C, and 14D.

Figure 9:
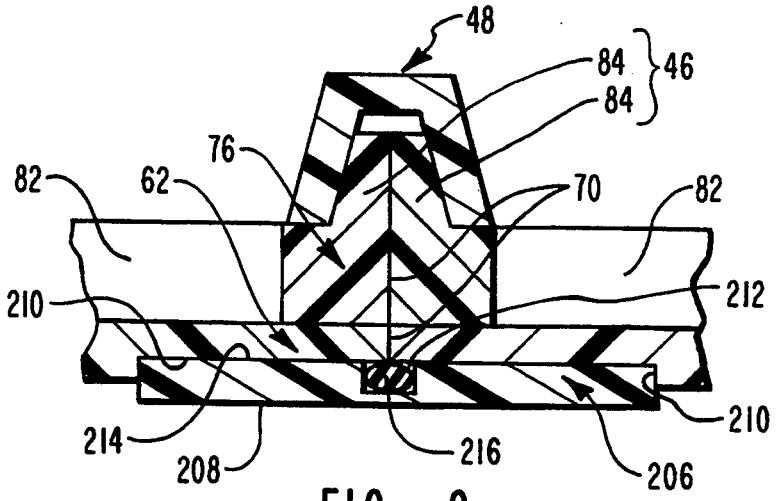
FIG. 9 is an enlarged cross-sectional plan view of the drive cylinder liner sleeve and the inner walls of the drive cylinder of the proportioning pump illustrated in FIG. 8.
Figure 10:
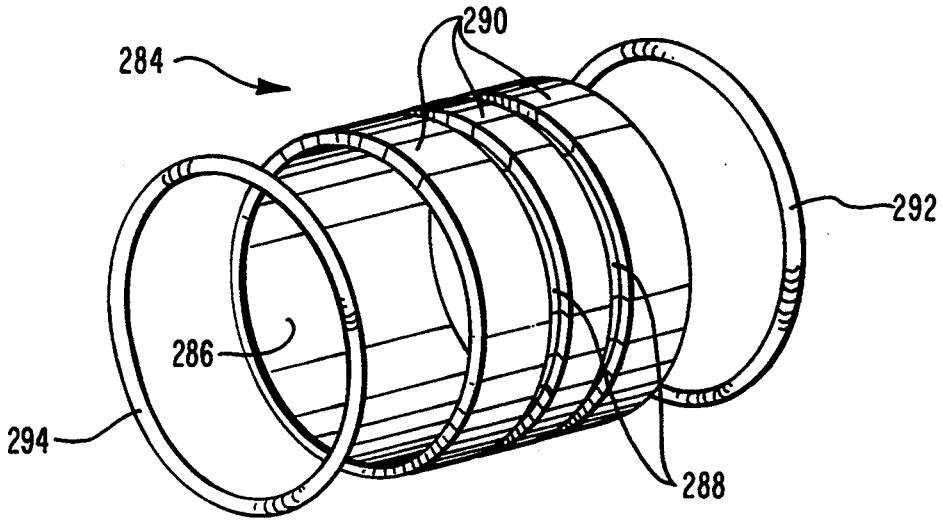
FIG. 10 is a perspective view of a second embodiment of a drive cylinder liner sleeve, such as that illustrated in FIG. 4.

FIG. 9 is an enlarged cross-sectional plan view of drive of the portion of FIG. 8 illustrating cylinder liner sleeve 214 disposed in drive cylinder liner sleeve receiving recess 210 in the inner walls of drive cylinder 22. There, drive cylinder liner sleeve sealing ring 216 is shown held in retaining groove 212 in outer surface 214 of drive cylinder liner sleeve 206. Drive cylinder liner sleeve sealing ring 216 is compressed against the mating surfaces of canisters 62 whereat sealing joint 70 is defined. In this manner, drive cylinder liner sleeve sealing ring 216 enhances the fluid-tight seal required, not only between the portions of drive cylinder 72 on opposite sides of drive piston 140, but between the two identical halves of housing 60 of proportioning pump 10.

Nevertheless, the drive cylinder liner sleeve for use in a proportioning pump according to the teachings of the present invention can take alternative forms. In the perspective view of FIG. 10 a second embodiment of a drive cylinder liner sleeve 284 is illustrated. Drive cylinder liner sleeve 284 has an inner surface 286 and a pair of retaining grooves 288 formed in the outer surface 290 thereof. A first drive cylinder liner sleeve sealing ring 292 is disposed in the retaining groove 288 shown to the right in FIG. 10, while a second drive cylinder liner sleeve sealing ring 294 is disposed in the retaining groove 288 to the left in FIG. 10.

Figure 11:
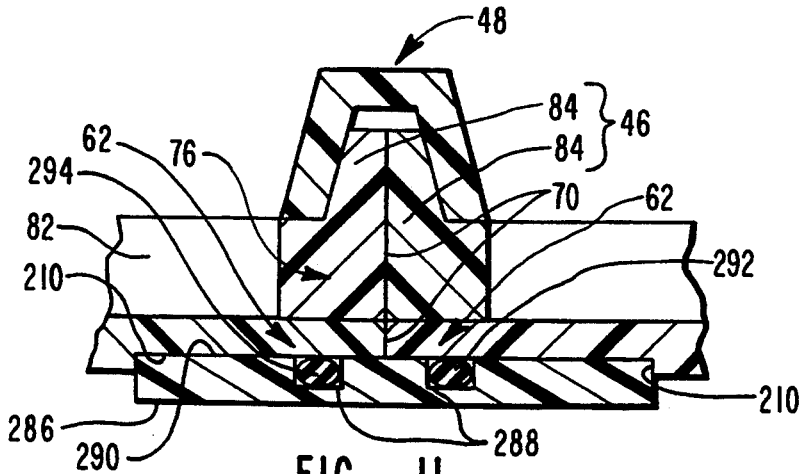
FIG. 11 is an enlarged cross-sectional plan view similar to that of FIG. 9 taken with respect to the second embodiment of a drive cylinder liner sleeve illustrated in FIG. 10.

In the assembled relationship illustrated in FIG. 11 drive cylinder liner sleeve 284 with first and second drive cylinder liner sleeve sealing rings 292, 294, respectively, retained thereon is then disposed in drive cylinder liner sleeve receiving recess 210 formed in the side walls of canisters 62. The first drive cylinder liner sleeve sealing ring 292 is compressed against the inner surface of the side walls of canister 62 to the right side of sealing joint 70, while second drive cylinder liner sleeve sealing ring 294 is compressed against the inner surface of the side walls of the canister 62 to the left of sealing joint 70. This arrangement of a pair of drive cylinder liner sleeve sealing rings 294 affords additional security to the fluid-tight seal required at sealing joint 70 when substantial tolerance between the size of drive cylinder liner sleeve 284 and the size of drive cylinder liner sleeve receiving recess 210 is desirable.

Figure 12:
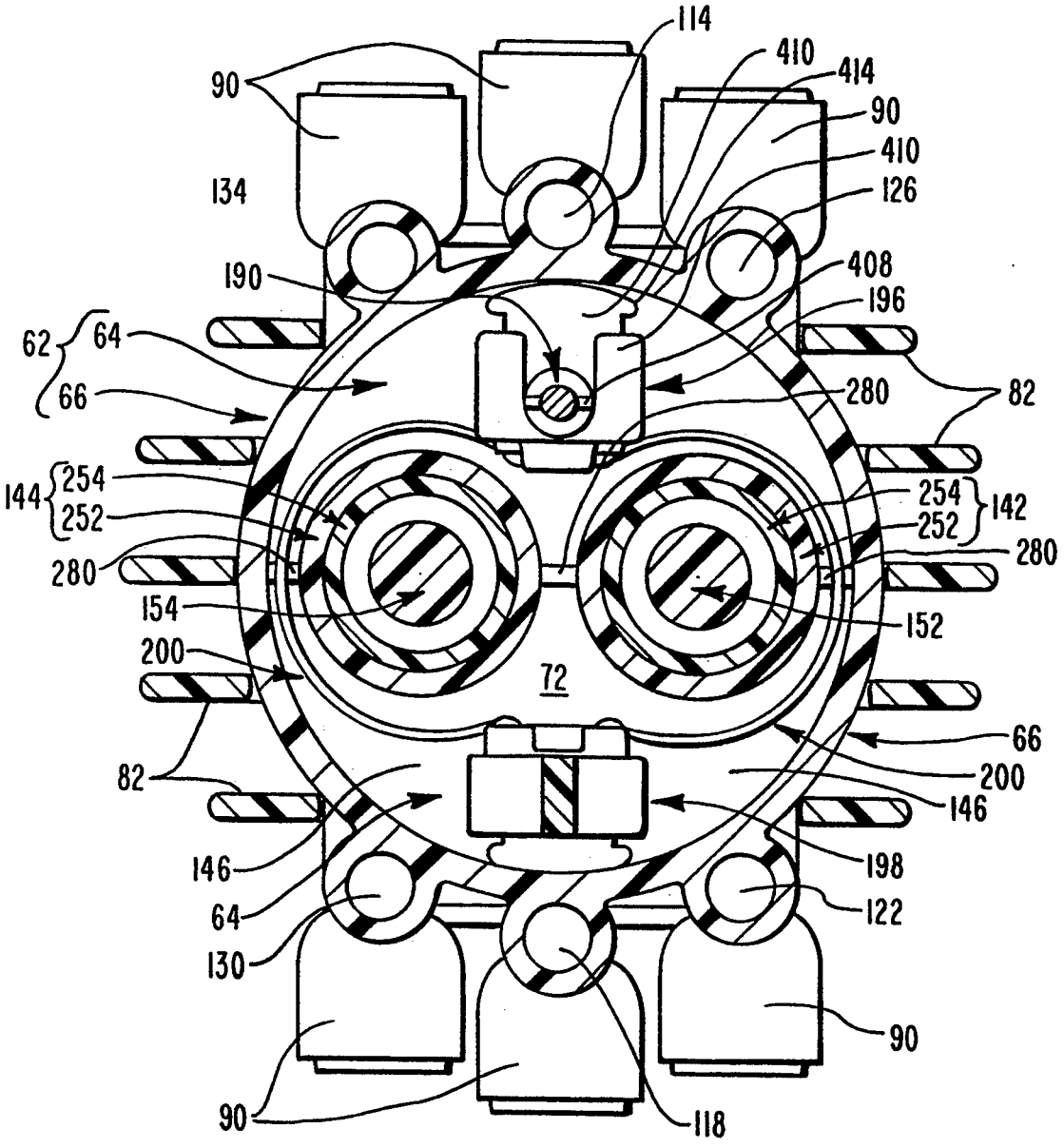
FIG. 12 is a cross-sectional lateral elevation view of the proportioning pump of FIGS. 2, 3, and 8 in an assembled condition taken along section line 12—12 shown therein.

FIG. 12 is a cross-sectional lateral elevation view of proportioning pump 10 of FIGS. 2 and 3 in the assembled condition thereof taken through first drive fluid chamber 162 looking toward inner face 146 of the canister 66 shown on the right side of those figures. Proportioning pistons 142, 144 project from inner surface 146 of that canister 66 and are shown in cross-section in FIG. 12 with the proportioning piston footings of proportioning pistons 152, 154, respectively, extending thereinto. Springs 200 are shown encircling proportioning pistons 42, 44 to the outsides thereof and held in compression between valve slide block 196 and spring shoe 198. As can be seen in FIG. 2, each of valve slide block 196 and spring shoe 198 bear against the interior surface of side walls 66 of canister 62 for reciprocating sliding movement thereagainst. Kicker ridge 280 projecting from inner surface 146 of end wall 64 at the far end of first drive fluid chamber 166 is also illustrated in FIG. 12.

Figure 13:
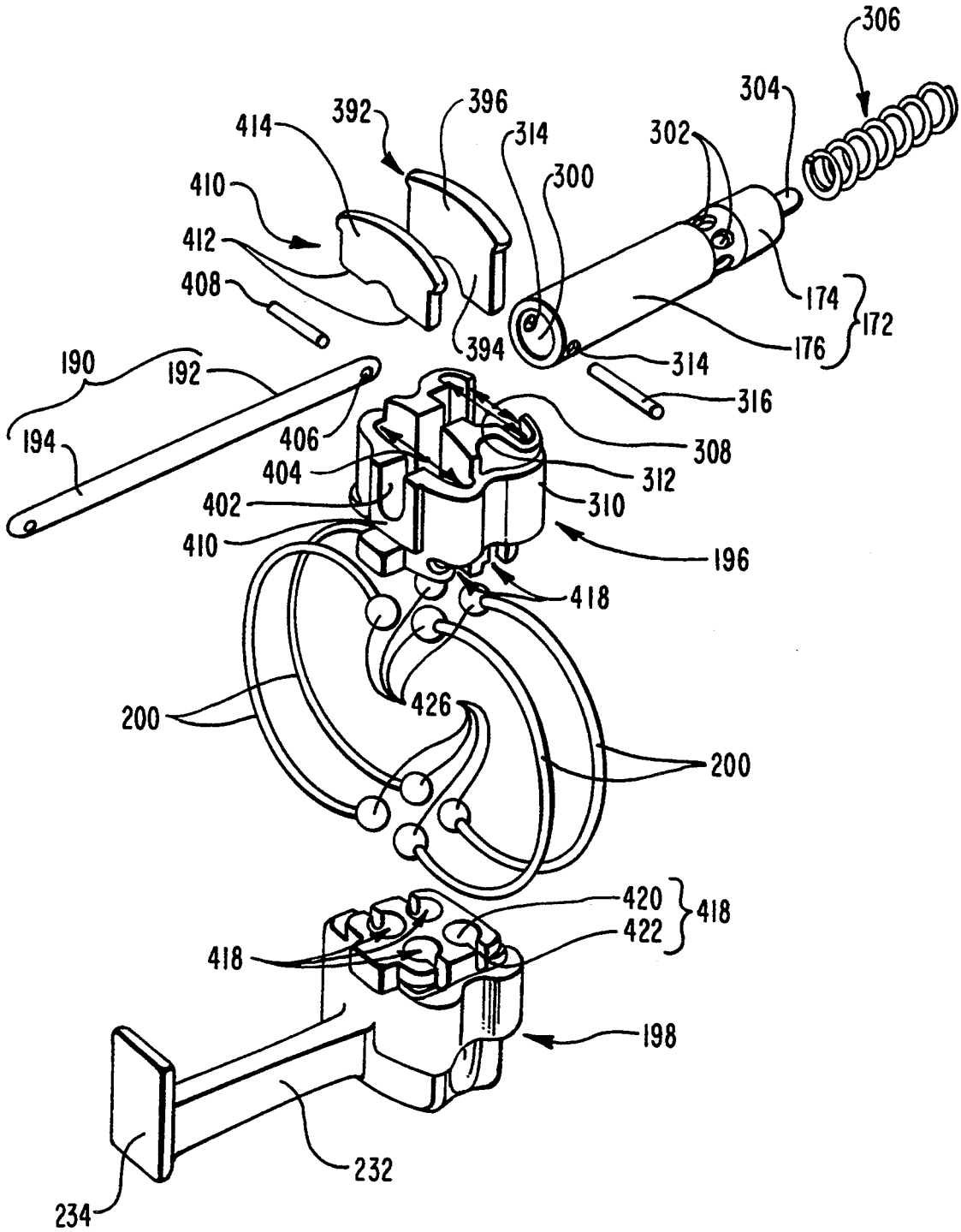
FIG. 13 is an exploded disassembled perspective view of the components of the drive reversal mechanisms located on one side of the drive piston of the proportioning pump illustrated in FIG. 4.

FIG. 13 is an exploded disassembled prospective view of the components of the drive reversal means of the present invention located on the right side of drive piston 140 in FIGS. 4 and 5. Wherever reference characters for these elements of the drive reversal mechanism have been introduced previously, those identical reference characters will be used to refer to the corresponding mechanisms in FIG. 13. Thus, in FIG. 13 first valve stem 172, valve linkage shaft 190, valve slide block 196, spring shoe 198, and springs 200 are illustrated.

Nevertheless, as can better be appreciated by reference to FIG. 13, first valve stem 172 is shown as having formed longitudinally therethrough a valving passageway 300 that opens at free end 176 of first valve stem 172 into first drive fluid chamber 166 in both the first and the second operative modes of the valving means of the present invention. The opposite end of valving passageway 300 in first valve stem 172 opens laterally thereof through valving apertures 302 in first end 174 of first valve stem 172. First end 174 of first valve stem 172 is otherwise closed, terminating in a booster spring retention nipple 304. Valving apertures 302 permit valving passageway 300 to communicate with pressurized drive fluid inlet passageway 92 in the first operative mode of the valving means of the present invention and with drive fluid outlet passageway 96 in the second operative mode thereof. These operative consequences of the structure of the drive reversal means illustrated in FIG. 13 will become clearer with reference to FIGS. 14A, 14B, 14C, and 14D.

Nevertheless, as further illustrated in FIG. 13, a booster spring 306 is provided which is retained in compression in alignment with valve bore 94 between the spring receiving recess within protuberance 98 of end plate 75 of fluid tubing manifold 76 and first end 174 of first valve stem 172. Booster spring retention nipple 304 serves to stabilize booster spring 306 as thusly assembled in proportioning pump 10. Booster spring 306 thus urges first valve stem 172 out of valve bore 94 toward first drive fluid chamber 166. In the second operative mode of the valving means of the present invention this assists in driving the valving means into the first operative mode.

A similar booster spring 306 is provided relative to second valve stem 182 and valve bore 94 that communicates with second drive fluid chamber 168 housed within canister 62 shown on the left side of FIGS. 4 and 5. While not illustrated in FIG. 13, booster spring 306 associated with second valve stem 182 and booster spring 306 associated with first valve stem 172 are both fully depicted in FIGS. 14A–14D that follow. The booster spring 306 associated with second valve stem 182 is retained in compression in alignment with valve bore 94 between the spring receiving recess within protuberance 98 of end plate 78 of fluid tubing manifold 76 and first end 174 of second valve stem 182. That booster spring 306 thus urges second valve stem 182 out of valve bore 94 toward second drive fluid chamber 168. In the first operative mode of the valving means of the present invention, this assists in driving the valving means into the second operative mode.

Slide valve block 196 illustrated in FIG. 13, is pivotally and laterally slidably attached on each end thereof to first valve stem 172 and to valve linkage shaft 190, respectively. Therefore, valve slide block 196 engages in reciprocating sliding motion against the inside of drive cylinder 72 when the over-center means of the present invention drives the linkage means thereof to operate the first and second valve means of the present invention between the first and second operative modes thereof.

As illustrated in FIG. 13, an open-topped valve stem recess 308 is formed through the wall of slide block 196 at a first side 310 thereof. An open-topped valve stem retention pin receiving slot 312 is also formed in first side 310 of slide block 196 normal to valve stem receiving recess 308 and parallel to first side 310 of slide block 196.

A pair of valve stem retention pin apertures 314 are formed laterally through the walls of free end 176 of first valve stem 172 on opposite sides of valving passageway 300. A valve stem retention pin 316 is slidably disposed through valve stem retention pin apertures 314. In the assembled state of the driving means of the present invention valve stem retention pin 316 projects from each side of free end 176 of first valve stem 172. In this condition, free end 176 of first valve stem 172 may be disposed in valve stem recess 308 while simultaneously valve stem retention pin 316 is received in valve stem retention pin receiving slot 312.

A valve stem retention bar 320 is then utilized to trap free end 176 of first valve stem 172 in valve stem receiving recess 308 with valve stem retention pin 316 passing therethrough and being disposed in valve stem retention pin receiving slot 312. Valve stem retention bar 320 has a first edge 392 that is received into valve stem retention pin receiving slot 312 bridging valve stem receiving recess 308. In this manner, valve stem retention bar 320 serves to operably couple free end 176 of first valve stem 172 to slide block 196, while permitting to a degree both tilting and sliding freedom therebetween. By the coupling described above, first valve stem 172 is tiltable relative to slide block 196 about valve stem retention pin 316 and is slidable relative to slide block 196 along valve stem retention pin 316. These degrees of freedom relative to the assembly of the above-described components of the driving means of the present invention facilitate the easy assembly thereof and permit the operation thereof with valve linkage shaft sliding through drive piston 140 without the development of binding forces therebetween.

Advantageously, valve stem retention bar 320 may be comprised of a material that facilitates the reciprocating sliding motion thereof against the inside of cylinder 72 mentioned previously relating to FIG. 12. Toward this end, valve stem retention bar 392 is provided with a second edge 396 opposite from first edge 394 thereof that projects from slide block 196 in the assembled form of elements of the driving means disclosed. Second edge 396 of valve stem retention bar 320 has a convex curvature that is complimentary to the curvature of the inside of drive cylinder 72.

Valve linkage shaft 190 is similarly secured to a second side 400 of slide block 196 opposite from first side 310 thereof. An open-topped valve linkage shaft recess 402 is formed through a wall of slide block 196 at second side 400 thereof. An open-topped valve linkage shaft retention pin receiving slot 404 is also formed in second side 400 of slide block 196 normal to valve linkage shaft recess 402 and parallel to second side 400 of slide block 196. A valve linkage shaft retention pin aperture 406 is formed laterally through first end 192 of valve linkage shaft 190. A valve linkage shaft retention pin 408 is slidably disposed through valve linkage shaft retention pin aperture 406 with valve linkage shaft retention pin 408 projecting outwardly from each side thereof. In this condition, first end 192 of valve linkage shaft 190 may be disposed in valve linkage shaft recess 402 with valve linkage shaft retention pin 408 entering valve linkage shaft retention pin receiving slot 404.

A valve linkage shaft retention bar 410 is then used to trap first end 192 of valve linkage shaft 190 in valve linkage shaft receiving slot 402 with valve linkage shaft retention pin 408 passing therethrough and being disposed in valve linkage shaft retention pin receiving slot 404. Valve linkage shaft retention bar 410 has a first edge 412 that is received into valve linkage shaft retention pin receiving slot 404 bridging valve linkage shaft receiving recess 402 for that purpose.

This serves to operably couple first end 192 of valve linkage shaft 190 to slide block 196 while permitted two degrees of movement relative thereto. Valve linkage shaft 190 is first tiltable relative to slide block 196 about valve linkage shaft retention pin 408. Secondly, valve linkage shaft 190 is slidable relative to slide block 196 along valve linkage shaft retention pin 408. This correspondingly facilitates the assembly of the disclosed components of the driving means of the present invention and contributing to the avoidance of binding stresses thereon during the operation of proportioning pump 10.

As with valve stem retention bar 320, valve linkage shaft retention bar 410 may advantageously be comprised of a material that facilitates the reciprocating motion of slide block 196 along the inside surface of drive cylinder 72. Toward that end, valve linkage shaft retention bar 410 is provided with a second edge 414 which projects from slide block 196 in the assembled relationship thereof and has a convex curvature that is complimentary to the curvature of the inside of drive cylinder 72. Second edge 414 of valve linkage shaft retention bar 410 can be seen bearing against the inside surface of drive cylinder 72 in FIG. 12.

As also shown in FIG. 13, spring shoe 198 is provided on the surface thereof opposing slide block 196 with spring receiving slots 418, which each comprise a spherically shaped socket 420 and a laterally outwardly extending aperture 422 communicating therewith. In the embodiment of spring shoe 198 shown in FIG. 13, four such spring receiving slots 418 are illustrated. A corresponding set of four spring receiving slots 418 are formed in the lower surface of slide block 196, although these are only partially visible in FIG. 13.

Spring receiving slots 418 on spring shoe 198 shown in FIG. 13 in turn perform the function of a drive bearing surface rigidly attached to drive piston 140 on one side thereof. Spring receiving slots 418 on slide block 196 shown in FIG. 13 in turn perform the function of a first linkage bearing surface attached to valve linkage shaft 190 on that same side of drive piston 140. Springs 200 are held in compression between spring receiving slots 418 on spring shoe 198 and spring receiving slots 418 on valve slide block 196.

When assembled, and as will be illustrated subsequently, it is significant in the proportioning pump of the present invention that the drive bearing surface that follows drive piston 140 in each alternating stroke of the reciprocating motion thereof reaches the center position thereof prior to the drive bearing surface that leads drive piston 140 in that same stroke of that motion.

FIG. 13 enables a clear appreciation of the nature of springs 200, which are there shown to each comprise a resilient c-shaped hoop. To optimize the motor power for the over-center means of the present invention, it has been found advantageous to configure these c-shaped hoops of springs 200 with an ambit between the free ends thereof that is slightly greater than 180 degrees. In addition, each of springs 200 is provided at the free ends thereof with a mounting ball 426 that is snappingly receivable into sockets 420 of spring receiving slots 418. The portion of springs 200 adjacent to mounting balls 426 exit spring receiving slots 418 through apertures 422. The cooperative action of apertures 422 on those portions of springs 200 adjacent to mounting balls 426 serves to stabilize springs 200 in the compressed state thereof.

The use of pairs of springs, such as c-shaped springs 200, has been found to result in several advantages. Paired springs 200 exhibit less fatigue and therefore enjoy longer effective lifetimes than would single-piece springs. The stress of compression between the valve blocks and shoe springs of proportioning pump 10 is more evenly distributed to each side thereof using a pair of springs as shown in FIG. 13. In addition, providing springs 200 with an ambit greater than 180 degrees results in a more even distribution of stresses along the length of the springs than if springs 180 were merely semicircular or smaller. Similar c-shaped springs 202 are utilized on the opposite side of drive piston 140 in second drive fluid chamber 168.

The manner in which the direction of movement of drive piston 140 is reversed will now be disclosed in relation to the sequence of FIGS. 14A, 14B, 14C, and 14D.

First, however, the structure as illustrated in these figures will be explained in some detail by reference to FIG. 14A. There, drive piston 140 can be seen to be positioned within drive cylinder 72 separating first drive fluid chamber 166 from second drive fluid chamber 168. Drive piston 140 engages in reciprocating motion sliding freely upon valve linkage shaft 190, which passes therethrough.

In order to admit pressurized drive fluid alternately into first drive fluid chamber 166 and second drive fluid chamber 168, proportioning pump 10 includes a pressurized drive fluid inlet passageway 92 in each end of housing 60 of proportioning pump 10. Pressurized drive fluid inlet passageways 92 are placed in communication one with another by way of transverse pressurized drive fluid inlet passageway 118. In addition, a drive fluid outlet passageway 96 is formed in each end of proportioning pump 10 interconnected by transverse drive fluid outlet passageway 114.

As shown, the pressurized drive fluid inlet passageway 92 and drive fluid outlet passageway 96 on the side of proportioning pump 10 adjacent to first drive fluid chamber 166 are coupled at enlarged openings 90 with pressurized drive fluid supply tube 30 and drive fluid discharge tube 40, respectively. Hose fittings 430 that are shown in additional detail in FIG. 16. Enlarged openings 90 on the side of proportioning pump 10 adjacent to second drive fluid chamber 168 are, however, closed by plugs 432.

Thus, pressurized drive fluid from drive fluid supply tube 30 is communicated to both drive fluid plenums 100 on either side of proportioning pump 10. Correspondingly, through the mechanism of the first and second valving means of the present invention, drive fluid alternately from first or second drive fluid chambers 166, 168, respectively, is discharged from proportioning pump 10 through drive fluid discharge tube 40.

Figure 15A:
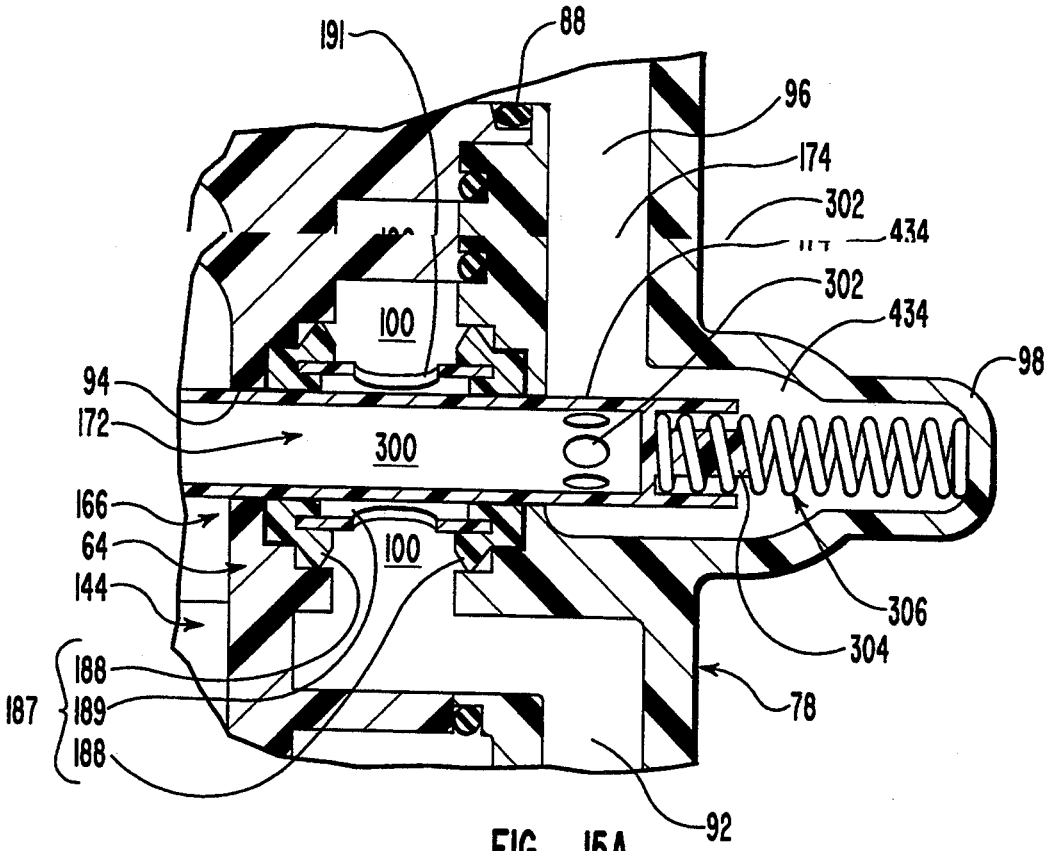
FIG. 15A is an enlarged cross-sectional elevation view of a drive fluid valve shown in the position thereof illustrated on the right side of FIG. 14A.

Neither pressurized drive fluid inlet passageway 92 nor drive fluid outlet passageway 96 on either side of proportioning pump 10, however, communicate directly with the interior of drive cylinder 72. A first valving means is provided for placing drive fluid inlet passageway 92 and drive fluid outlet passageway 96 on the side of proportioning pump 10 adjacent first drive fluid chamber 166 alternately in communication with first drive fluid chamber 66. By way of example and not limitation, such a first valving means comprises valve bore 94 which extends from first drive fluid chamber 166 into housing 60 of proportioning pump 10 and communicates with both pressurized drive fluid inlet passageway 92 and drive fluid outlet passageway 96. Valve bore 94 is not labeled in FIG. 14A, as there valve bore 94 is filled by first valve stem 172 which is slidably disposed therein. Nevertheless, FIG. 15A provides a substantially enlarged view of this same portion of FIG. 14A, and there valve bore 94 is labeled.

Valving passageway 300 longitudinally formed through first valve stem 172 opens at first end 174 thereof through valving apertures 302 into either of pressurized drive fluid inlet passageway 92 or drive fluid outlet passageway 96, depending upon the longitudinal position of first valve stem 172 in valve bore 94. As shown in FIG. 14A, the position of first valve stem 172 is such that valving apertures 302 are within drive fluid outlet passageway 96, whereby first drive fluid chamber 166 is vented through valving passageway 300 to permit the positive displacement of drive fluid from first drive fluid chamber 166.

Correspondingly, a second valve means is provided for alternately placing pressurized drive fluid inlet passageway 92 and drive fluid outlet passageway 96 in the side of housing 60 of proportioning pump 10 adjacent to second drive fluid chamber 168 in communication with second drive fluid chamber 168. By way of example and not limitation, valve bore 94 extends from second drive fluid chamber 168 into housing 60 of proportioning pump 10 and communicates with both pressurized drive fluid inlet passageway 92 and drive fluid outlet passageway 96. Valve bore 94 is not identified in FIG. 14A, as second valve stem 182 is shown slidably disposed therein.

Second valve stem 182 extends from second drive fluid chamber 168 into housing 60 of proportioning pump 10 adjacent thereto to communicate with either pressurized drive fluid inlet passageway 92 or drive fluid outlet passageway 96, depending upon the longitudinal position of second valve stem 182.

Valving passageway 300, formed longitudinally through valve stem 182, opens at first end 174 thereof through valving apertures 302 into either of pressurized drive fluid inlet passageway 92 or drive fluid outlet passageway 96. As shown in FIG. 14A, the position of second valve stem 182 is such that valving apertures 302 thereof are within pressurized drive fluid inlet passageway 92, whereby drive fluid therefrom is permitted to enter second drive fluid chamber 168 providing motive force therefor to move drive piston 140 in the direction shown by arrow B.

Figure 15B:
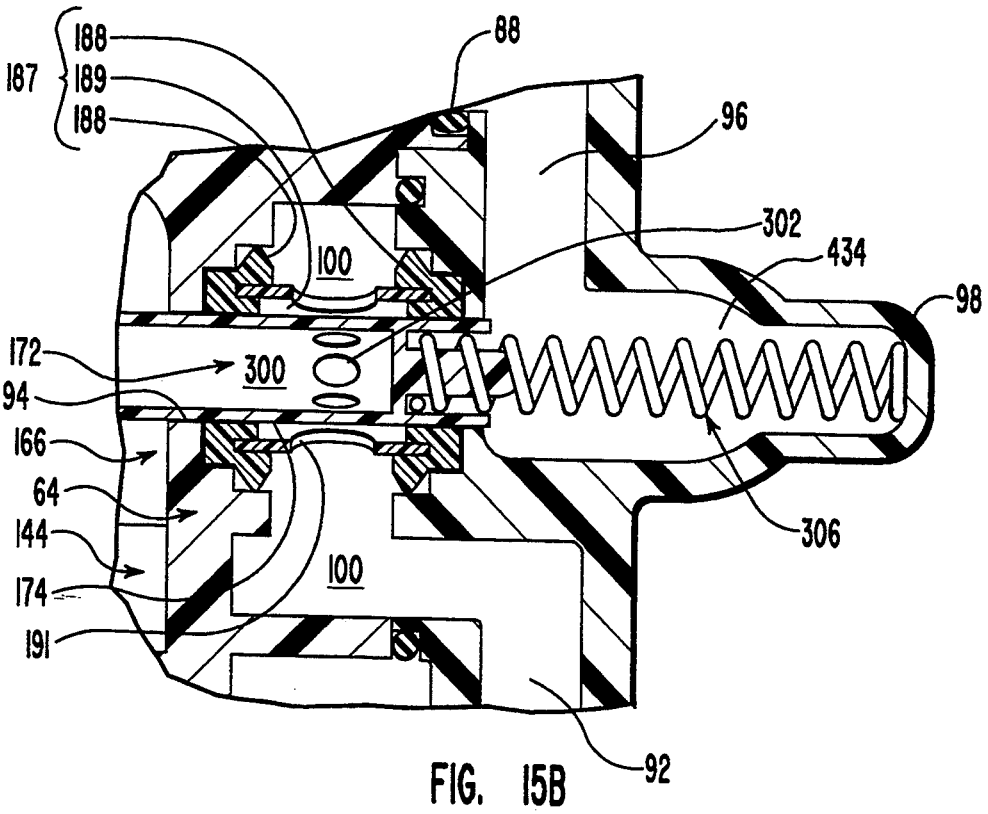
FIG. 15B is an enlarged cross-sectional elevation view of the drive fluid valve of FIG. 15A shown in the position thereof illustrated on the right side of FIG. 14D.

As illustrated in FIG. 14A, each valve bore 94 is provided with a seal assembly 187 already disclosed relative to FIG. 3 and are illustrated in the assembled position thereof in FIGS. 15A and 15B. Chevron seals 188 thereof engage the outer surface of valve stems 172, 182 during the reciprocating sliding movement thereof. Perforations 191 formed in cylindrical sleeve 189 permit drive fluid in drive fluid plenum 100 from pressurized drive fluid inlet passageway 92 to flow into proximity with the outer sides of valve stems 172, 182 and thereby to enter valving apertures 302, when the respective positions of valve stems 172, 182 locate valve apertures 302 within seal assembly 181.

Also shown in FIG. 14A are booster springs 306 disposed within a spring receiving recess 434 inside protuberance 98 in compression therewith between respective first ends 174 of valve stems 172, 182.

Booster spring 306 associated with first valve stem 172 is shown in FIG. 14A in a more highly compressed state than is booster spring 306 associated with second valve stem 182. This difference in compression between each of valve stems 306 is a result of the differing positions of each of first and second valve stems 172, 178 longitudinally in the valve bore 94 and seal assembly 187 associated therewith.

Figure 14C:
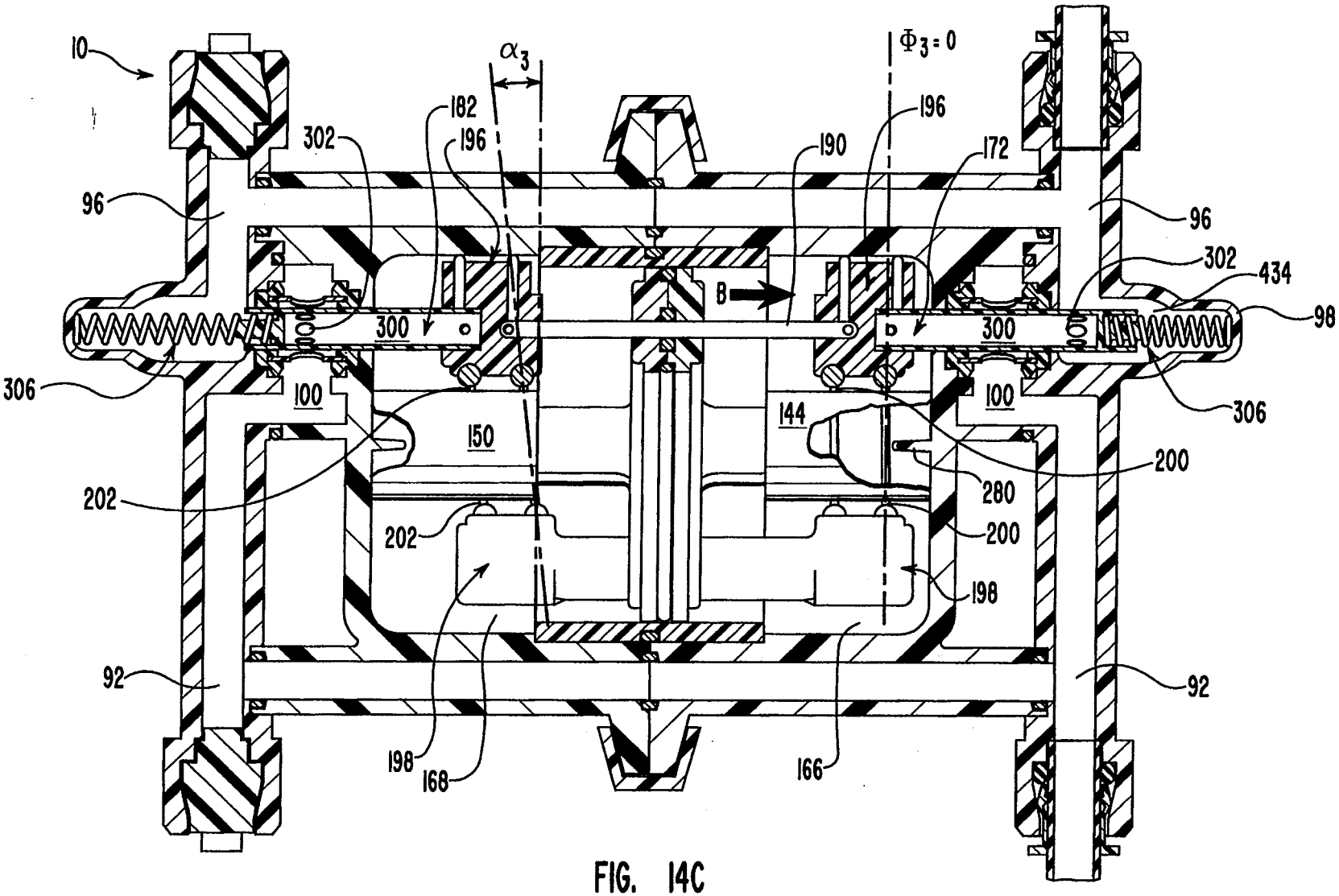
FIG. 14C is a cross-sectional longitudinal elevation view of the device shown in FIGS. 14A and 14B shown in a succeeding third stage of operation.

The operation of first and second valve stems 172, 182, respectively, is coordinated by a linkage means comprising valve linkage shaft 190, valve slide blocks 196, and the associated linkages therebetween. These structures serve to operate first and second valve stems 172, 182, respectively, in either a first or a second operative mode. In the first operative mode, first drive fluid chamber 166 is placed in communication with pressurized drive fluid inlet passageway 92 adjacent thereto, while second drive fluid chamber 168 is placed in communication with drive fluid outlet passageway 96 adjacent thereto. In the first operative mode, drive piston 140 is urged in the direction of first drive fluid chamber 166 from which nonpressurized drive fluid is thereby positively displaced. The first operative mode is illustrated in FIGS. 14A, 14B, and 14C.

Figure 14D:
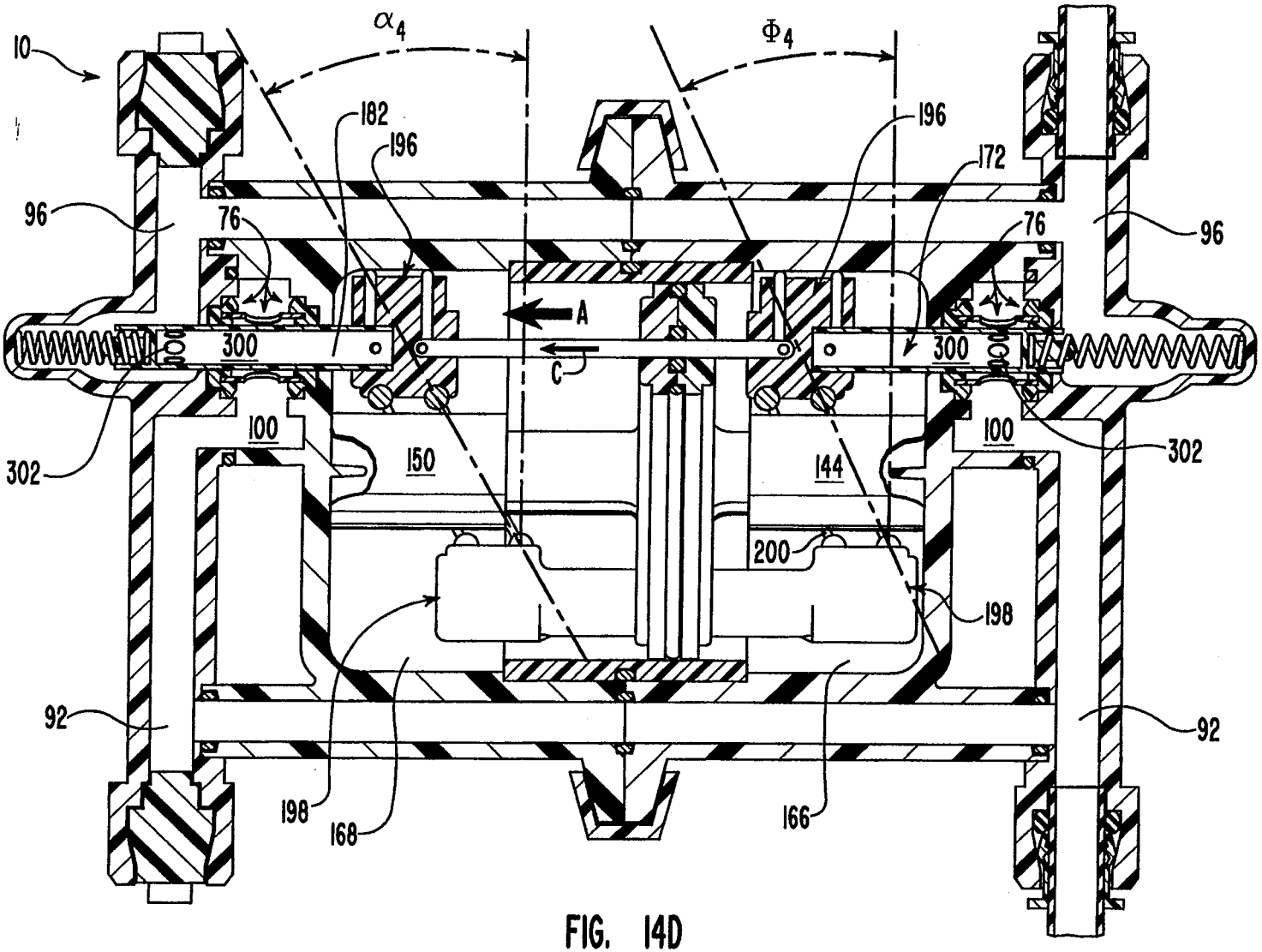
FIG. 14D is a cross-sectional longitudinal elevation view of the device shown in FIGS. 14A–14C shown in a succeeding fourth stage of operation.

In the second operative mode of first and second valve stems 172, 182, respectively, first drive fluid chamber 166 is placed in communication with drive fluid outlet passageway 96 adjacent thereto, while second drive fluid chamber 168 communicates with pressurized drive fluid inlet passageway 92 adjacent thereto. In the second operative mode, drive piston 140 is urged in the direction of second drive fluid chamber 168, accordingly displacing therefrom nonpressurized drive fluid. The second operative mode is illustrated in FIG. 14D and will be more readily understood following a short discussion of the manner in which valve linkage shaft 190 with valve slide blocks 196 attached thereto is driven alternately into the first and second operative modes.

This is accomplished using the same source of power as causes movement in drive piston 140, namely the pressurized drive fluid. Toward this end, the inventive proportioning pump comprises an over-center means for driving valve linkage shaft 190 to operate first valve stem 172 and second valve stem 182 between the first and second operative modes in response to the completion of each of the successive strokes of the reciprocal motion of drive piston 140. As shown in FIG. 14A by way of example and not limitation, the over-center means of the present invention comprises at least one linkage bearing surface and one drive bearing surface on either side of drive piston 140 and a pair of resilient springs 200, 202 compressed therebetween. Each linkage bearing surface is formed on valve slide block 196, while each drive bearing surface is formed on spring shoe 198 that is attached to drive piston 140.

On the side of drive piston 140 facing first drive fluid chamber 166, spring shoe 198 is moveable in each successive stroke of the reciprocating motion of drive piston 140 into a center position relative to the valve slide block 196 associated therewith that is maximally proximate thereto. Springs 200 mounted in compression therebetween urge valve slide block 196 and valve linkage shaft 190 attached thereto into the first operative mode when spring shoe 198 is on the side of the center position thereof adjacent to drive piston 140. When spring shoe 198 is on the side of the center position thereof remote from drive piston 140, however, springs 200 urge valve slide block 196 and valve linkage shaft 190 attached thereto into the second operative mode. Spring shoe 198 disposed in first drive fluid chamber 166 can be seen in the center position thereof in FIG. 14C.

On the side of drive piston 140 adjacent to second drive fluid chamber 168 are at least one second linkage bearing surface and at least one second drive bearing surface. These are formed on the valve slide block 196 and the spring shoe 198, respectively, that are disposed in second drive fluid chamber 168. Spring shoe 198 disposed in second drive fluid chamber 168 is moveable in each successive stroke of drive piston 140 into a center position relative to the valve slide block 196 associated therewith that is maximally proximate thereto. Springs 202 mounted in compression between spring shoe 198 and valve slide block 196 in second drive fluid chamber 168 urge the valve slide block 196 in second drive fluid chamber 168 and valve linkage shaft 190 attached thereto into the first operative mode when spring shoe 198 in second drive fluid chamber 168 is on the side of the center position thereof remote from drive piston 140. When spring shoe 198 in second drive fluid chamber 168 is on the side of the center position thereof adjacent to drive piston 140, however, springs 202 associated therewith urge valve slide block 196 and valve linkage shaft 190 attached thereto into the second operative mode. Spring shoe 198 and valve slide block 196 in second drive fluid chamber 168 can be seen in the center position thereof in FIG. 14B.

The operation of the drive reversal means of the present invention will now be explained by reference to the sequence of FIGS. 14A–14D.

In FIG. 14A, first and second valve stems 172, 182, respectively, are in the second operative mode. First drive fluid chamber 166 is in communication through first valve stem 172 with drive fluid outlet passageway 96 adjacent to first drive fluid chamber 166, while second drive fluid chamber 168 is in communication through second valve stem 182 with pressurized drive fluid inlet passageway 92 formed adjacent to second drive fluid chamber 168. Under these conditions, the pressure of the drive fluid in second drive fluid chamber 168 impels drive piston 140 to the right as shown in FIG. 14A by arrow B. In the process, drive fluid is positively displaced from first drive fluid chamber 166 through valving passageway 300 in first valve stem 172 and drive fluid outlet passageway 96 formed adjacent to first drive fluid chamber 166. Simultaneously, one of the constituent fluids is also positively displaced from proportioning cylinder 144, while the same constituent fluid is drawn into proportioning cylinder 150 on the opposite side of drive piston 140. Movement of drive piston 140 in the direction of arrow B with spring shoes 198 attached thereto initially tends to bring both of spring shoes 198 closer to the respective center position thereof.

In FIG. 14A, an angle $\alpha_1$ is formed at spring shoe 198 in second drive fluid chamber 168 between the vertical and valve slide block 196. The inclination of springs 202 implied by angle $\alpha_1$ tends to urge the slide block 196 associated therewith into the second operative mode there illustrated.

Correspondingly, an angle $\phi_1$ is formed at spring shoe 198 in first drive fluid chamber 166 between the vertical and valve slide block 196. The inclination of springs 200 implied by angle $\phi_1$ tends to urge the slide block 196 associated therewith into the second operative mode there illustrated.

The angle $\alpha_1$ shown in FIG. 14A is less than the angle $\phi_1$. Ultimately, this is an indication that the spring shoe 198 located in drive fluid chamber 168 is closer to the center position thereof than is the spring shoe 198 located in first drive fluid chamber 166.

In FIG. 14B movement of drive piston 140 in the direction shown by arrow B is seen to have driven the spring shoe 198 located in second drive fluid chamber 168 into the center position thereof maximally proximate to the valve slide block 196 also located in second drive fluid chamber 168. As a result, the angle $\alpha_2$ formed at spring shoe 198 between the vertical and valve slide block 196 is zero and springs 200 therebetween are placed in maximum compression.

The angle $\phi_2$ formed at spring shoe 198 in first drive fluid chamber 166 between the vertical and the corresponding valve slide block 196 is, however, reduced in measure relative to angle $\phi_1$ shown in FIG. 14A. The reduced measure of angle $\phi_2$ relative to angle $\phi_1$ is an indication that the movement of drive piston 140 from the depiction in FIG. 14A to the depiction in FIG. 14B has served to move the spring shoe 198 that is in first drive fluid chamber 168 closer to the center position thereof.

The inclination of angle $\phi_2$, however, indicates that springs 200 continue to urge slide block 196 associated therewith into the second operative mode as shown. Therefore, the net force upon valve linkage shaft 190 imposed by springs 200 and springs 202 in FIG. 14B tends to maintain the linkage means of the present invention in the second operative mode there illustrated. To a degree, however, the additional compression of booster spring 306 associated with first valve stem 172 relative to the compression of booster spring 306 associated with second valve stem 182 tends to reduce this net force of springs 200, 202 in urging valve linkage shaft 190 into the second operative mode illustrated.

In FIG. 14B first and second valve stems 172, 182, respectively, are thus still in the second operative mode with first drive fluid chamber 166 being vented through first valve stem 172 to drive fluid outlet passageway 196 adjacent to first drive fluid chamber 166. Second drive fluid chamber 168 is pressurized through second valve stem 182 from pressurized drive fluid inlet passageway formed adjacent to second drive fluid chamber 168. Under such conditions, movement of drive piston 140 in the direction of arrow B continues as pressurized drive fluid fills second drive fluid chamber 168 moving drive piston 140 in the direction of arrow B and positively displacing drive fluid from first drive fluid chamber 166. Concomitantly, constituent fluid continues to be displaced from proportioning cylinder 144 while the same constituent fluid is drawn into proportioning cylinder 150.

Continued movement of drive piston 140 in the direction of arrow B eventually brings spring shoe 198 in second drive fluid chamber 168 past the center position thereof. In this situation, the associated springs 202 will commence to urge valve block 196 located in second drive fluid chamber 168 and valve linkage shaft 190 attached thereto out of the second operative mode. Nevertheless, the urging of springs 200 located on the opposite side of drive piston 140 in first drive fluid chamber 166 will preclude any shift of position in valve linkage shaft 190 for yet a period of continued movement of drive piston 140 in the direction of arrow B.

That continued movement of drive piston 140 in the direction shown by arrow B in FIG. 14B brings the components of proportioning pump 10 into the relationship shown in FIG. 14C. There, spring shoe 198 located in first drive fluid chamber 166 has reached the center position thereof relative to the corresponding valve slide block 196 also located in first drive fluid chamber 166. Accordingly, springs 200 in compression therebetween are in a maximum state of compression, and the angle $\phi_3$ formed at spring shoe 198 between the vertical end of valve slide block 196 is zero.

As suggested in the immediately preceding paragraph, the angle $\alpha_3$ formed at spring shoe 198 in second drive fluid chamber 168 between the vertical and the corresponding valve slide block 196 is no longer zero, as was the case in FIG. 4B. Instead, the inclination of angle $\alpha_3$ indicates that springs 202 have begun to urge slide block 196 associated therewith out of the second operative mode.

Any further movement of drive piston 140 in the direction shown by arrow B will take spring shoe 198 in first drive fluid chamber 166 to the side of the center position thereof remote from drive piston 140, causing the springs 200 associated therewith to also urge valve block 196 located in first drive fluid chamber 166 and valve linkage shaft 190 attached thereto to the second operative mode. The positioning of spring shoe 198 located in second drive fluid chamber 168 is in FIG. 14C already on the side of the center position thereof adjacent to drive piston 140, so that springs 202 associated therewith tends to urge valve slide block 196 in second drive fluid chamber 168 and valve linkage shaft 190 attached thereto out of the second operative mode.

Thus, the over-center means of the disclosed invention as shown in FIG. 14C is about to drive the valving means thereof into a new operative mode and reverse the driven direction of drive piston 140. Nevertheless, prior to that reversal, first and second valve stems 172, 182, respectively, remain in the second operative mode with pressurized drive fluid entering second drive fluid chamber 168 and drive fluid from first drive fluid chamber 106 being positively displaced therefrom.

Should continued movement of drive piston 140 in the direction shown by arrow B not produce this reversal, then kicker ridge 280 in first drive fluid chamber 166 will come to bear as a fulcrum against the adjacent of springs 200, thereby increasing the leverage on valve slide block 196 to move into the second operative mode. The differential amounts of compression in booster springs 306 also assist in this regard.

FIG. 14D shows the relationship of the components of proportioning pump 10 after movement of drive piston 140 in the direction of arrow B past the position shown in FIG. 14C. Such movement displaces spring shoe 198 located in first drive fluid chamber 166 to the side of the center position thereof remote from drive piston 140, resulting in the biasing force of springs 202 associated therewith being added to that of springs 202 associated with spring shoe 198 in second drive fluid chamber 168 in urging both of valve slide blocks 196 and valve linkage shaft 190 attached therebetween out of the second operative mode. Accordingly, valve slide blocks 196 and valve linkage shaft 190 have snapped leftward as seen in FIG. 14D in the direction indicated by arrow C.

In FIG. 14D this has occurred. As a result, valving apertures 302 in first valve stem 172 no longer communicate with drive fluid outlet passageway 96 adjacent to first drive fluid chamber 166, but rather open seal assembly 197 and drive fluid plenum 100 into pressurized drive fluid inlet passageway 92 adjacent to first drive fluid chamber 166. At the opposite end of valve linkage shaft 190 second valve stem 196 has shifted position, so that valving apertures 302 thereof no longer communicate with pressurized drive fluid inlet passageway 92, but instead vent second drive fluid chamber 168 into drive fluid outlet passageway 196 formed adjacent to second drive fluid chamber 168. This is the second operative position for second valve stems 172, 182, respectively.

Under such conditions, pressurized drive fluid enters first drive fluid chamber 166 and begins to impel drive piston 140 leftwardly, as seen in FIG. 3D in the direction shown by arrow A. Correspondingly, drive fluid in second drive fluid chamber 168 begins to be positively displaced therefrom into fluid outlet passageway 96 adjacent to second drive fluid chamber 168. The action upon constituent fluid in proportioning cylinders 144, 150 is also reversed. Constituent fluid begins to be displaced from proportioning cylinder 150 and drawn into proportioning cylinder 144.

Movement in the direction of arrow A will continue, bringing spring shoe 198 in first drive fluid chamber 166 initially into the center position thereof, followed by bringing spring shoe 198 in second drive fluid chamber 168 into the center position thereof. The movement will then trigger the over-center mechanism of the inventive proportioning pump, altering the valving of the pressurized drive fluid and reversing the direction of drive piston 140 as the relative relationships shown in FIG. 14A are resumed. As a general rule, the spring shoe 198 that follows in the direction of travel of drive piston 140 is the first to reach the center position thereof.

Proportioning pump 10 is thus reliably driven in a reciprocating motion without the aid of any auxiliary power source, other than a pressurized drive fluid. In the process, the pressurized drive fluid and at least a first and a second constituent fluid are dispensed in a predetermined precise ratio one to the other. All moving parts required to effect this functioning are compactly housed interior to drive cylinder 72, and continuous flow is effected due to the positive displacement developed in both directions of the reciprocating motion of the pump.

The simplicity of the disclosed design renders proportioning pump 10 easy to assemble and rarely in need of maintenance. An additional advantage of the design disclosed resides in the fact that all dynamic seals incorporated thereto are fully lubricated on both sides thereof with fluids being dispensed. The wetting of these moveable seals on both sides thereof contributes substantially to the enhanced effective lifetime thereof.

FIG. 15A is an enlarged cross-sectional elevation view of first valve stem 172 for the drive fluid of proportioning pump 10 shown in the position thereof illustrated in FIG. 14A. Correspondingly, FIG. 15B is an enlarged cross-sectional elevation view of the first valve stem 172 shown in the position thereof illustrated in FIG. 14D.

Figure 16:
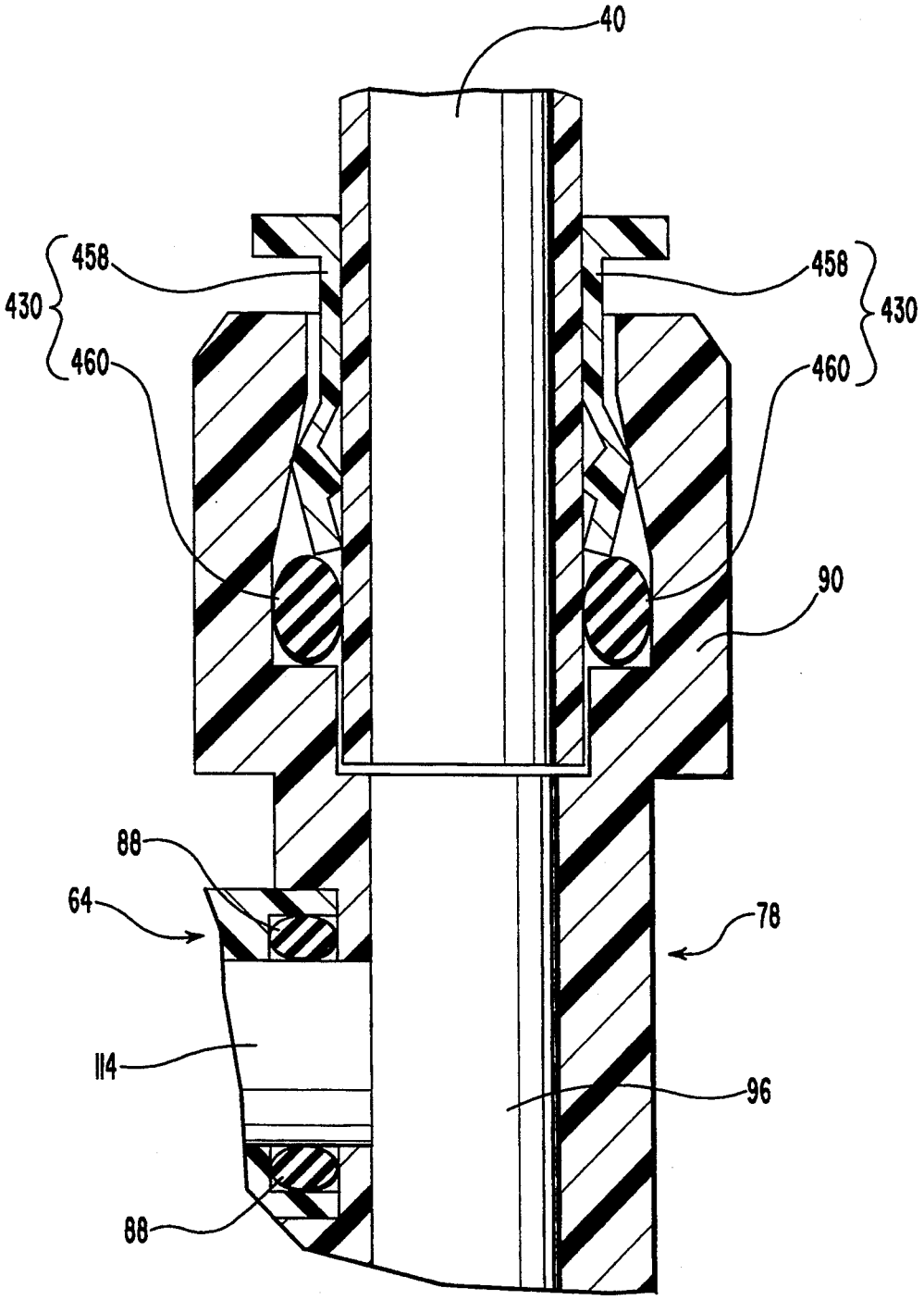
FIG. 16 is an enlarged cross-sectional elevation view of a typical hose sealing mechanism used to connect a supply or a discharge hose to the proportioning pump illustrated in FIG. 1.

FIG. 16 is an enlarged cross-sectional view of the hose fitting 430 shown in FIG. 14A as securing drive fluid discharge tube 40 to proportioning pump 10. As illustrated in FIG. 16, hose fitting 430 comprises a collar 258 inserted into enlarged opening 90 following a sealing ring 460. Hose fitting 430 may typically be a Super Speed Fit TM hose fitting of the type marketed by the John Guest Company. Such fittings are reusable and permit rapid securement of hoses without need for additional tools and without causing restriction of the flow in the hoses involved.

Figure 17:
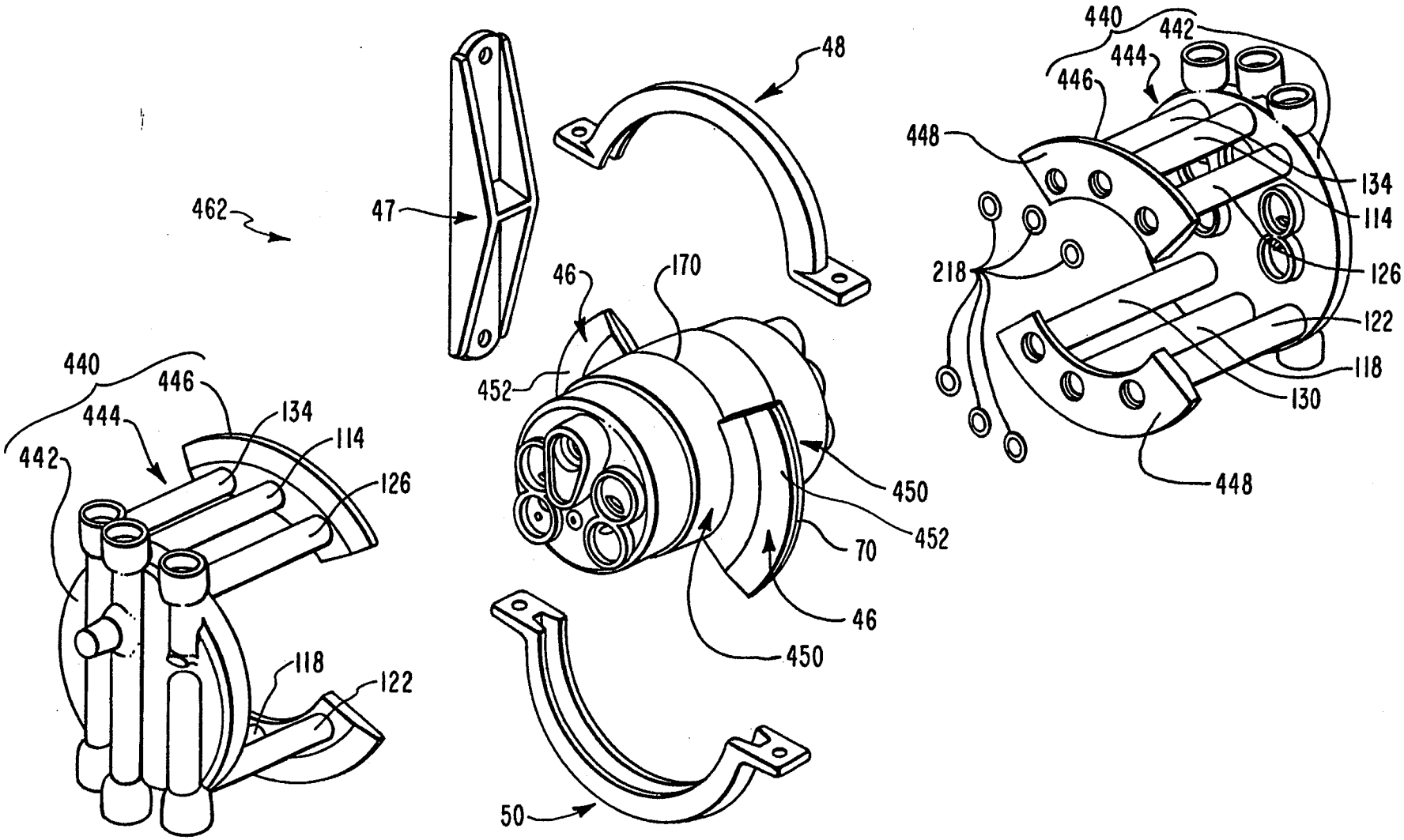
FIG. 17 is an exploded perspective view similar to FIG. 3 of a second embodiment of a proportioning pump utilizing fluid tubing manifolds configured alternatively to those illustrated in FIG. 3.

FIG. 17 is an exploded perspective view similar to FIG. 3 of a second embodiment of a proportioning pump 438 utilizing fluid tubing manifolds 440 contrasting with fluid tubing manifold 76 illustrated previously throughout this disclosure. Fluid tubing manifolds 440 comprises an end plate 442 and an assembly cage 444. Assembly cage 444 comprises various transverse fluid passageways that in the embodiment of proportioning pump 10 illustrated in FIG. 3 were formed instead on the exterior of canister 62. A fluid tubing manifold assembly flange 446 with a mating face 448 is formed on the end of assembly cage 444 to assist in the assembly thereof in a nesting arrangement about canisters 450.

As shown in FIG. 17, canisters 450 include no structures on the exterior of the sides thereof, except for canister assembly flanges 446. Otherwise, canisters 450 are substantially similar to canister 62 of housing 60 of proportioning pump 10 shown in FIG. 3. Canister assembly flanges 452 and assembly flanges 446 of fluid tubing manifold 440 in the assembled relationship of proportioning pump 438 comprise an encircling flange 46 with a sealing joint 70 therebetween that is clamped together by encircling semicircular bands 48, 50. Advantageously, proportioning pump 462 is lighter in weight than is proportioning pump 10 due to the absence from the exterior thereof of any structures corresponding to ribs 82 disclosed earlier on the exterior of proportioning pump 10.

According to one aspect of the present invention, flow of fluids through proportioning pump 10 is such that all flow is from a lower entry for a given fluid to an upper exit for that fluid. In this way, bubbles in the fluid flowing through proportioning pump 10 are purged therefrom during the course of operation. For example, it was seen to advantage in FIG. 7 that the first constituent fluid enters proportioning cylinder 148 through an entry site 277 that is located at a lower position than discharge site 278 from which the first constituent fluid is discharged from proportioning cylinder 148.

Drive fluid leaves each of first and second drive fluid chambers 166, 168, respectively, at the highest possible discharge location in end walls 64 of canister 62, a discharge location corresponding to valve bore 94 in which first and second valve stems 172, 178 are slidably disposed.

The mounting means of the disclosed invention permits the rotation of proportioning pump 10 about longitudinal axis L shown in FIG. 2 in order to optimize this arrangement of fluid flow in proportioning pump 10.

FIGS. 18A, 18B, 19A, and 19B are schematic fluid flow diagrams of proportioning pump 10. Selected elements of proportioning pump 10 are schematically depicted therein and labeled with identical reference characters as were used in the earlier figures to identify components of proportioning pump 10. In these figures, the drive fluid is represented by the letter "X," while the first constituent fluid is represented by the letter "Y" and the second constituent fluid is represented by the letter "X."

Figure 18A:
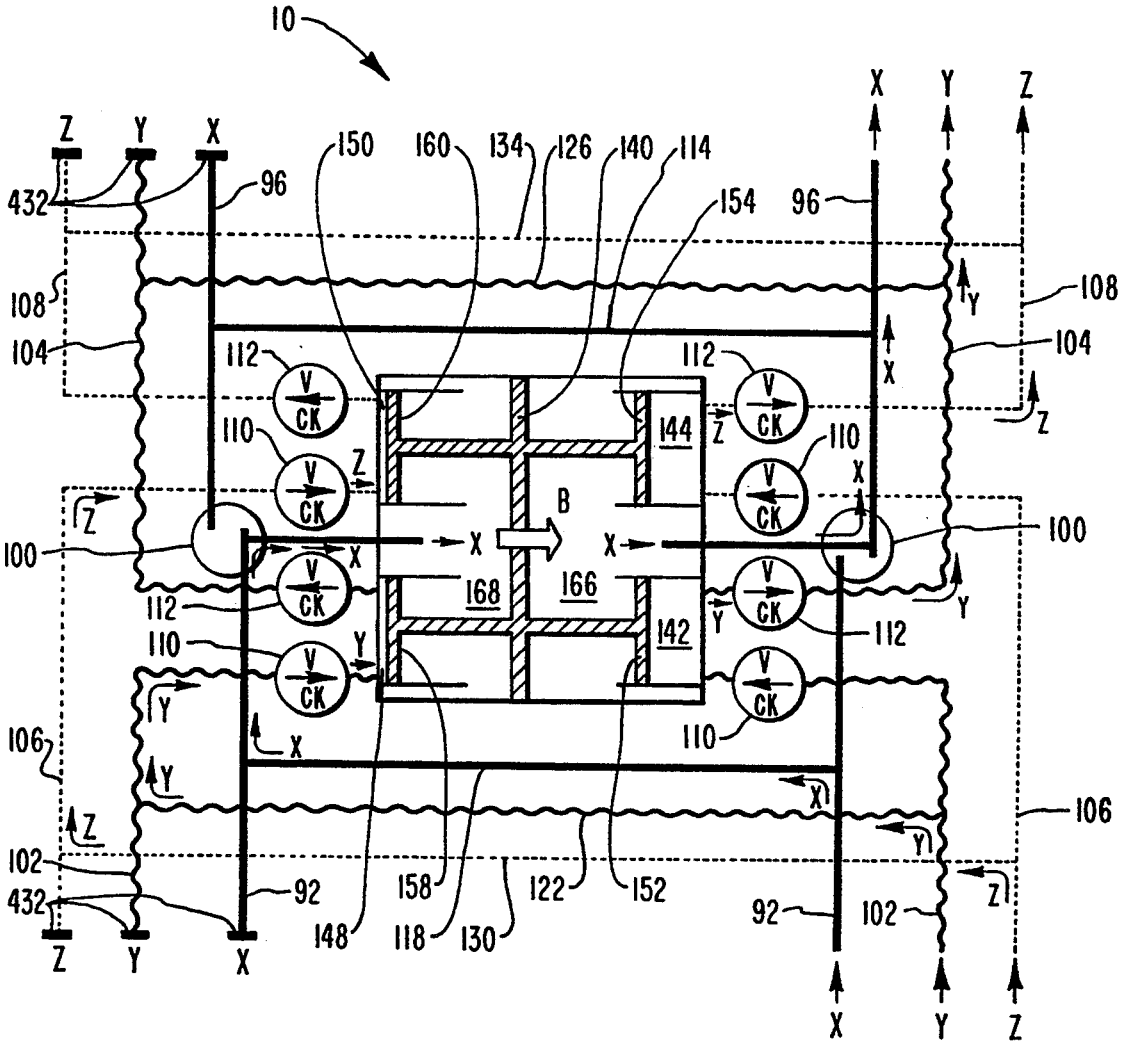
FIG. 18A is a schematic fluid flow diagram of the proportioning pump of FIG. 1 coupled to a single source of pressurized fluid and positioned corresponding to the cross-sectional longitudinal elevation view of the proportioning pump shown in FIG. 14A.

FIG. 18A illustrates the flow of fluids from single sources such as canisters 28, 32, 34 through proportioning pump 10 during movement of drive piston 140 in the direction shown by arrow B. This corresponds to the flow of fluids illustrated in FIGS. 14A–14C discussed previously.

Figure 18B:
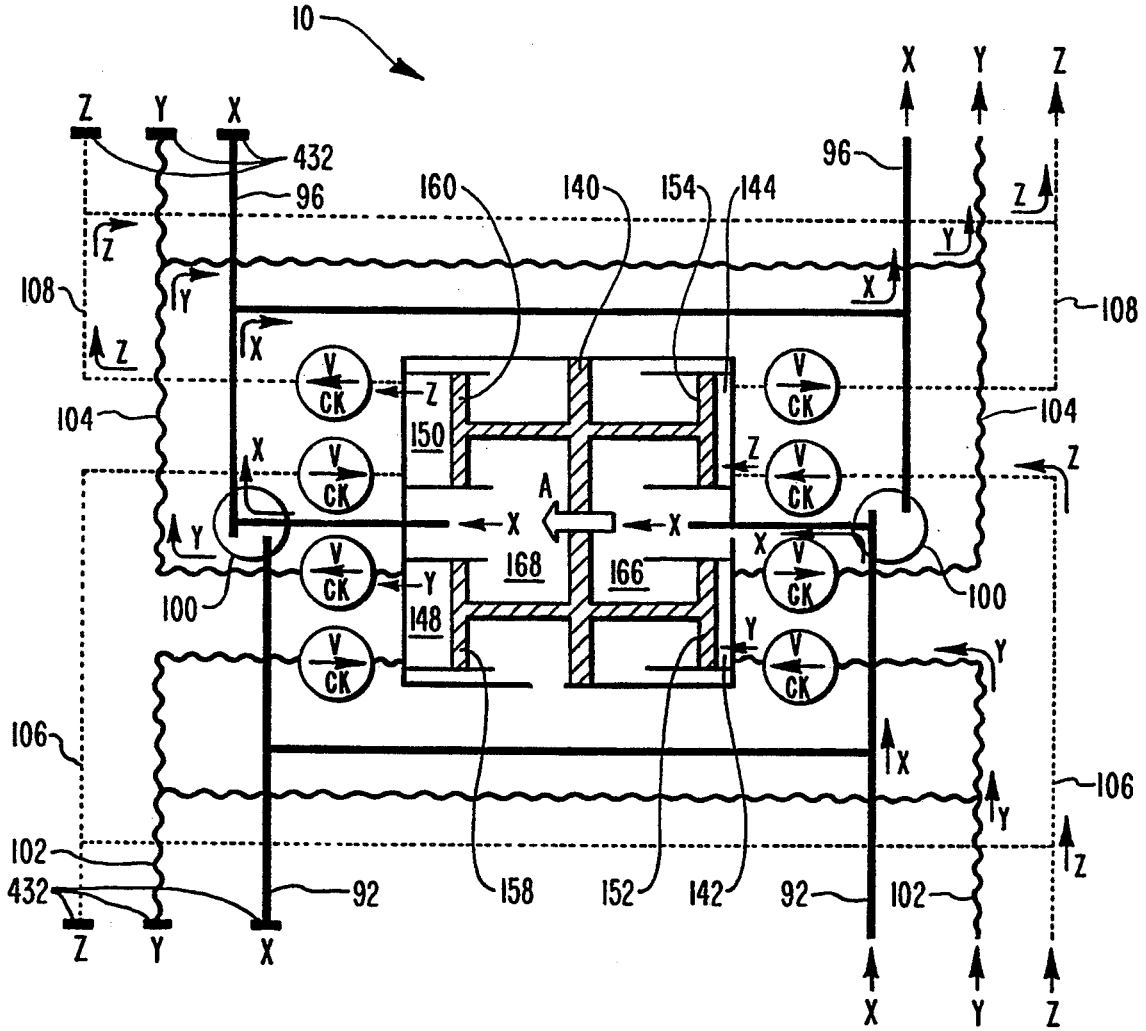
FIG. 18B is a schematic fluid flow diagram of the proportioning pump of FIG. 18A positioned corresponding to the cross-sectional longitudinal elevation view of the proportioning pump shown in FIG. 14D.

FIG. 18B illustrates the flow of fluids through proportioning pump 10 when the direction of movement of drive piston 140 has been reversed and corresponds to that illustrated by arrow A. FIG. 18B illustrates the flow of fluids through proportioning pump 10 corresponding to the state of proportioning pump 10 illustrated in FIG. 14D.

Figure 19A:
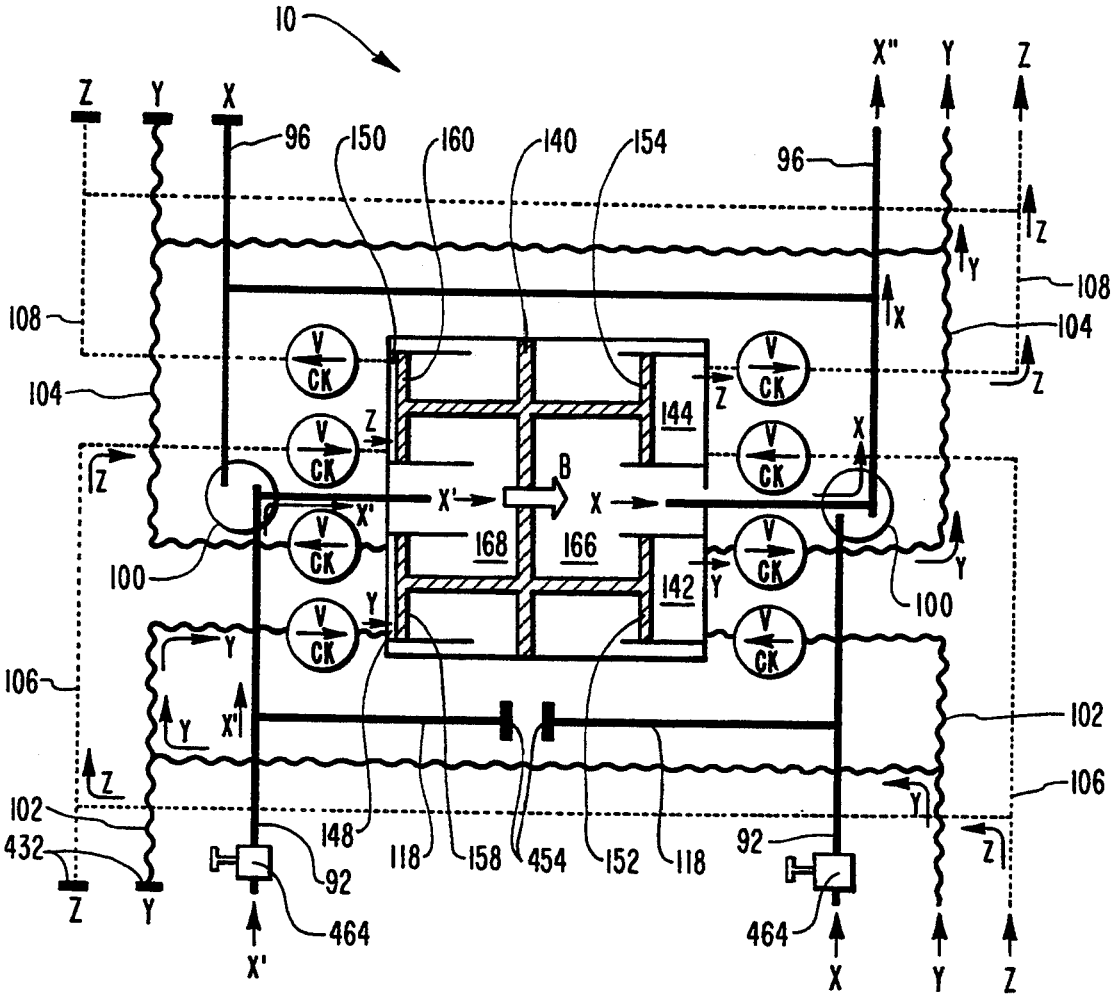
FIG. 19A is a schematic fluid flow diagram of the proportioning pump of FIG. 1 coupled to two distinct sources of pressurized fluid and positioned corresponding to the cross-sectional longitudinal elevation view of the proportioning pump shown in FIG. 14A.

FIG. 19A depicts a situation in which transverse pressurized drive fluid inlet passageway 118 is blocked by plugs 454, and the pressurized drive fluid inlet passageway 92 on the left side of FIG. 19A adjacent to second drive fluid chamber 168 is coupled to a source of a second drive fluid X′ that differs from the first drive fluid X supplied to first drive fluid chamber 166. Under such circumstances, second drive fluid chamber 168 dispenses the second drive fluid X′, while first drive fluid chamber 166 dispenses the first drive fluid X. Both drive fluids are pressurized. On alternate strokes of the reciprocating motion of drive piston 140, one of first drive fluid X or second drive fluid X′ is dispensed as a mixed, discharged drive fluid X". Advantageously, first drive fluid X may be a highly carbonated drive fluid, while second drive fluid X′ can be only slightly carbonated or entirely noncarbonated.

Figure 19B:
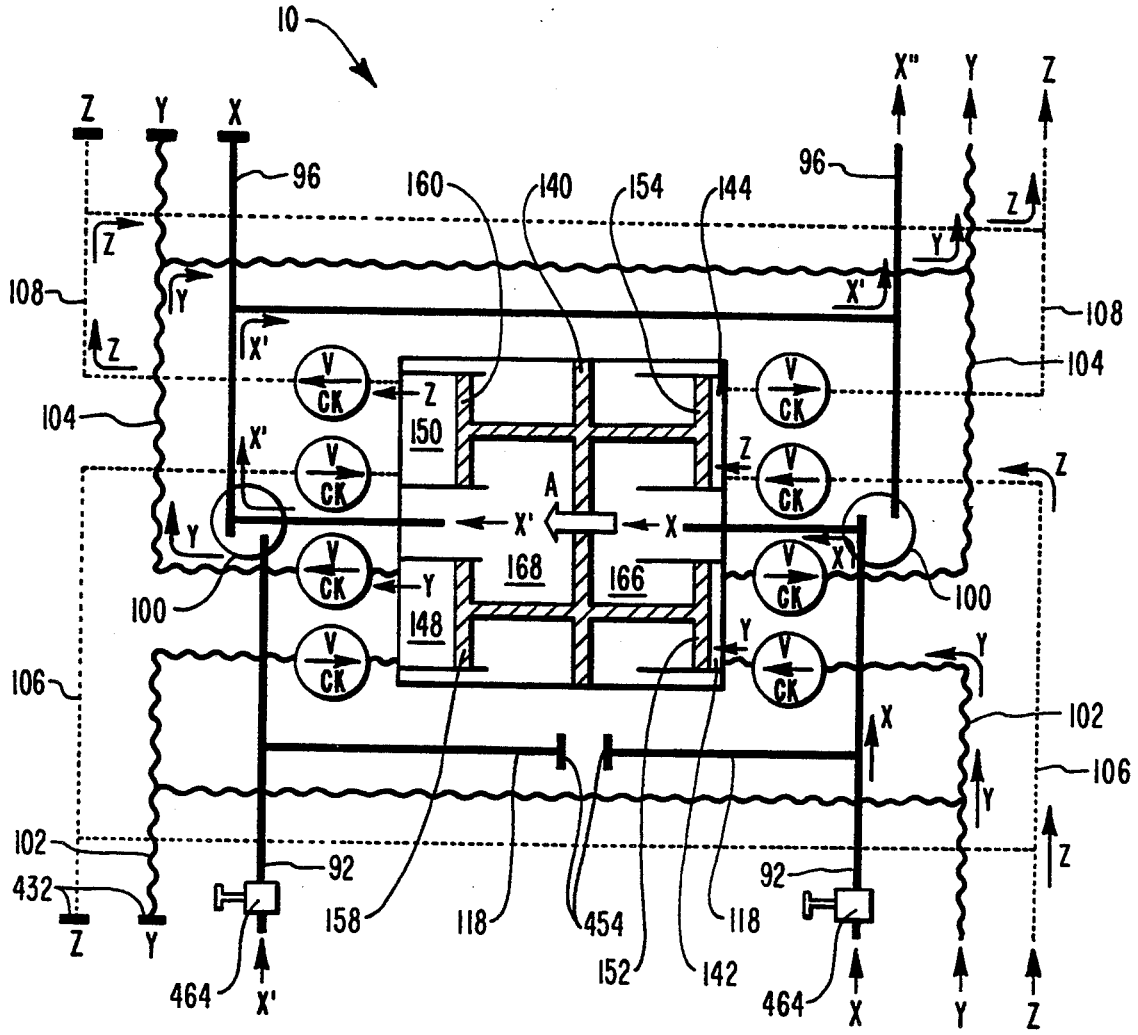
FIG. 19B is a schematic fluid flow diagram of the proportioning pump of FIG. 19A positioned corresponding to the cross-sectional longitudinal elevation view of the proportioning pump shown in FIG. 14D.

In FIG. 19A, first drive fluid X is being dispensed from first drive fluid chamber 166 by movement of drive piston 144 in the direction shown by arrow B. There mixed discharged drive fluid X" will be compressed of first drive fluid X almost exclusively. In FIG. 19B, second drive fluid X′ is illustrated being dispensed from second drive fluid chamber 168 as drive piston 140 moves in the direction indicated by arrow A. There mixed discharged dry fluid X" will be comprised of second drive fluid X′ almost exclusively.

Under such conditions, it is advisable to employ an external valve 464 in each of the respective pressurized drive fluid inlet passageways 92 for first drive fluid X and for second drive fluid X′. The adjustment of valves 464 will enable the equalization of the pressure exerted within proportioning pump 60 by each of these two drive fluids on each of the alternating strokes of reciprocating movement of drive piston 140.

The subject invention also embodies methods for proportioning a plurality of at least three fluids in a precise, predetermined ratio. That method comprises the steps of valving a pressurized drive fluid alternately to opposite sides of a drive piston slidably disposed for reciprocating motion in a drive cylinder using valving disposed within the drive cylinder, where the drive cylinder is comprised of first and second identical hollow housings. Further, the method comprises the step of venting the side of the drive piston not provided with the pressurized drive fluid to enable the reciprocating motion of the drive piston and the positive displacement of the drive fluid from the side of the drive piston not provided with the pressurized drive fluid. On each side of the drive piston, a pair of proportioning pistons are secured extending parallel to the axis of the drive cylinder into individual corresponding proportioning cylinders. The proportioning cylinders advance into and recede within the corresponding proportioning cylinders in the reciprocating motion of the drive piston. The method further includes the steps of supplying the constituent fluid or fluids to the proportioning cylinders as the proportioning pistons receive therein and venting the proportioning cylinders as the proportioning pistons advance thereinto. This enables the positive displacement of the constituent fluids therefrom.

As discussed above, the method of the present invention includes the steps of configuring passageways for the drive fluid to produce flow of the drive fluid that is substantially vertical and configuring passageways for the constituent fluids to produce flow thereof that is also substantially vertical.

The proportioning piston is secured to a fixed surface in a manner as to optimize the vertical flow of fluids through the proportioning pump.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for dispensing in a precise predetermined ratio quantities of a first fluid that is externally pressurized and a second fluid, said apparatus comprising:

(a) reciprocating means for continuously dispensing the first fluid, said reciprocating means comprising:

(i) a stationary portion comprising first and second identical hollow housings, each of said first and second hollow housings having an open end, and said first and second hollow housings being mutually matingly engaged at said open ends thereof to define therewithin opposed first and second fluid chambers; and (ii) an active portion housed within said stationary portion, said active portion being driven in a reciprocating motion comprising successive strokes in opposite directions alternately toward said first and toward said second fluid chambers;

(b) first and second reservoir means for holding a predetermined quantity of the second fluid, said first and second reservoir means being located individually in said first and second fluid chambers, respectively; and (c) fluid advancement means for continuously dispensing the second fluid, said fluid advancement means being operably connected to said active portion of said reciprocating means, thereby to draw said predetermined quantity of the second fluid into one of said first and second reservoir means and to positively displace said predetermined quantity of the second fluid from the other of said first and second reservoir means during each of said strokes in said motion of said reciprocating means.

2. An apparatus as recited in claim 1, wherein each of said first and second hollow housings comprises:

(a) shell means for defining a single closed end of a drive cylinder and for enclosing in the interior thereof an individual one of said first and second fluid chambers; and (b) fluid communication means for coupling sources of the first fluid and the second fluid to the interior of said shell means.

3. An apparatus as recited in claim 2, wherein said shell means comprises a cup-shaped canister, said canister comprising:

(a) an end wall;

(b) sidewalls projecting from the periphery of said end wall; and (c) a mating surface on the ends of said sidewalls remote from said end wall, said mating surface of said canister of said first hollow housing and said mating surface of said canister of said second hollow housing being engaged in an assembled relationship of said canisters to form a sealing joint of said drive cylinder, said canisters in said assembled relationship defining on the interior thereof said first and second fluid chambers.

4. An apparatus as recited in claim 3, further comprising a drive cylinder liner sleeve disposed against the interior of said sidewalls of said canisters in said assembled relationship thereof, said drive cylinder liner sleeve being positioned along said sidewalls of said canisters bridging said sealing joint of said drive cylinder.

5. An apparatus as recited in claim 4, further comprising a sealing ring encircling the outer surface of said drive cylinder liner sleeve, said sealing ring being disposed between said drive cylinder liner sleeve and said sidewalls of said canisters at said sealing joint of said drive cylinder.

6. An apparatus as recited in claim 5, wherein a continuous retaining slot is formed in said outer surface of said drive cylinder liner sleeve, and said sealing ring is disposed in said retaining slot.

7. An apparatus as recited in claim 4, wherein said drive cylinder liner sleeve is retained longitudinally in a drive cylinder liner recess formed in said interior of said sidewalls of said canisters adjacent to said mating surfaces thereof.

8. An apparatus as recited in claim 4, further comprising first and second sealing rings, each of said sealing rings encircling the outer surface of said drive cylinder liner sleeve and being disposed between said drive cylinder liner sleeve and said sidewalls of individual of said canisters on opposite sides of said sealing joint of said drive cylinder.

9. An apparatus as recited in claim 8, wherein continuous distinct first and second sealing ring retaining slots are formed in said outer surface of said drive cylinder liner sleeve, and said first and second sealing rings are disposed in said first and second sealing ring retaining slots, respectively.

10. An apparatus as recited in claim 3, wherein said fluid communication means comprises a fluid tubing manifold nestable about the exterior of a corresponding canister of said canisters of said first and second hollow housings, said fluid tubing manifold comprising:

(a) an end plate positionable against the exterior of said end wall of said corresponding canister;

(b) an assembly cage extending from said end plate along the exterior of said sidewalls of said corresponding canister; and (c) a fluid tubing manifold assembly flange on the end of said assembly cage remote from said end plate of said fluid tubing manifold.

11. An apparatus as recited in claim 10, wherein said assembly cage comprises at least one fluid passageway.

12. An apparatus as recited in claim 10, wherein said assembly cage comprises a pair of assembly arms diametrically disposed on opposite sides of said end plate, each of said assembly arms having a free end remote from said end plate of said fluid tubing manifold.

13. An apparatus as recited in claim 12, wherein said fluid tubing manifold assembly flange is comprised of distinct first and second portions thereof located individually on said free end of each of said pair of assembly arms.

14. An apparatus as recited in claim 10, further comprising a clamp engaging said fluid tubing manifold assembly flanges of said fluid tubing manifold of said canisters of said first and second hollow housings.

15. An apparatus as recited in claim 14, wherein said clamp comprises a pair of semicircular bands nondestructively mutually attachable at the ends thereof in tight encirclement of said stationary portion.

16. An apparatus as recited in claim 12, wherein each of said canisters further comprises a drive cylinder assembly flange extending radially outwardly from at least a portion of the circumference of said mating surface.

17. An apparatus as recited in claim 16, further comprising a clamp engaging said drive cylinder assembly flanges of said canisters of said first and second hollow housings and said fluid tubing manifold assembly flanges of said fluid tubing manifolds of said first and second hollow housings.

18. An apparatus as recited in claim 17, wherein said clamp comprises a pair of semicircular bands nondestructively mutually attachable at the ends thereof in tight encirclement of said stationary portion.

19. An apparatus as recited in claim 3, wherein said canisters are so constructed as to be substantially stable dimensionally when the first fluid is supplied thereinto by said fluid communication means.

20. An apparatus as recited in claim 19, wherein said canisters are comprised of a castable material.

21. An apparatus as recited in claim 20, wherein said castable material comprises stainless steel.

22. An apparatus as recited in claim 19, wherein said canisters are comprised of a moldable material.

23. An apparatus as recited in claim 22, wherein said moldable material comprises a glass-filled polysulfon.

24. An apparatus as recited in claim 19, further comprising a drive cylinder liner sleeve disposed against the interior of said sidewalls of said canisters in said assembled relationship thereof, said drive cylinder liner sleeve being positioned along said sidewalls of said first and second canisters bridging said sealing joint of said drive cylinder.

25. An apparatus as recited in claim 24, wherein said drive cylinder liner sleeve is comprises of a material having a high lubricity.

26. An apparatus as recited in claim 25, wherein said drive cylinder liner sleeve is comprised of a material having a high teflon content.

27. A fluid-driven pump powered by and dispensing an externally pressurized drive fluid, said pump comprising:

(a) a drive cylinder having closed ends and sidewalls extending therebetween;

(b) a drive piston disposed in said drive cylinder and propelled by the drive fluid in a reciprocating motion comprising successive strokes of said drive piston in opposite directions, said drive piston separating said drive cylinder into a first and a second drive fluid chamber;

(c) drive reversal means for admitting the pressurized drive fluid alternately into said first and said second drive fluid chambers, thereby to propel said drive piston in said reciprocating motion and to positively displace drive fluid alternately from said second and said first drive fluid chambers, respectively; and (d) a drive cylinder liner sleeve disposed against the interior of said sidewalls of said drive cylinder.

28. A fluid-driven pump as recited in claim 27, wherein said drive cylinder liner sleeve is disposed at a longitudinally medial position along said interior of said sidewalls of said drive cylinder.

29. A fluid-driven pump as recited in claim 28, wherein said drive cylinder liner sleeve is disposed along said interior of said sidewalls of said drive cylinder at longitudinal positions thereupon corresponding to all longitudinal positions of-said drive piston during said reciprocating motion thereof.

30. A fluid-driven pump as recited in claim 27, wherein said drive cylinder liner sleeve is comprised of a material having a high lubricity.

31. A fluid-driven pump as recited in claim 27, wherein said sidewalls of said drive cylinder are so constructed as to be substantially stable dimensionally when the drive fluid is supplied thereinto.

32. A fluid-driven pump as recited in claim 31, wherein said sidewalls of said drive cylinder are comprised of a castable material.

33. A fluid-driven pump as recited in claim 31, wherein said sidewalls of said drive cylinder are comprised of a moldable material.

34. A fluid-driven pump as recited in claim 33, wherein said sidewalls of said drive cylinder are comprised of a glass-filled polysulfon.

35. A fluid-driven pump as recited in claim 31, wherein said drive cylinder liner sleeve is comprised of a material having a high lubricity.

36. A fluid-driven pump as recited in claim 35, wherein said drive cylinder liner sleeve is comprised of a material having a high teflon content.

37. A fluid-driven pump as recited in claim 27, wherein said drive reversal means is disposed within said drive cylinder.

38. A fluid-driven pump as recited in claim 27, further comprising:

(a) a circumferential retaining slot formed about the periphery of said drive piston opposing said interior of said sidewalls of said drive cylinder; and (b) a sealing ring disposed in said retaining slot slidingly engaging the interior of said drive cylinder liner sleeve.

39. A fluid-driven pump as recited in claim 27, wherein said drive cylinder comprises first and second identical cup-shaped canisters, each of said first and second canisters comprising:

(a) an end wall;

(b) sidewalls projecting from the periphery of said end wall; and (c) a mating surface on the end of said sidewalls remote from said end wall, said mating surface of said first canister and said mating surface of said second canister being engaged in an assembled relationship of said canisters to form a sealing joint of said drive cylinder, said canisters in said assembled relationship thereof defining on the interior thereof said first and second fluid chambers.

40. A fluid-driven pump as recited in claim 39, wherein said drive cylinder liner sleeve is disposed against the interior of said sidewalls of said first and second canisters in said assembled relationship thereof positioned along said interior of said sidewalls of said first and second canisters bridging said sealing joint of said drive cylinder.

41. A fluid-driven pump as recited in claim 40, further comprising a sealing ring encircling the outer surface of said drive cylinder liner sleeve.

42. A fluid-drive pump as recited in claim 41, wherein said sealing ring is disposed between said outer surface of said drive cylinder liner sleeve and said interior of said sidewalls of said canisters at said sealing joint of said drive cylinder.

43. A fluid-driven pump as recited in claim 40, further comprising:

(a) a first sealing ring encircling the outer surface of said drive cylinder liner sleeve and being disposed between said outer surface of said drive cylinder liner sleeve and said interior of said sidewalls of said first canister; and (b) a second sealing ring encircling said outer surface of said drive cylinder liner sleeve and being disposed between said outer surface of said drive cylinder liner sleeve and said interior of said sidewalls of said second canister.

44. A system for dispensing in a precise predetermined ratio quantities of an externally pressurized drive fluid and of a first and a second constituent fluid, said system comprising:

(a) a proportioning pump activated by the drive fluid, said proportioning pump comprising:

(i) a pump housing defining in the interior thereof a drive cylinder having closed ends and sidewalls extending therebetween, said drive cylinder having a longitudinal axis disposed generally centrally of and parallel to said sidewalls;

(ii) a drive piston disposed in said drive cylinder and propelled by the drive fluid in a reciprocating motion comprising successive strokes of said drive piston in opposite directions, said drive piston separating said drive cylinder into a first and a second drive fluid chamber;

(iii) a pair of first constituent fluid proportioning cylinders, each of said first constituent fluid proportioning cylinders having sidewalls and a longitudinal axis, said longitudinal axis of each of said first constituent fluid proportioning cylinders being disposed generally centrally of said sidewalls thereof parallel to said longitudinal axis of said drive cylinder, one of said first constituent fluid proportioning cylinders opening opposite said drive piston into each of said first and second drive fluid chambers;

(iv) a pair of second constituent fluid proportioning cylinders, each of said second constituent fluid proportioning cylinders having sidewalls and a longitudinal axis, said longitudinal axis of each of said second constituent fluid proportioning cylinders being disposed generally centrally of said sidewalls thereof parallel to said longitudinal axis of said drive cylinder, one of said second constituent fluid proportioning cylinders opening opposite said drive piston into each of said first and said second drive fluid chambers;

(v) a constituent fluid inlet passageway corresponding to each of said first and second constituent fluid proportioning cylinders;

(vi) a constituent fluid outlet passageway corresponding to each of said first and second constituent fluid proportioning cylinders, each of said constituent fluid outlet passageways opening onto a corresponding one of said first and second constituent fluid proportioning cylinders at a constituent fluid discharge site located radially remote from said longitudinal axis of said corresponding one of said first and second constituent fluid proportional cylinders, whereby when the rotational orientation of said drive cylinder about said longitudinal axis thereof is such that said constituent fluid discharge sites are at the top of said corresponding one of said first and second constituent fluid proportioning cylinders, air bubble accumulation in said corresponding one of first and second constituent fluid proportioning cylinders is suppressed; and (vii) a pair of proportioning pistons projecting from each side of said drive piston, said proportioning pistons extending into corresponding individual ones of said first and second constituent fluid proportioning cylinders, said reciprocating motion of said drive piston alternately advancing and retracting said constituent fluid proportioning pistons within said corresponding ones of said first and second constituent fluid proportioning cylinders; and (b) mounting means for securing said proportioning pump to a fixed surface at any predetermined rotational orientation of said pump housing about said longitudinal axis of said drive cylinder.

45. A system as recited in claim 44, wherein each of said constituent fluid inlet passageways opens into a corresponding one of said first and second constituent fluid proportioning cylinders at a constituent fluid influx site located radially remote from said longitudinal axis of said corresponding one of said first and second constituent fluid proportioning cylinders on the side of said longitudinal axis opposite from said constituent fluid discharge site for said corresponding one of said first and second constituent fluid proportioning cylinders.

46. A system as recited in claim 44, wherein each of said constituent fluid outlet passageways is formed in said pump housing on the side of said longitudinal axis of said corresponding one of said first and second constituent fluid proportioning cylinders opposite from said constituent fluid discharge site for said corresponding one of said first and second constituent fluid proportioning cylinders.

47. A system as recited in claim 45, wherein each of said constituent fluid inlet passageways is formed in said pump housing on the side of said longitudinal axis of said corresponding one of said first and second constituent fluid proportioning cylinders opposite from said constituent fluid influx site for said corresponding one of said first and second constituent fluid proportioning cylinders.

48. A system as recited in claim 44, wherein said means for mounting comprises:

(a) clamp means for engaging said proportioning pump; and (b) a mount capable of securing said clamp means to a fixed surface.

49. A system as recited in claim 48, wherein said clamp means nondestructively encircles said proportioning pump at a longitudinally medial position thereon.

50. A system as recited in claim 48, wherein said clamp means comprises a pair of semicircular bands nondestructively mutually attachable at the ends thereof in tight encirclement of said pump housing.

51. A system as recited in claim 44, further comprising:

(a) drive reversal means for admitting the pressurized drive fluid alternately into said first and into said second fluid drive chambers, thereby to propel said drive piston in said reciprocating motion and to positively displace drive fluid alternately from said second and first drive fluid chambers, respectively; and (b) a drive fluid communication aperture associated with each of said first and second drive fluid chambers located radially remote from and on the same side of said longitudinal axis of said drive cylinder, admission of the drive fluid into said first and second fluid chambers and displacement of the drive fluid from said second and first drive fluid chambers occurring at said drive fluid communication apertures, whereby when the rotational orientation of said pump housing about said longitudinal axis of said drive cylinder is such that said drive fluid communication apertures are at the top of said drive cylinder, air bubble accumulation in said drive cylinder is suppressed.

52. A system as recited in claim 51, further comprising a drive fluid outlet passageway corresponding to and communicating with each of said first and second drive fluid chambers through said drive fluid communication aperture associated therewith, each of said drive fluid outlet passageways being formed in said pump housing on the opposite side of said drive fluid communication apertures from said longitudinal axis of said drive cylinder.

53. A system as recited in claim 52, further comprising a pressurized drive fluid inlet passageway corresponding to and communicating with each of said first and second drive fluid chambers through said drive fluid communication aperture associated therewith, each of said drive fluid inlet passageways being formed in said pump housing on the same side of said drive fluid communication apertures as said longitudinal axis of said drive cylinder.

54. A system as recited in claim 51 further comprising a pressurized drive fluid inlet passageway corresponding to and communicating with each of said first and second drive fluid chambers through said drive fluid communication aperture associated therewith, each of said drive fluid inlet passageways being formed in said pump housing on the same side of said drive fluid communication apertures as said longitudinal axis of said drive piston.

55. A system as recited in claim 54 wherein said proportioning pump is secured to a fixed surface by said mounting means with said drive fluid outlet passageways positioned higher than said pressurized drive fluid inlet passageways.

56. A system as recited in claim 53, wherein each of said drive fluid outlet passageways communicates with the exterior of said housing through an associated drive fluid outlet, and each of said drive fluid inlet passageways communicate with the exterior of said housing at a drive fluid inlet, said drive fluid outlets being on the opposite side of said longitudinal axis of said drive cylinder from said drive fluid inlets.

57. A system as recited in claim 56, wherein said proportioning pump is secured to a fixed surface by said mounting means with said drive fluid outlets positioned higher than said drive fluid inlets.

58. A system as recited in claim 57 wherein said drive fluid outlet associated with said drive fluid outlet passageway communicating with said first drive fluid chamber is positioned substantially vertically above said drive fluid inlet associated with said pressurized drive fluid inlet passageway communicating with said first drive fluid chamber.

59. A system as recited in claim 44, wherein said drive piston comprises:

(a) a pair of substantially identical drive piston plates mated in a back-to-back relationship, in said back-to-back relationship said drive piston plates forming about the periphery of said drive piston a circumferential retaining slot opposing the interior of said sidewalls of said drive cylinder; and (b) a sealing ring disposed in said retaining slot slidingly engaging said interior of said sidewalls of said drive cylinder.

60. A system as recited in claim 44, wherein one of said first constituent fluid proportioning cylinders and one of said second constituent fluid proportioning cylinders projects from each of said closed ends of said drive cylinder.

61. A system for dispensing in a precise, predetermined ratio quantities of an externally pressurized drive fluid and of a first and a second constituent fluid, said system comprising:

(a) a proportioning pump activated by the drive fluid, said proportioning pump comprising:

(i) a pump housing defining in the interior thereof a drive cylinder having closed ends and sidewalls extending therebetween, said drive cylinder having a longitudinal axis disposed generally centrally of and parallel to said sidewalls;

(ii) a drive piston disposed in said drive cylinder and propelled by the drive fluid in a reciprocating motion comprising successive strokes of said drive piston in opposite directions, said drive piston separating said drive cylinder into a first and a second drive fluid chamber;

(iii) drive reversal means for admitting the pressurized drive fluid alternately into said first and into said second fluid drive chambers, thereby to propel said drive piston in said reciprocating motion and to positively displace drive fluid alternately from said second and first drive fluid chambers, respectively;

(iv) a drive fluid communication aperture associated with each of said first and second drive fluid chambers located radially remote from and on the same side of said longitudinal axis of said drive cylinder, admission and displacement of the drive fluid into and from said second and first drive fluid chambers, respectively, occurring at said drive fluid communication apertures, whereby when the rotational orientation of said pump housing about said longitudinal axis of said drive cylinder is such that said drive fluid communication apertures are at the top of said drive cylinder, air bubble accumulation in said drive cylinder is suppressed;

(v) a pair of first constituent fluid proportioning cylinders, each of said first constituent fluid proportioning cylinders having sidewalls and a longitudinal axis, said longitudinal axis of each of said first constituent fluid proportioning cylinders being disposed generally centrally of said sidewalls of each of said first constituent fluid proportioning cylinders parallel to said longitudinal axis of said drive cylinder, one of said first constituent fluid proportioning cylinders opening opposite said drive piston into each of said first and second drive fluid chambers through said drive fluid communication aperture associated therewith;

(vi) a pair of second constituent fluid proportioning cylinders, each of said second constituent fluid proportioning cylinders having sidewalls and a longitudinal axis, said longitudinal axis of each of said second constituent fluid proportioning cylinders being disposed generally centrally of said sidewalls of each of said second constituent fluid proportioning cylinders parallel to said longitudinal axis of said drive cylinder, one of said second constituent fluid proportioning cylinders opening opposite said drive piston into each of said first and said second drive fluid chambers; and (vii) a pair of proportioning pistons projecting from each side of said drive piston, said proportioning pistons extending into corresponding individual ones of said first and second constituent fluid proportioning cylinders, said reciprocating motion of said drive piston alternately advancing and retracting said constituent fluid proportioning pistons within said corresponding ones of said first and second constituent fluid proportioning cylinders; and (b) mounting means for securing said proportioning pump to a fixed surface at any predetermined rotational orientation of said pump housing about said longitudinal axis of said drive cylinder.

62. A system as recited in claim 61, further comprising a drive fluid outlet passageway corresponding to and communicating with each of said first and second drive fluid chambers, each of said drive fluid outlet passageways being formed in said pump housing on the opposite side of said drive fluid communication apertures from said longitudinal axis of said drive cylinder.

63. A system as recited in claim 61, further comprising a pressurized drive fluid inlet passageway corresponding to and communicating with each of said first and second drive fluid chambers through said drive fluid communication aperture associated therewith, each of said drive fluid inlet passageways being formed in said pump housing on the same side of said drive fluid communication apertures as said longitudinal axis of said drive piston.

64. A system as recited in claim 62, further comprising a pressurized drive fluid inlet passageway corresponding to and communicating with each of said first and second drive fluid chambers through said drive fluid communication aperture associated therewith, each of said drive fluid inlet passageways being formed in said pump housing on the same side of said drive fluid communication apertures as said longitudinal axis of said drive piston.

65. A system as recited in claim 64, wherein said proportioning pump is secured to a fixed surface by said mounting means with said drive fluid outlet passageways positioned higher than said pressurized drive fluid inlet passageways.

66. A system as recited in claim 61, wherein said mounting means comprises:

(a) clamp means for engaging said proportioning pump; and (b) a mount capable of securing said clamp means to a fixed surface.

67. A system as recited ill claim 66, wherein said clamp means nondestructively encircles said proportioning pump at a longitudinally medial position thereon.

68. A system as recited in claim 66, wherein said clamp means comprises a pair of semicircular bands nondestructively mutually attachable at the ends thereof in tight encirclement of said pump housing.

69. A fluid-driven pump powered by and dispensing an externally pressurized drive fluid, said pump comprising:

(a) a pump housing defining in the interior thereof a drive cylinder having closing ends;

(b) a drive piston disposed in said drive cylinder and propelled by the drive fluid in a reciprocating motion comprising successive strokes of said drive piston in opposite directions, said drive piston separating said drive cylinder into a first and a second fluid drive chamber;

(c) a pressurized drive fluid inlet passageway formed in said pump housing at each end of said drive cylinder;

(d) a drive fluid outlet passageway formed in said pump housing at each end of said drive cylinder;

(e) first valve means for placing said first drive fluid chamber in communication alternately with said pressurized drive fluid inlet passageway and with said drive fluid outlet passageway formed in said pump housing at said end of said drive cylinder adjacent to said first drive fluid chamber;

(f) second valve means for placing said second drive fluid chamber in communication alternately with said pressurized drive fluid inlet passageway and with said drive fluid outlet passageway formed in said pump housing at said end of said drive cylinder adjacent to said second drive fluid chamber;

(g) linkage means for operably interconnecting said first valve means and said second valve means through said drive piston with plural dimensions of alignment freedom, thereby to simultaneously operate both said first and second valve means in either a first or a second operative mode thereof, in said first operative mode said first drive fluid chamber being in communication with said pressurized drive fluid inlet passageway formed in said pump housing at said end of said drive cylinder adjacent thereto and said second drive fluid chamber being in communication with said drive fluid outlet passageway formed in said pump housing at said end of said drive cylinder adjacent thereto, and in said second operative mode said first drive fluid chamber being in communication with said drive fluid outlet passageway formed in said pump housing at said end of said drive cylinder adjacent thereto and said second drive fluid chamber being in communication with said pressurized drive fluid inlet passageway formed in said pump housing at said end of said drive cylinder adjacent thereto; and (h) an over-center means for driving said linkage means to operate said first and second valve means between said first and second operative modes responsive to completion of each of said successive strokes of said reciprocating motion of said drive piston.

70. A fluid-driven pump as recited in claim 69, wherein said linkage means comprises:

(a) a valve linkage aperture formed through said drive piston between said first and second drive fluid chambers;

(b) a valve linkage shaft slidably disposed through said valve linkage aperture, said valve linkage shaft having first and second ends thereby being disposed in said first and second drive fluid chambers, respectively; and (c) a system of connective links between each of said first and second ends of said valving shaft and said first and second valve means, respectively.

71. A fluid-driven pump as recited in claim 70, wherein said linkage means further comprises a sealing ring disposed in said valve linkage aperture in sealing engagement with said valve linkage shaft.

72. A fluid-driven pump as recited in claim 70, wherein said first valve means comprises:

(a) a first valve bore extending from said first drive fluid chamber into said pump housing at said end of said drive cylinder adjacent to said first drive fluid chamber, said first valve bore communicating with said pressurized drive fluid inlet passageway and said drive fluid outlet passageway formed in said pump housing at said end of said drive cylinder adjacent to said first drive fluid chamber; and (b) a first valve stem having a first end slidably mounted in said first valve bore and a free end opposite thereto extending from said first valve bore into said first drive fluid chamber, said first valve stem having formed longitudinally therethrough a first valving passageway opening at a one end thereof in both said first and said second operative modes into said first drive fluid chamber through said free end of said first valve stem, the other end of said first valving passageway opening through a valving aperture in said first valve stem into said first valve bore, said valving aperture communicating with said pressurized drive fluid inlet passageway in said first operative mode and communicating with said drive fluid outlet passageway in said second operative mode.

73. A fluid-driven pump as recited in claim 72, wherein said first valve means further comprises a booster spring retained in said first valve bore in compression between said pump housing and said first end of said first valve stem, said booster spring urging said first valve stem out of said first valve bore toward said first drive fluid cylinder in said second operative mode.

74. A fluid-driven pump as recited in claim 72, wherein said system of links comprises a valve slide block pivotally and laterally slidably attached on a first side thereof to said first end of said valve linkage shaft and pivotally and laterally slidably attached on a second side thereof to said free end of said first valve stem.

75. A fluid-driven pump as recited in claim 74, wherein said valve slide block engages in reciprocating sliding motion against the inside of said drive cylinder when said over-center means drives said linkage means to operate said first and second valve means between said first and second operative modes.

76. A fluid-driven pump as recited in claim 74, wherein said system of links further comprises:

(a) an open-topped valve stem receiving recess formed through a wall of said slide block at said first side thereof;

(b) an open-topped valve stem retention pin receiving slot formed in said first side of said slide block normal to said valve stem receiving recess;

(c) a valve stem retention pin aperture formed laterally through said free end of said first valve stem;

(d) a valve stem retention pin slidably disposed through said valve stem retention pin aperture in said free end of said first valve stem, said valve stem retention pin projecting from each side of said first valve stem and being received in said valve stem retention pin receiving slot when said free end of said first valve stem is disposed in said valve stem receiving recess; and (e) a valve stem retention bar having a first edge received into said valve stem retention pin receiving slot bridging said valve stem receiving recess, thereby to trap said free end of said first valve stem with said valve stem retention pin passing therethrough in said valve stem receiving recess and said valve stem retention pin receiving slot, respectively, and to operably couple said free end of said first valve stem to said slide block while permitting tilting of said first valve stem relative to said slide block about said valve stem retention pin and lateral sliding of said first valve stem relative to said slide block along said valve stem retention pin.

77. A fluid-driven pump as recited in claim 76, wherein said valve stem retention bar has a second edge opposite said first edge thereof, said second edge of said valve stem retention bar projecting from said slide block and having a convex curvature complimentary to the curvature of the inside of said drive cylinder.

78. A fluid-driven pump as recited in claim 77, wherein said valve stem retention bar is comprised of a material that facilitates said reciprocating motion of said slide block along said inside of said drive cylinder.

79. A fluid-driven pump as recited in claim 76, wherein said system of links further comprises:

(a) an open-topped valve linkage shaft receiving recess formed through a wall of said slide block at said second side thereof;

(b) an open-topped valve linkage shaft retention pin receiving slot formed in said second side of said slide block normal to said valve linkage shaft receiving recess;

(c) a valve linkage shaft retention pin aperture formed laterally through said first end of said valve linkage shaft;

(d) a valve linkage shaft retention pin freely slidably disposed through said valve linkage shaft retention pin aperture in said first end of said valve linkage shaft, said valve linkage shaft retention pin projecting outwardly from each side of said valve linkage shaft and being received in said valve linkage shaft retention pin receiving slot when said first end of said valve linkage shaft is disposed in said valve linkage shaft recess; and (e) a valve linkage shaft retention bar having a first edge received into said valve linkage shaft retention pin receiving slot bridging said valve linkage shaft receiving recess, thereby to trap said first end of said valve linkage shaft with said valve linkage shaft retention pin passing therethrough in said valve linkage shaft receiving recess and said valve linkage shaft retention pin receiving slot, respectively, and to operably couple said first end of said valve linkage shaft to said slide block while permitting tilting of said valve linkage shaft relative to said slide block about said valve linkage shaft retention pin and sliding of said valve linkage shaft relative to said slide block along said valve linkage shaft retention pin.

80. A fluid-driven pump as recited in claim 79, wherein said valve linkage shaft retention bar has a second edge opposite said first end thereof, said second edge of said valve linkage shaft retention bar projecting from said slide block and having a convex curvature complimentary to the curvature of the inside of said drive cylinder.

81. A fluid-driven pump as recited in claim 80, wherein said valve linkage shaft retention bar is comprised of a material that facilitates said reciprocating motion of said slide block along said inside of said drive cylinder.

82. A fluid-driven pump as recited in claim 69, wherein said over-center means comprises:

(a) a first linkage bearing surface attached to said linkage means on a first side of said drive piston;

(b) a first drive bearing surface attached to said drive piston on said first side thereof, said first drive bearing surface being movable in each successive stroke of said reciprocating motion of said drive piston into a center position relative to said first linkage bearing surface in which said first drive bearing surface is maximally proximate thereto; and (c) first biasing means for urging said first linkage bearing surface and said linkage means attached thereto into said first operative mode on the side of said center position of said first drive bearing surface adjacent said drive piston and into said second operative mode on the side of said center position of said first drive bearing surface remote from said drive piston.

83. A fluid driven pump as recited in claim 82, wherein said over-center means further comprises:

(a) a second linkage bearing surface attached to said linkage means on a second side of said drive piston opposite from first side thereof;

(b) a second drive bearing surface rigidly attached to said drive piston on said second side thereof, said second drive bearing being movable in each successive stroke of said reciprocating motion of said drive piston into a center position relative said second linkage bearing surface in which said second drive bearing surface is maximally proximate thereto; and (c) second biasing means for urging said second linkage bearing surface and said linkage means attached thereto into said first operative mode on the side of said center position of said second drive bearing surface remote from said drive piston and into said second operative mode on the other side of said second position of said second drive bearing surface adjacent said drive piston.

84. A fluid driven pump as recited in claim 83, wherein said first and second linkage bearing surfaces and said first and second drive bearing surfaces, respectively, are so positioned relative each other that in each successive stroke of said reciprocating motion of said drive piston said drive bearing surface that follows said drive piston reaches said center position thereof prior to said drive bearing surface that leads said drive piston.

85. A fluid driven pump as recited in claim 83, wherein said over-center mechanism further comprises spring shoes attached to said drive piston on said first and second sides thereof, respectively, and wherein said first and second drive bearing surfaces each comprise a spring-receiving slot formed in said first and second spring shoes, respectively.

86. A fluid driven pump as recited in claim 84, wherein said over-center means further comprises leverage means for interacting with and enhancing the effect in driving said linkage means of said biasing means associated with said drive bearing surface that leads said drive piston after said drive bearing surface that leads said drive piston passes said center piston thereof.

87. A fluid driven pump as recited in claim 86, wherein said leverage means comprises a kicker ridge projecting from each of said closed ends of said drive cylinder into said first and second drive fluid chambers, respectively.

88. A fluid driven pump as recited in claim 82, wherein said first biasing means comprises two pair of springs mounted in compression between said first linkage bearing surface and said first drive bearing surface.

89. A fluid-driven pump as recited in claim 86, wherein each spring of said pair of springs comprises a resilient C-shaped loop.

90. A fluid-driven pump as recited in claim 89, wherein said loop has an ambit greater than 180 degrees.

91. A fluid-driven pump as recited in claim 89, wherein the ends of said loop are provided with mounting balls.

92. A fluid-driven pump as recited in claim 91, wherein said over-center mechanism further comprises a valve slide block operably connected to said first valve means, and wherein said first linkage bearing surface comprises hemispherical sockets formed in said valve slide block, said sockets being so sized as to receive and retain individual of said mounting balls.

93. A fluid-driven pump as recited in claim 91, wherein said over-center mechanism further comprises a drive shoe operably connected to said drive piston, and wherein said drive bearing surfaces each comprise hemispherical sockets formed in said drive shoe, said sockets being so sized as to receive and retain individual of said mounting balls.

94. A fluid-driven pump as recited in claim 83, wherein said first and second bias means each comprise two pair of resilient C-shaped loops having an ambit greater than 180 degrees and being provided at the ends thereof with mounting balls.

95. An apparatus for dispensing in a precise predetermined ratio quantities of an externally pressurized drive fluid and a constituent fluid, said apparatus comprising:

(a) a drive cylinder having closed ends;

(b) a drive piston disposed in said drive cylinder and propelled by the drive fluid in a reciprocating motion comprising successive strokes of said drive piston in opposite directions, said drive piston separating said drive cylinder into a first and a second drive fluid chamber;

(c) a pair of proportioning cylinders for the constituent fluid, each Of said proportioning cylinders comprising a proportioning cylinder shell opening opposite said drive piston into a respective one of said first and second drive fluid chambers;

(d) a pair of proportioning pistons, one of said proportioning pistons corresponding to each of said proportioning cylinders, and each of said proportioning pistons comprising a proportioning piston footing projecting from an opposite side of said drive piston toward a corresponding one of said proportioning cylinders; and (e) ratio adjustment means for fixing a predetermined quantity of the constituent fluid to be drawn into and displaced from each of said proportioning cylinders by said reciprocating motion of said drive piston.

96. A proportioning pump as recited in claim 95, wherein said ratio adjustment means comprises:

(a) a proportioning cylinder sleeve retained in each of said proportioning cylinder shells, said proportioning cylinder sleeve having an internal bore of predetermined cross-section; and (b) a proportioning piston head secured to the end of each of said proportioning piston footings opposite from said drive pistol], said proportioning piston head having a cross-section complimentary to said predetermined cross-section of said proportioning cylinder sleeve and being slidably disposed in said proportioning cylinder sleeve, whereby said reciprocating motion of said drive piston alternately advances and retracts said proportioning piston head within said proportioning cylinder sleeve to alternately draw into and to positively displace from said proportioning cylinder said predetermined quantity of the constituent fluid.

97. A proportioning pump as recited in claim 96, wherein said proportioning cylinder sleeve is comprised of a material of high lubricity.

98. A proportioning pump as recited in claim 96, wherein said ratio adjustment means further comprises:

(a) a circumferential retaining slot is formed about the periphery of said proportioning piston head opposing the walls of said proportioning piston sleeve of said corresponding one of said proportioning pistons; and (b) a sealing ring disposed in said retaining slot slidingly engaging said walls of said proportioning piston sleeve of said corresponding one of said proportioning pistons.

99. A proportioning pump as recited in claim 95, wherein said proportioning pump further comprises:

(a) a constituent fluid inlet passageway communicating between the exterior of said drive cylinder and an associated one of each of said proportioning cylinders; and (b) a first check valve located within said constituent fluid inlet passageway oriented to permit one-way flow of the constituent fluid into said associated one of said proportioning cylinders.

100. A proportioning pump as recited in claim 99, wherein said first check valve comprises:

(a) a first check valve recess having opposed parallel end walls, said first check valve recess being formed across said constituent fluid inlet passageway with said end walls thereof normal to said constituent inlet passageway;

(b) a check valve seat disposed in said first check valve recess; and (c) a butterfly valve disposed in said first check valve seat and being oriented to permit one-way flow of the constituent fluid into said associated one of said proportioning cylinders.

101. A proportioning pump as recited in claim 100, wherein the portion of said constituent fluid inlet passageway between said first check valve recess and said associated one of said proportioning cylinders is eccentric both to said first check valve recess and to said associated one of said proportioning cylinders.

102. A proportioning pump as recited in claim 95, wherein said proportioning pump further comprises:

(a) a constituent fluid outlet passageway communicating between the exterior of said drive cylinder and an associated one of each of said proportioning cylinders; and (b) a second check valve located within said constituent fluid outlet passageway oriented to permit one-way flow of the constituent fluid out of said associated one of said proportioning cylinders.

103. A proportioning pump as recited in claim 102, wherein said second check valve comprises:

(a) a second check valve recess having opposed parallel end walls, said second check valve recess being formed across said constituent fluid outlet passageway with said end walls thereof normal to said constituent fluid outlet passageway;

(b) a check valve seat disposed in said second check valve recess; and (c) a butterfly valve disposed in said second check valve seat and being oriented to permit one-way flow of the constituent fluid out of said associated one of said proportioning cylinders.

104. A proportioning pump as recited in claim 103, wherein the portion of said constituent fluid outlet passageway between said second check valve recess and said associated one of said proportioning cylinders is eccentric both to said second check valve recess and to said associated one of said proportioning cylinders.

105. An apparatus for dispensing in a precise predetermined ratio quantities of an externally pressurized drive fluid and a constituent fluid, said apparatus comprising:

(a) a drive cylinder having closed ends;

(b) a drive piston disposed in said drive cylinder and propelled by the drive fluid in a reciprocating motion comprising successive strokes of said drive piston in opposite directions, said drive piston separating said drive cylinder into a first and a second drive fluid chamber;

(c) a pair of proportioning cylinders for the constituent fluid, one of said proportioning cylinders being disposed in each of said first and second drive fluid chambers, and each of said proportioning cylinders comprising:

(i) a proportioning cylinder shell projecting from a respective of said ends of said drive cylinder and opening opposite said drive piston into one of said first and second drive fluid chambers; and (ii) a proportioning cylinder sleeve retained in said proportioning cylinder shell, said proportioning cylinder sleeve having an internal bore of predetermined cross-section;

(d) a pair of proportioning pistons disposed on opposite sides of said drive piston, one of said proportioning pistons corresponding to each of said proportioning cylinders, and each of said proportioning pistons comprising:

(i) a proportioning piston footing projecting from one side of said drive piston toward said corresponding one of said proportioning cylinders; and (ii) a proportioning piston head secured to the end of said proportioning piston footing opposite from said drive piston, said proportioning piston head having a cross-section complimentary to said predetermined cross-section of said proportioning cylinder sleeve and being slidably disposed in said proportioning cylinder sleeve, whereby said reciprocating motion of said drive piston alternately advances and retracts said proportioning piston heads within said proportioning cylinder sleeves to alternately draw into and to positively displace from said proportioning piston a predetermined quantity of said constituent fluid.

106. A proportioning pump as recited in claim 105, further comprising:

(a) a constituent fluid inlet passageway communicating between the exterior of said drive cylinder and an associated one of each of said proportioning cylinders;

(b) a first check valve recess having opposed parallel end walls, said first check valve recess being formed across said constituent fluid inlet passageway with said end walls thereof normal to said constituent fluid inlet passageway;

(c) a check valve seat disposed in said first check valve recess; and (d) a butterfly valve disposed in said first check valve seat oriented to permit one-way flow of the constituent fluid into said associated one of said proportioning cylinders.

107. A proportioning pump as recited in claim 106, wherein the portion of said constituent fluid inlet passageway between said first check valve recess and said associated one of said proportioning cylinders is eccentric both to said first check valve recess and to said associated one of said proportioning cylinders.

108. A proportioning pump as recited in claim 105, further comprising:

(a) a constituent fluid outlet passageway communicating between the exterior of said drive cylinder and an associated one of each of said proportioning cylinders;

(b) a second check valve recess having opposed parallel end walls, said second check valve recess being formed across said constituent fluid outlet passageway with said end walls thereof normal to said second check valve recess;

(c) a check valve seat disposed in said second check valve recess; and (d) a butterfly valve disposed in said second check valve seat oriented to permit one-way flow of the constituent fluid out of said associated one of said proportioning cylinders.

109. A proportioning pump as recited in claim 108, wherein the portion of said constituent fluid outlet passageway between said second check valve recess and said associated one of said proportioning cylinders is eccentric both to said second check valve recess and to said associated one of said proportioning cylinder sleeves.

110. A proportioning pump as recited in claim 105, wherein said proportioning cylinder sleeve is comprised of a material of high lubricity.

111. A proportioning pump for dispensing in a precise, predetermined ratio quantities of an externally pressurized drive fluid and of a first and a second constituent fluid, said proportioning pump comprising:

(a) a drive cylinder having end walls and sidewalls extending therebetween;

(b) a drive piston positioned in said drive cylinder and propelled by the drive fluid in a reciprocating motion comprising successive strokes of said drive piston in opposite directions, said drive piston separating said drive cylinder into a first and a second drive fluid chamber;

(c) a first constituent fluid proportioning cylinder projecting from said end wall of said drive cylinder adjacent said first drive fluid chamber and opening into said first drive fluid chamber opposite said drive piston;

(d) a second constituent fluid proportioning cylinder projecting from said end wall of said drive cylinder adjacent said first drive fluid chamber and opening into said first drive fluid chamber opposite said drive piston; and (e) a first fluid tubing manifold nestable about the exterior of said drive cylinder at said first drive fluid chamber, said first fluid tubing manifold comprising an end plate positionable against the exterior of said end wall of said drive cylinder adjacent said first drive fluid chamber, said end plate having formed therein the following fluid passageways, each communicating from the exterior of said first fluid tubing manifold to said first drive fluid chamber through said end wall of said drive cylinder adjacent said first drive fluid chamber:

(i) a pressurized drive fluid inlet passageway;

(ii) a drive fluid outlet passageway;

(iii) a first constituent fluid inlet passageway;

(iv) a first constituent fluid outlet passageway;

(v) a second constituent fluid inlet passageway; and (vi) a second constituent fluid outlet passageway.

112. A proportioning pump as recited in claim 111, further comprising:

(a) a second constituent fluid proportioning cylinder projecting from said end wall of said drive cylinder adjacent said second drive fluid chamber and opening into said second drive fluid chamber opposite said drive piston;

(b) a second constituent fluid proportioning cylinder projecting from said end wall of said drive cylinder adjacent said second drive fluid chamber and opening into said second drive fluid chamber opposite said drive piston; and (c) a second fluid tubing manifold nestable about the exterior of said drive cylinder at said second drive fluid chamber, said second fluid tubing manifold comprising an end plate positionable against the exterior of said end wall of said drive cylinder adjacent said second drive fluid chamber, said end plate having formed therein the following fluid passageways, each communicating from the exterior of said second fluid tubing manifold to said second drive fluid chamber through said end wall of said drive cylinder adjacent said second drive fluid chamber:

(i) a pressurized drive fluid inlet passageway;

(ii) a drive fluid outlet passageway;

(iii) a first constituent fluid inlet passageway;

(iv) a first constituent fluid outlet passageway;

(v) a second constituent fluid inlet passageway; and (vi) a second constituent fluid outlet passageway.

113. A proportioning pump as recited in claim 112, further comprising universal fluid communication means for coupling selected of said fluid passageways formed in said first fluid tubing manifold with corresponding individual ones of said fluid passageways formed in said second tubing manifold.

114. A proportioning pump as recited in claim 113, wherein said universal fluid communication means comprises:

(a) a transverse pressurized drive fluid inlet passageway communicating between said pressurized drive fluid inlet passageway formed in said first fluid tubing manifold and said pressurized drive fluid inlet passageway formed in said second fluid tubing manifold; and (b) a transverse drive fluid outlet passageway communicating between said drive fluid outlet passageway formed in said first fluid tubing manifold and said drive fluid passageway formed in said second fluid tubing manifold.

115. A proportioning pump as recited in claim 113, wherein said universal fluid communication means comprises:

(a) a transverse first constituent fluid inlet passageway communicating between said first constituent fluid inlet passageway formed in said first fluid tubing manifold and said first constituent fluid inlet passageway formed in said second fluid tubing manifold; and (b) a transverse first constituent fluid outlet passageway communicating between said first constituent fluid outlet passageway formed in said first fluid tubing manifold and said first constituent fluid outlet passageway formed in said second fluid tubing manifold.

116. A proportioning pump as recited in claim 113, wherein said universal fluid communication means comprises:

(a) a transverse second constituent fluid inlet passageway communicating between said second constituent fluid inlet passageway formed in said first fluid tubing manifold and said second constituent fluid inlet passageway formed in said second fluid tubing manifold; and (b) a transverse second constituent fluid outlet passageway communicating between said second constituent fluid outlet passageway formed in said first fluid tubing manifolds and said second constituent fluid outlet passageway formed in said second fluid tubing manifold.

117. A proportioning pump as recited in claim 113, wherein said universal fluid communication means is disposed on the exterior of said sidewalls of said drive cylinder.

118. A proportioning pump as recited in claim 117, wherein said universal fluid communication means is integrally formed with said drive cylinder.

119. A proportioning pump as recited in claim 117, wherein said universal fluid communication means is distinct from said drive cylinder and nestable about the exterior of the sidewalls thereof.

120. A proportioning pump as recited in claim 119, wherein said universal fluid communication means comprises:

(a) first portion thereof integrally formed with said first fluid tubing manifold; and (b) a second portion thereof integrally formed with said second fluid tubing manifold, said first and second portions of said universal fluid communication means matingly engaging each other when said first and second fluid tubing manifolds nest about said exterior of said drive cylinder at said first and second drive fluid chambers, respectively.

121. A proportioning pump as recited in claim 113, wherein each of said fluid passageways formed in said first and second fluid tubing manifolds communicates with the exterior of said first and second fluid tubing manifolds, respectively, at openings that are provided with fittings for tubes for the drive and constituent fluids that are coupleable and selectively non-destructively uncoupleable therewith without tools.

122. A proportioning pump as recited in claim 113, wherein each of said fluid passageways formed in said first and second fluid tubing manifolds communicates with the exterior of said first and second fluid tubing manifolds, respectively, at openings that are selectively closable.

123. A proportioning pump as recited in claim 114 wherein said transverse pressurized drive fluid inlet passageway is selectively closeable.

124. A method for dispensing in a precise predetermined ratio quantities of a drive fluid and constituent fluid, said method comprising the steps of:

(a) valving a pressurized drive fluid alternately to opposite sides of a drive piston slidably disposed for reciprocating motion in a drive cylinder using valving disposed within said drive cylinder, said drive cylinder being comprised of first and second identical hollow housings, each of said first and second hollow housings having an open end and being mutually matingly engaged at said open ends thereof to form a sealing joint of said drive cylinder and to define said drive cylinder within said matingly engaged first and second hollow housings;

(b) venting the side of said drive piston not provided with the pressurized drive fluid to enable said reciprocating motion of said drive piston and the positive displacement of the drive fluid from said side of said drive piston not provided with the pressurized drive fluid;

(c) securing within said drive cylinder on each side of said drive piston a pair of proportioning pistons extending parallel to the axis of said drive cylinder into individual corresponding proportioning cylinders opening into said drive cylinder facing said drive piston, said proportioning pistons advancing into and receding within said corresponding proportioning cylinders in said reciprocating motion of said drive piston;

(d) supplying the constituent fluid to said proportioning cylinders as said proportioning pistons recede therein; and (e) venting said proportioning cylinders as said proportioning piston advances thereinto to enable the positive displacement of the constituent fluid therefrom.

125. A method as recited in claim 124, further comprising the step of disposing a drive cylinder liner sleeve against the interior of the side walls of said drive piston bridging said sealing joint of said drive cylinder.

126. A method as recited in claim 124, further comprising the steps of:

(a) securing said drive cylinder to a fixed surface;

(b) configuring passageways for the drive fluid associated with said drive cylinder to produce flow of the drive fluid that is substantially vertical; and (c) configuring passageways for the constituent fluid associated with said proportioning cylinders to produce flow of the constituent fluid that is substantially vertical.

127. A method as recited in claim 124, further comprising the step of coupling both sides of said drive cylinder to a source of the drive fluid using a single drive fluid supply hose.

128. A method as recited in claim 124, further comprising the steps of:

(a) coupling each side of said drive cylinder to a respective first and second source of a drive fluid; and (b) venting each side of the drive piston to a single output hose.

129. A method as recited in claim 124, further comprising the step of coupling both of said portioning cylinders to a single source of the constituent fluid using a single constituent fluid supply hose.

130. A method for dispensing in the precise, predetermined ratio quantities of an externally pressurized drive fluid and of a first and a second constituent fluid, said method comprising the steps of:

(a) valving a pressurized drive fluid alternately to opposite sides of a drive piston slidably disposed for reciprocating motion in a drive cylinder using valving disposed within said drive cylinder, said drive cylinder being comprised of first and second identical hollow housings, each of said first and second hollow housings having an open end and being mutually matingly engaged at said open ends thereof to form a sealing joint of said drive cylinder and to define said drive cylinder within said matingly engaged first and second hollow housings;

(b) venting the side of the piston not provided with the pressurized drive fluid to enable said reciprocating motion of said drive piston and the positive displacement of the drive fluid from said side of said drive piston not provided with the pressurized drive fluid;

(c) securing within said drive cylinder on each side thereof first and second proportioning pistons extending parallel to the axis of said drive cylinder into individual corresponding first and second proportioning cylinders that open into said drive cylinder facing said drive piston, said proportioning pistons advancing into and receding within said corresponding proportioning pistons in said reciprocating motion of said drive pistons;

(d) supplying the first and second constituent fluids to said first and second proportioning cylinders, respectively, as said corresponding proportioning pistons recede therein; and (e) venting said first and second proportioning cylinders as said corresponding proportioning pistons advance thereinto to enable the positive displacement of the first and second constituent fluid, respectively, therefrom.

131. A method as recited in claim 130, further comprising the step of disposing a drive cylinder liner sleeve against the interior of the side walls of said drive piston bridging said sealing joint of said drive cylinder.

132. A method as recited in claim 130, further comprising the steps of:

(a) securing said drive cylinder to a fixed surface;

(b) configuring passageways for said drive fluid associated with said drive cylinder to provide flow of the drive fluid that is substantially vertical;

(c) configuring passageways for the first constituent fluid associated with said first proportioning cylinder to provide flow of the first constituent fluid that is substantially vertical; and (d) configuring passageways for the second constituent fluid associated with said second proportioning cylinder that is substantially vertical.

133. A method as recited in claim 130, further comprising the step of coupling both sides of said drive cylinder to a source of drive fluid using a single drive fluid supply hose.

134. A method as recited in claim 130, further comprising the steps of:

(a) coupling each side of said drive cylinder to a respective first and second source of a drive fluid; and (b) venting each side of the drive piston to a single output hose.

135. A method as recited in claim 130, further comprising the step of:

(a) coupling both of said first portioning cylinders to a single source of the first constituent fluid using a single first constituent fluid using a single first constituent fluid supply hose; and (b) coupling both of said second portioning cylinders to a single source of the second constituent fluid using a single second constituent fluid supply hose.

* * * * *

UNITED STATES PATENT AND TRADEMARK OFFICE

CERTIFICATE OF CORRECTION

PATENT NO. : 5,388,725

DATED : February 14, 1995

INVENTOR(S) : WILLIAM H. LICHFIELD

It is certified that error appears in the above-indentified patent and that said Letters Patent is hereby corrected as shown below:

Column 3, line 65, "value" should be --valve--
Column 5, line 46, "quire" should be --require--
Column 6, line 39, "on to" should be --onto--
Column 7, line 45, "tile" should be --the--
Column 8, line 50, delete "a"
Column 10, line 68, before "formed" insert --is--
Column 12, line 20, "slidably" should be --slidable--
Column 19, line 20, "aperatured" should be --apertured--
Column 22, line 4, after "FIG. 3" insert --and--
Column 23, line 49, "not" should be --As--
Column 23, lines 52-53, delete "not shown in FIG.3."
Column 30, line 23, after "glass fibers" insert --or--
Column 33, line 16, "recess 112" should be --recesses 112--
Column 33, lines 30-31, "spacial" should be --spatial--
Column 33, line 34, "spacial" should be --spatial--
Column 34, line 2, "associate" should be --associated--
Column 34, line 26, "spacial" should be --spatial--
Column 35, line 15, delete "is"
Column 36, line 17, "comprising" should be --comprises--
Column 36, line 51, "passed" should be --past--
Column 36, line 63, "passed" should be --past--
Column 37, lines 26-27, delete "of drive"

UNITED STATES PATENT AND TRADEMARK OFFICE

CERTIFICATE OF CORRECTION

PATENT NO. : 5,388,725

DATED : February 14, 1995

INVENTOR(S) : WILLIAM H. LICHFIELD

It is certified that error appears in the above-indentified patent and that said Letters Patent is hereby corrected as shown below:

Column 38, line 11, after "and" insert --are--
Column 40, line 43, "contributing" should be --contributes--
Column 42, line 8, delete "that"
Column 42, line 23, "communicate" should be --communicates--
Column 44, line 38, "are" should be --is--
Column 46, line 62, "tends" should be --tend--
Column 53, line 9, "comprises" should be --comprised--
Column 53, line 42, "of-said" should be --of said--
Column 60, line 61, delete second occurrence of "a"
Column 64, line 20, "Of" should be --of--

Signed and Sealed this

Twenty-ninth Day of August, 1995

*Attest:*

Bruce Lehman

BRUCE LEHMAN

*Attesting Officer*

*Commissioner of Patents and Trademarks*